US007665250B2

(12) United States Patent
Powell

(10) Patent No.: US 7,665,250 B2
(45) Date of Patent: Feb. 23, 2010

(54) SYSTEM FOR CONSTRUCTION OF A COMPRESSION STRUCTURE WITH CORNER BLOCKS, KEY BLOCKS, AND CORNER BLOCK SUPPORTS

(76) Inventor: David W. Powell, 8108 Texas Plume, Austin, TX (US) 78759

( * ) Notice: Subject to any disclaimer, the term of this patent is extended or adjusted under 35 U.S.C. 154(b) by 830 days.

(21) Appl. No.: 10/837,924

(22) Filed: May 3, 2004

(65) Prior Publication Data

US 2004/0237439 A1 Dec. 2, 2004

Related U.S. Application Data

(60) Provisional application No. 60/467,410, filed on May 2, 2003.

(51) Int. Cl.
*E04B 1/32* (2006.01)
*E04H 14/00* (2006.01)
*E02D 27/32* (2006.01)

(52) U.S. Cl. ..... 52/87; 52/88; 52/89; 52/236.4; 52/297

(58) Field of Classification Search ..... 52/86, 52/87, 88, 234, 236.3, 236.4, DIG. 2, 263, 52/264, 296, 297, 89
See application file for complete search history.

(56) References Cited

U.S. PATENT DOCUMENTS 829,397 A * 8/1906 Gerber ..... 256/19
858,170 A * 6/1907 Gernaert ..... 52/86
1,097,269 A * 5/1914 Thomas ..... 52/87
1,120,104 A * 12/1914 Thomas ..... 52/87
1,327,889 A * 1/1920 Thomas ..... 52/87
1,851,137 A * 3/1932 MacMillan ..... 52/236.5
3,289,366 A * 12/1966 Abrams ..... 52/174
3,299,585 A * 1/1967 Wilkins ..... 52/13
3,696,574 A * 10/1972 Dietrich ..... 52/236.3
3,842,557 A * 10/1974 Brown ..... 52/301
3,861,102 A * 1/1975 Hodge ..... 52/236.3
3,902,294 A * 9/1975 Brown ..... 52/301
3,943,672 A * 3/1976 O'Sheeran ..... 52/73
4,041,666 A * 8/1977 Sargis ..... 52/405.1
4,137,679 A * 2/1979 Tully ..... 52/73
4,144,692 A * 3/1979 Jonas ..... 52/637
4,211,043 A * 7/1980 Coday ..... 52/79.1
4,378,664 A 4/1983 Andaya (Continued)

FOREIGN PATENT DOCUMENTS

BE 510326 9/1953

(Continued)

*Primary Examiner*—Michael Safavi
(74) *Attorney, Agent, or Firm*—Rick B. Yeager

(57) ABSTRACT

A structure assembled from a combination of stackable modules, each module assembled from multiple prefabricated, transportable blocks. The blocks are typically reinforced cast concrete formed in reusable molds. Module framing blocks may include arched corner blocks, key blocks that interlock with a pair of corner blocks, and optional center blocks. Other structural elements include roof, floor, and wall components that interlock with the framing modules. Modules may be stacked or nested to form structures including buildings, elevated roadways, and parking garages. Utilities may be provided through optional conduits formed in the corner elements. The framing supports raised floor modules for ease in mechanical system installation and modification. The roof elements support usable terraces and rainwater collection. The blocks are demountable and reusable. The modules are self-supporting during erection, and may be assembled without fasteners.

27 Claims, 39 Drawing Sheets

U.S. PATENT DOCUMENTS

| | | | | | |
|---|---|---|---|---|---|
| 4,422,269 | A | | 12/1983 | Giard | |
| 4,989,382 | A | * | 2/1991 | Spronken | 52/252 |
| 5,245,802 | A | * | 9/1993 | Davis | 52/86 |
| 5,826,381 | A | * | 10/1998 | Sasaki | 52/175 |
| 6,088,987 | A | * | 7/2000 | Simmons et al. | 52/592.6 |
| 6,332,298 | B1 | * | 12/2001 | Bigelow | 52/648.1 |
| RE39,097 | E | * | 5/2006 | Schilham | 52/263 |

FOREIGN PATENT DOCUMENTS

| | | |
|---|---|---|
| EP | A-0013570 | 7/1980 |
| FR | 631028 | 12/1927 |
| FR | 992152 | 10/1951 |
| GB | 115457 | 5/1918 |
| GB | A-1211716 | 11/1970 |

* cited by examiner

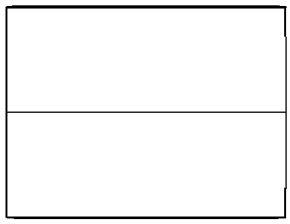
FIG. 12A
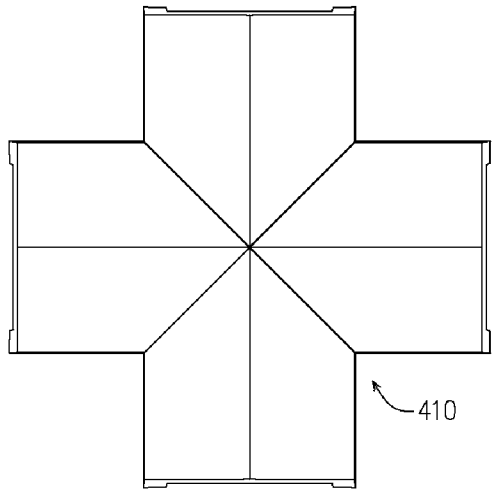
FIG. 12E
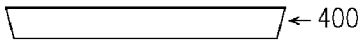
FIG. 12B
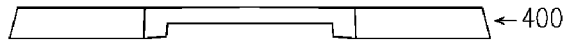
FIG. 12F
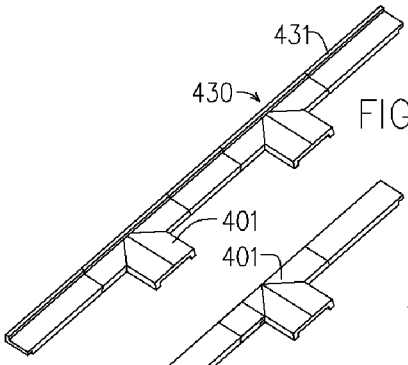
FIG. 12C
FIG. 12D
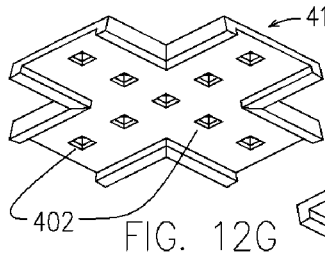
FIG. 12G
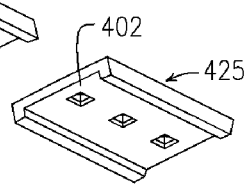
FIG. 12H
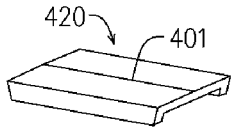
FIG. 12I
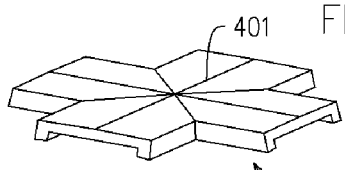
FIG. 12J

SYSTEM FOR CONSTRUCTION OF A COMPRESSION STRUCTURE WITH CORNER BLOCKS, KEY BLOCKS, AND CORNER BLOCK SUPPORTS

RELATED APPLICATIONS

This application is related to U.S. Provisional Patent Application No. 60/467,410 filed May 2, 2003, and claims the benefit of that filing date.

BACKGROUND OF THE INVENTION

1. Field of Invention

This invention relates to a system of construction involving interlocking stackable precast blocks where a combination of interlocking and overlapping structural blocks are used to create individual structural frame modules; frame modules may then be nested and stacked with the necessary interlock to build larger structures.

BACKGROUND

Various uses of precast blocks are known in the prior art. In tilt wall construction, for example, precast wall panels are erected on a site to create a shell. Precast beams and planks are used in building construction and other civil engineering projects, such as bridges. Typically, this type of construction is used to build rectangular, box-like frame blocks which may require further support such as cross bracing.

Other types of systems including precast geodesic structures have been shown in the prior art.

There is a need for a modular precast construction system which does not require additional bracing or supports and can be constructed in a manner that minimizes or eliminates the need for fasteners to be installed during the erection process. These features can maximize the speed and safety of construction. There is a need for precast modular structures which can be disassembled and reconfigured or moved and reassembled at another site. These features minimize the potential for a structure to fall to demolition and thus be converted from an asset into waste that then requires disposal.

2. Description of Related Art

Various types of construction are known in the prior art including wood framed buildings, steel framed buildings, precast concrete structures, and cast in place concrete structures.

The majority of structural design decisions that are made in conventional practice are driven by cost; there are enormous pressures on structural engineers of most building projects to minimize costs while upholding their first duty to ensure the safety of structures. These pressures tend to minimize the structure in many buildings. This tendency can be unfortunate when a structure is subjected to rare but extreme loads that cannot reasonably be incorporated into statistical load guidance provided by building codes.

Accordingly, engineered structures are typically designed to safely resist code-specified loads without necessarily providing large reserve capacity beyond that achieved by virtue of required safety factors. By building to provide structural capacities that are significantly in excess of those required to resist the minimum loads required by building codes, new opportunities are created in the functionality and versatility of the built structure.

The design of a structure of conventional construction typically seeks to concentrate forces to conserve usable floor space, and relies on secondary lateral systems, such as diagonal braces or shear walls, to stabilize the structure. Benefits can be gained by flaring the upper portion of a column structure to reduce the effective span of the structure supported by the column.

Conventional construction generally consists either cast-in-place construction with obstructive and costly formwork, or of interconnected stick or panel framing that relies on diagonal bracing or shear walls for lateral stability. Because much of conventional construction is inherently unstable until the construction of structural diaphragms and lateral systems are complete, structural failures during the relatively brief construction period are more common than in completed buildings that stand for years of service.

The lateral bracing and shoring that is typically required for conventional construction creates building site obstructions that contribute to many construction accidents. Because conventional construction commonly involves the field assembly of parts that can be lifted and handled by one or two workers, the construction of exterior walls and roofs generally involves a significant amount of labor far above ground level; this creates the potential for falling hazards that generate the most lethal jobsite injuries. Where conventional construction utilizes large parts, such as with tilt-wall construction, expensive crane time is typically consumed holding those parts in position while lateral shoring and bracing members and connections are installed; this is required to stabilize the part prior to releasing the hoisting lines. It is desirable to build using a system of independently stable modules that minimize or eliminate the need for temporary shoring and bracing, and that allow crane time to be utilized efficiently.

In the field of concrete buildings or concrete framed structures, the structural elements are typically either cast in place on site such as with flat-plate or beam and slab type of applications, prefabricated on-site such as with tilt wall construction, or prefabricated off-site such as with precast concrete planks, tees, and wall panels. Most significant building structures are built based on a unique design that is the result of the work a team of design professionals; the design of a given building is generally unique to that project. The design of unique projects under ever-increasing time, budget, and liability pressures presents real challenges to design professionals; it also places an enormous burden on the builder that must interpret and build a unique and complex project from what will inevitably prove to be an imperfect set of drawings and specifications. It is highly desirable to introduce a building system that allows design flexibility while offering vast simplifications in both design and construction; this can be accomplished by means of an expanding kit of compatible parts.

The use of on-site casting for concrete cast-in-place structures requires the expense and delay of field-fabricating the forms for pouring concrete. It is desirable to provide concrete structural elements which can be built in stacks or mass-produced by other means either on-site or under factory controlled conditions.

Tilt wall construction provides some advantage in precasting wall elements, but has the disadvantage of requiring the advance construction of large areas of grade-supported slab to serve as a casting surface for the wall blocks. Tilt wall construction also requires the use of temporary shoring during the assembly process to hold walls in place until additional structural elements are attached to the walls. It is desirable to provide pre-cast concrete structural elements that can be assembled into a variety of structural elements and finished buildings without the use of temporary shoring.

Concrete building blocks such as cinder blocks are typically provided in relatively small units that require laborintensive mortared assembly to form walls and structures. It is desirable to provide larger structural units that can be precast, trucked to a job site, and assembled together into a wide variety of structural forms without extensive use of mortar or adhesive.

Once conventional construction is complete, the modification or removal of a finished building generally involves destructive demolition. It is common practice in conventional construction to design for a relatively short building life span, and to simply demolish buildings that because of age, location, or poor initial construction have met the end of their useful service lives. This practice results in millions of tons of construction debris being hauled to landfills every year. It is desirable to build using a system that is built of durable but cost-effective construction and which offers ease of modification or removal and reuse without the waste of materials and manpower associated with conventional demolition practices. It is desirable to introduce a building system that enables the wholesale recycling and reuse of entire buildings by use of durably constructed large-scale building blocks.

BRIEF SUMMARY OF THE INVENTION

This methods and apparatus presented herein produce a structural shell and an architecturally finished space by means of modular, transportable blocks that are designed to interlock for structural stability.

The building system is designed to enable finished structures to be erected with remarkable speed. The system is also designed to use construction materials efficiently and to provide unique opportunities for the disassembly, reconfiguration, modification and relocation of finished structures. The building system is further designed to enable rapid integration and modification of mechanical, electrical, and plumbing (MEP) systems, and to provide a base for broad flexibility in interior and exterior architectural expression. Architecturally finished precast surfaces can also eliminate the cost, installation time, and indoor environmental problems associated with many common but less durable interior building finish products.

The building system is intended to introduce a unique line of large-scale building blocks to the construction industry, and to offer an expanding kit of parts from which quality structures may be quickly and economically built. It offers distinct advantages in the design, construction, and performance of the finished structure as compared with conventional construction utilizing structural steel, site-cast concrete, masonry, and wood-frame building systems. It also provides several environmental advantages to the growing numbers of people interested in "green" building, and has a wide variety of potential applications.

Design Advantages

This building system is intended to provide flexibility to the team of professionals that are typically responsible for the design of structures. The system is designed to provide a new set of large-scale building blocks to structural engineers, MEP engineers, architects, builders, developers, and owners, and it offers ease of modification in response to the needs of each.

Because the building system is modular and pre-engineered, the effort and time required to design a structure for a given application is greatly reduced. A design that grows in increments of a predetermined dimensional module not only saves time and cost in the fabrication of that design, it also simplifies the design process itself by setting a rhythm of dimensions that are easily identified and predictable. This allows the designer to focus on details that are unique to a given project and fall outside of a modular solution. Presuming that the acceptability of an intended use of each structural block has been confirmed by an engineering analysis, blocks may become modular "plug and play" elements that can be used in a variety of ways.

Liability Control

Design professionals and owners are required to make hundreds of decisions in the course of the design of any given project. More and more, these decisions are made under the pressure of aggressive construction schedules and budgets. Once made, decisions are often irrevocable without incurring the liability for significant costs. Once conventional construction has been completed, the labor and materials that have been invested into the project are at risk of requiring costly demolition and replacement to effect a late design change. Construction using this building system offers significant and unique relief to this problem, because the finished structure can be modified at any time with relative ease.

Structural Advantages

Varying structural demands can be met by individually manipulating the profile, cross section, and reinforcement of each of the components. The design is also largely scalable; the basic dimensional module can change and, within practical limits, components can be scaled along all three axes to produce a reduction or enlargement of the entire system. Further scaling can be accomplished by stretching the module about one or two axes in design and casting to extend or reduce span lengths or story heights The structure is generally designed to take advantage of natural arching action for the efficient and economical use of materials, and may be produced in a variety of spans, plan geometries, and vertical geometries. A compressive load path may be through shells (as in example embodiments) or through struts; one embodiment of this system takes the form of precast interlocking 3D frames that support standard floor joists or planks.

The inherent strength of the building system makes it a candidate for use in a variety of structural applications, as described below. A structure that has the capacity to safely resist overloads is one that can lend great comfort to the engineer and owner. A system of interlocking structural blocks that can be used to construct a building, transportation structure, or earth-sheltered structure can be a powerful tool in the hands of a structural engineer.

Structural actions and failure mechanisms for each prototype block will initially be confirmed by full-scale load testing. Data gathered during load tests will enable the refinement of design methodologies for determining the required structural geometry, reinforcement, and load carrying capacities of each block.

MEP Advantages

Varying MEP demands can be accommodated with relative ease by virtue of the access floor space that is created between the top of the structural shell and the underside of the standoff floor system. MEP demands for a given use can be met by modifying the standoff design height and therefore the access floor clear openings, by providing a simple method of access to and block-outs for MEP systems, and by providing modular access between levels via integral pipe sleeves within column elements and chases between structural modules. The underfloor space can be utilized for the construction or the modification of plumbing, electrical, heating, ventilation, air conditioning (HVAC), and data systems.

Although a standard HVAC system can be used, this building system has the potential to accommodate a ductless system air conditioning system that utilizes a pressurized plenum with variable fan floor registers for comfort control. By utilizing the subfloor space as a pressurized plenum for conditioned air, ductwork design and construction costs can be eliminated. The design of HVAC systems is simplified by the elimination of ductwork design, and job costs and construction time are reduced by the elimination of the need for ductwork. Reversal of the air flow could be designed to result in a self-cleaning floor that can be fitted with air filtration systems. The building system also accommodates radiant heating and/or cooling systems in conjunction with forced air flow in the access floor plenum, and thin-shell sections may lend themselves to radiant comfort control of the space by heating or cooling the structure. Perimeter blocks can accommodate spray-on, batt, integral insulation, or any other suitable insulation material as required to further limit the energy usage of an air-conditioned or heated building. This system offers new opportunities to MEP engineers and invites creative solutions not presented here. System requirements for a given application will be determined by MEP engineering analysis.

Acoustically sensitive spaces can incorporate blocks that utilize appropriately textured form liners, or blocks can accommodate cast-in acoustical materials that may be laid into molds prior to casting or bonded to the cast surface.

Architectural Advantages

Although each of the advantages described above carry obvious economic benefits for the owner, the typical owner will also be interested in the flexibility this system offers to the architect. This building system offers flexibility in structural module size, standoff height, floor-to-floor height, ceiling profile, span, and plan geometry. This flexibility can be exploited for variation in the exterior and interior architecture of the building. Plan flexibility can be further enhanced by non-rectangular plan modules, and by the ability to separate independent structural modules with gaps that may be left open or bridged with simple floor infill blocks that are easy to modify. Where a given architecture requires smaller modules, a span of the embodiment may consist of three blocks (two paired-column blocks and one full-width key block), or it may consist of a single, four-column block that is of sufficiently small size and weight that it may be cast and handled as a single element and therefore does not require segmenting into multiple smaller blocks.

To offer free rein in the architectural design of building exteriors, the building system is designed to accommodate both standard and customized perimeter wall and roof systems. Exterior wall block sets enable a variety of parapet heights and shapes, and can accommodate undulations in the design of exterior wall surfaces. Exterior walls can also accommodate canopies and roof segments to complete the range of architectural variability. By adjusting spans in modular increments using standard components, and by taking advantage of unlimited flexibility in perimeter wall geometry and construction, the footprint and exterior elevations of a building can be defined at the will of the architect. They can also be redefined at any point in the future at a lower cost and without the waste associated with modifying conventional construction.

Although it leads and provides the basis for the interior architecture, this system does not offer significant constriction to the layout and use of interior space. Finished surfaces of ceilings, columns, and floors may consist of a standard steel-formed finish that is transferred from the master to the mold set, or they may incorporate an unlimited variety of liners to form brick or stone patterns, tile patterns, corrugations, reveals, or geometric designs; they may also be cast against molds made of a hand-sculpted master. Blocks may incorporate integral admixtures or surface treatments for color variations, and offer the ability to embed decorative or acoustical materials into the exposed surfaces.

Because the structure is so prominent in the interior architecture, and because compression structures justifiably invoke the perception of durable, safe structure, the owners and occupants of buildings constructed of this system will likely find the space both architecturally comforting and inspirational.

Construction Advantages

Builders and contractors will find that this building system offers distinct advantages as compared to standard construction types. Builders will find this system very attractive because the simplified and repetitive assembly of parts offers the ability to rapidly erect and dry-in a project while drastically reducing the waste, losses, and multiple learning curves common to conventional construction.

Erection

Because blocks are designed to rapidly interlock without shoring and without fasteners, and because block dimensions are generally configured to allow transport on a flatbed trailer without special permit; they can be shipped to a prepared site and erected at a pace that cannot be approached using conventional site-built construction techniques.

Dry-in

This building system allows the majority of the work necessary to build the structural shell to be conducted in a controlled plant environment, independent of weather conditions. By shop fabricating the structural shell and exterior wall blocks, a majority of the work that normally requires site scaffolds or lifts is instead accomplished at ground level on the shop floor. This reduces risks to workers and thereby improves job safety. Plant production enhances quality control capabilities while largely eliminating the cost of weather delays, site waste, and the theft of tools and materials from the construction site. The building system uses concrete in an efficient manner, and the normal waste of site-cut and assembled materials in the construction of the finished building shell is virtually eliminated.

Finish-Out

Of further benefit to the contractor's schedule, interior trades can perform work in a weather-protected and secure environment at a much earlier point in the construction schedule than is possible with conventional building techniques. By routing systems below the floor instead of above the ceiling, the majority of the work that normally requires scaffolds or lifts is instead accomplished in the accessible space just below the floor. The total quantity of finish-out work is also significantly reduced. Because the erected structural shell provides finished surfaces at all structural frame and ceiling elements, sheetrock and suspended acoustical tile ceilings may not be necessary. As previously described, the reduction in required finish-out work includes the potential elimination of ductwork and the simplification of MEP system installation. If the building system is used as a rainwater collection system and/or parking structure, the costs of water quality detention ponds to treat runoff from the typical project can be reduced or eliminated.

Flexibility

The segmental mold construction methodology enables large, long-span blocks to be produced using this technique, such that structures of a wide variety of shapes and spans may be built with this system. Parts may be stackable, may remain interchangeable long after construction is completed, and should never fall to demolition. This flexibility should serve to benefit the builder by making owners less hesitant to build.

Economy

Building decisions are, by necessity, largely cost-driven. The advantages offered by this building system bring real value to the owner, and enhance the ability of the system to be cost-competitive. Simpler block sets are naturally more economical than more complex, longer span, or hand-sculpted sets. The expense of conventional reinforced concrete structures is largely driven by the cost of forming the concrete; this system is designed to minimized formwork costs by building durable molds that can be used again and again. A master may be expensive to build, but it may be used to produce multiple mold sets. Because multiple blocks can be produced from each mold set with limited effort, and because material costs of reinforcing steel and concrete are relatively low, large-scale production can be accomplished economically.

Environmental Advantages

This system offers the potential to minimize the environmental impact of construction in several ways. It offers the ability to reduce the disruption of the site due to construction, to reduce construction material waste and building product emissions, and to offer unique opportunities for recycling and rain water harvesting as compared to conventional construction.

Construction Site Disruption

Because this system is intended to provide cost-effective, suspended structure, it can be built with a significant reduction in site grading and disruption as compared to conventional construction. Whether supported by drilled piers and pier caps, footing blocks, or another foundation system, variable-height footing blocks or base blocks can be "planted" on discrete foundations in a manner that can significantly reduce the excavation, cut and fill that is typical on most construction projects. By elevating the first level of floor structure above the ground, the cut and fill that is generally required for slab-on-grade construction can be largely eliminated, along with the runoff and erosion problems that often accompany extensive earthwork.

Waste Reduction

Block production is a highly efficient use of construction materials and manpower. Mold sets are built to be used repetitively; avoiding the waste of materials and manpower that often accompanies conventional concrete formwork, which is typically discarded after a very limited number of uses. The material that is normally wasted, and which presents a disposal problem, is minimized by reducing the number of times the concrete mixing and placing equipment must be cleaned, and by having very small blocks, such as cap blocks, that can be made of what might have otherwise been an overage of the castable material at the end of a production session. Combining a waste-conscious concrete pumping operation with an array of block sizes ensures that essentially 100 percent of the concrete that is produced will make its way into useful building product. This is in sharp contrast to the typical construction project that sends dumpsters full of waste to the landfill.

So long as structural capacity is not diminished, blocks that are cast with minor flaws or defects are still usable, and can be patched or sold as "seconds" for use in more economical or industrial grade structures. As described previously, construction materials are also used with structural efficiency, by virtue of proportioning structures to generally take advantage of compressive action.

Waste Material Utilization

Blocks may be produced with concrete mixes that make use of flyash, an industrial waste product that has cementitious properties and can offer some benefits to the mix. Other means will be sought to incorporate other useful or inert waste materials into these building blocks.

Building Product Emissions

This system discourages the use of paint, and the pollution created by paint fumes and cleanup, by providing durable, interchangeable surfaces that may include integral color. The building system also reduces the need for other building products such as sheetrock, acoustical tile ceilings, and ductwork. By reducing the need for less permanent manufactured products that often end up in a landfill, pollution from the manufacture, use, and disposal of these products is also reduced. By reducing the need for building products that have been shown to introduce pollutants, indoor air quality can be improved.

Recycling

It seems an irresponsible use of resources to demolish a building, especially one that is a decent structure but simply no longer meets the needs of the property owner, or one that is on land that has become too valuable for the building that sits on it. When a structure is to be enlarged or modified, some portion of the original work is in the way and must be removed. Conventional construction is usually demolished under these circumstances. Recent efforts have succeeded in recycling much of the demolition material, but much still goes to the landfill, along with all of the work that went into the original construction. By contrast, this building system allows entire buildings to be picked up, block by block, transported to another site, and reassembled or incorporated into a new structure. If an owner simply wants to change the style or size of his building, exterior wall and structural building blocks can be removed and reused elsewhere, traded in, or donated for humanitarian use. This system makes it possible to renovate, add to, or remove a structural shell without any trips to the landfill. This is recycling at large scale.

Rain Water Harvesting

Because this building system is designed to offer a collection surface and structure for rainwater harvesting and storage, a building constructed of this system need not increase the effective impervious cover, and unnatural runoff, on a site. If this potential were combined with placing vehicle traffic and parking below or on the structure, the impervious cover of an entire project, and the eroding and polluting runoff that accompany it, can be reduced to become negligible. This may be combined with the potential, by building a collection terrace that is large enough, of harvesting and purifying enough rainwater to reduce or eliminate the occupant's need for a public water supply, and the infrastructure required to deliver it.

Building Performance Advantages

Many of the potential advantages of the building system and production methodologies described above have already been noted. It is expected that the list of advantages described herein will continue to grow as production methodologies and prototype structures are put into service and evolve.

Durability

The structure doesn't just give the impression of durability and stability; it can in fact be more durable and structurally sound than most conventional construction. The completed structural shell is more resistant to damage from structural overload, wind, fire, hail, flood, insects, and decay than are most standard construction types.

Flexibility

The creation of an access floor can allow extraordinary ease of MEP system integration and enormous flexibility in the subsequent reconfiguration of space. The provision of an access floor can position this system as a candidate for use in computer lab and cleanroom applications. The benefits of these features will continue to become more apparent amid the rapid evolution and continuous redefinition of information system technologies.

Continuity

Of certain interest to the owner of a planned building is the fact that this system offers the ability to construct finished architectural and structural shell at unprecedented pace, and concurrently provides extraordinary flexibility in the future reconfiguration and use of the space. Utilizing the benefits of this system, a building owner could offer a building for lease, and erect it on the tenant's property; the structure could be reclaimed and re-erected elsewhere at the end of the lease. Reduced construction time yields direct benefit in reduced construction financing costs and earlier utilization benefits. The ability to rapidly and economically reconfigure the space helps to ensure that a structure of this system provides the needed shelter and produces the desired income in a more continuous fashion than can be delivered by conventional construction.

Roof Terrace

The occupants of a building of this system will find great value in having built a usable roof terrace that can collect water instead of an expensive roof that sheds it. As urban space becomes more constrained and personal security concerns grow, these private spaces will find the use that they have enjoyed throughout history in many parts of the world.

Investment Potential

The long-term performance of this building system will provide direct and unique benefits to building owners and occupants. A structure built of these blocks is demountable; it can be easily modified, relocated, or traded in. The hardiness of the structure will qualify it for discounted insurance rates, and classification as a temporary structure may offer the owner some benefits relative to conventional construction in terms of reduced regulatory control and taxation of the construction. This system introduces building blocks as a commodity. As such, the purchase of a set of these building blocks represents a concrete investment option that also provides the owner with usable shelter or an income stream. These blocks cannot vanish overnight in the way many other investments can.

BRIEF DESCRIPTION OF DRAWINGS

These and other objects and advantages of the present invention are set forth below and further made clear by reference to the drawings, wherein:

FIG. 12A is a plan view of a wedge cap block.

FIG. 12B is a side elevation view of a wedge cap block.

FIG. 12C is a perspective view of curbed perimeter cap blocks.

FIG. 12D is a perspective view of uncurbed perimeter cap blocks.

FIG. 12E is a plan view of a cruciform cap block.

FIG. 12F is a side elevation view of a cruciform cap block.

FIG. 12G is a bottom perspective view of a cruciform cap block.

FIG. 12H is a bottom perspective view of a column cap block.

FIG. 12I is a top perspective view of a wedge cap block.

FIG. 12J is a top perspective view of a cruciform cap block.

FIG. 32B is a side perspective view of a sample elevated roadway assembly.

FIG. 33A is a schematic view of a span block model with profile lines.

FIG. 33B is a schematic view of a short direction ceiling profile.

FIG. 33C is a schematic view of a long direction ceiling profile.

FIG. 33D is a schematic view of a groin vault ceiling profile.

FIG. 33E is a schematic view of a structural module block schematic.

FIG. 33F is a schematic view of a structural module block schematic with floor block schematic FIG. 33G is a schematic view of a first option for segmenting the structural module of FIG. 33F.

FIG. 33H is a schematic view of a second option for segmenting the structural module of FIG. 33F.

FIG. 33I is a schematic view of a third option for segmenting the structural module of FIG. 33F.

FIG. 33J is an exploded schematic view of the segmenting option of FIG. 33G.

FIG. 33K is an exploded schematic view of the segmenting option of FIG. 33H.

FIG. 33L is an exploded schematic view of the segmenting option of FIG. 33I.

Figure 34A:
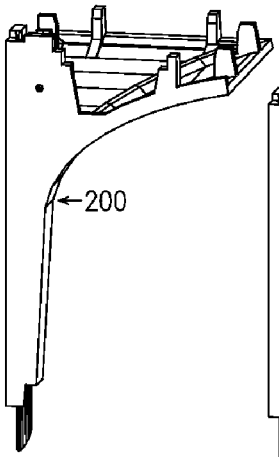

FIG. 34A is a perspective view of a corner block.

Figure 34B:
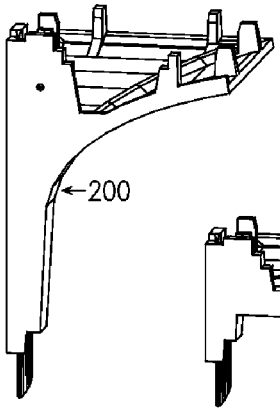

FIG. 34B is a perspective view of a shortened corner block.

Figure 34C:
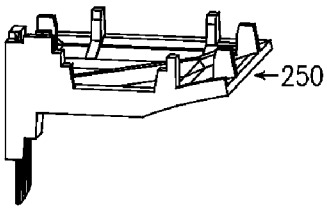

FIG. 34C is a perspective view of a base block.

Figure 34L:
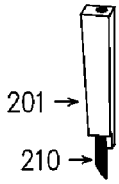
Figure 34M:
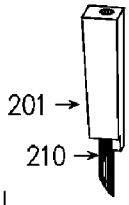
Figure 34N:
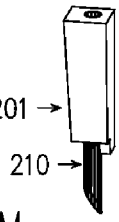
Figure 34E:
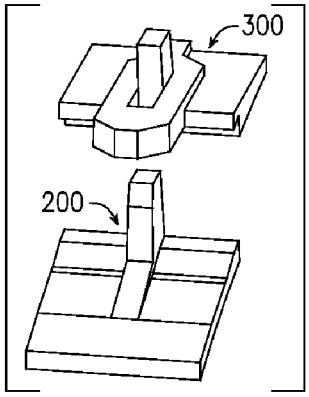

FIG. 34E is a perspective view of a key block eye suspended above a corner block plinth.

Figure 34F:
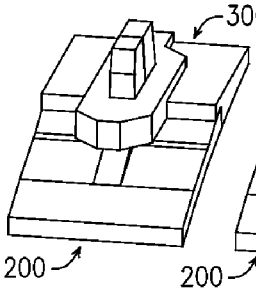

FIG. 34F is a perspective view of a key block eye engaged with a corner block plinth.

Figure 34G:
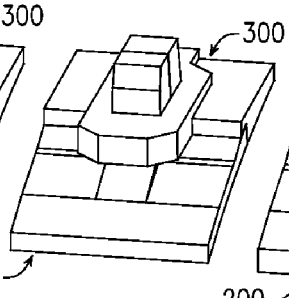

FIG. 34G is a perspective view of an enlarged key block eye engaged with an enlarged corner block plinth.

Figure 34H:
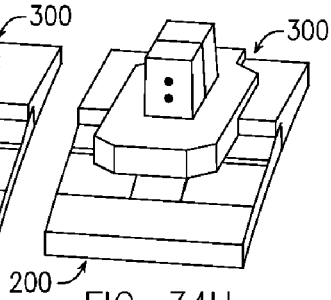

FIG. 34H is a perspective view of an enlarged key block eye engaged with an enlarged corner block plinth with aligned sleeves for bolting.

Figure 34I:
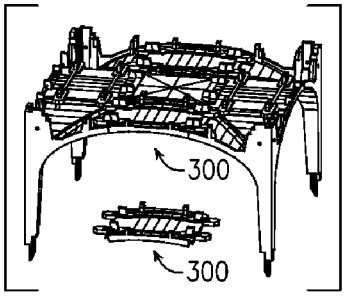

FIG. 34I shows a structural module a standard key block.

Figure 34J:
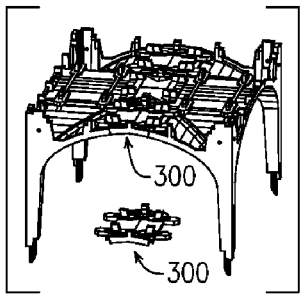

FIG. 34J shows a structural module with shortened key blocks and center blocks.

Figure 34K:
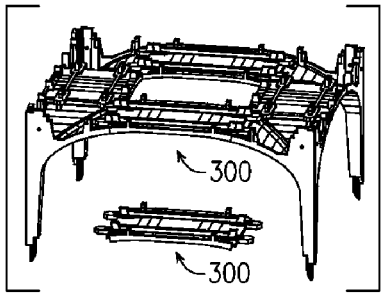

FIG. 34K shows a structural module with extended key blocks and omitted center block.

FIG. 34L is a perspective view of a reduced scale column and pipe spine of a corner block.

FIG. 34M is a perspective view of a column and pipe spine of a corner block.

FIG. 34N is a perspective view of a enlarged column and pipe spine of a corner block.

Figure 35A:
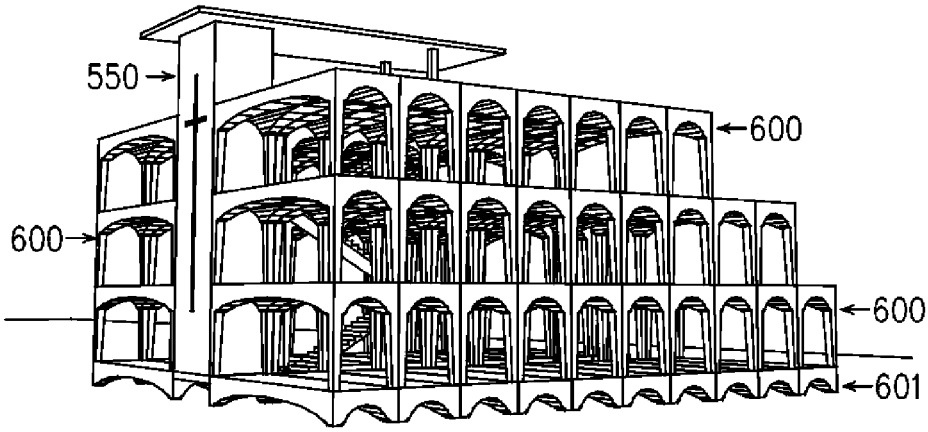

FIG. 35A is a perspective view of an example assembly.

Figure 35B:
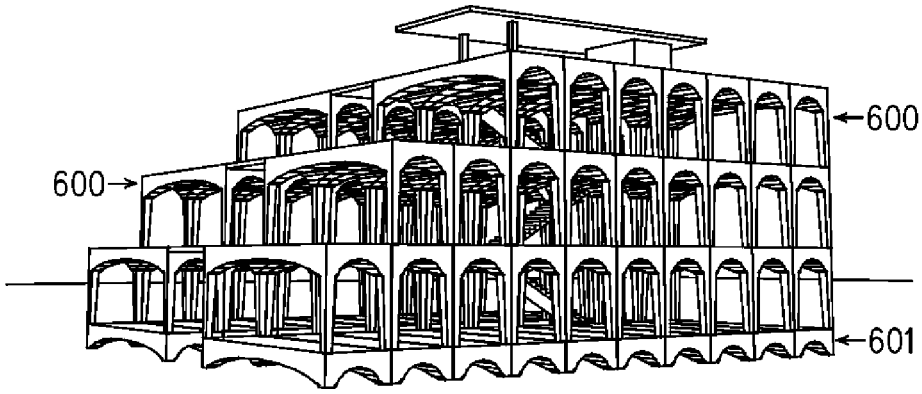

FIG. 35B is a second perspective view of the example assembly of FIG. 35A.

Figure 35C:
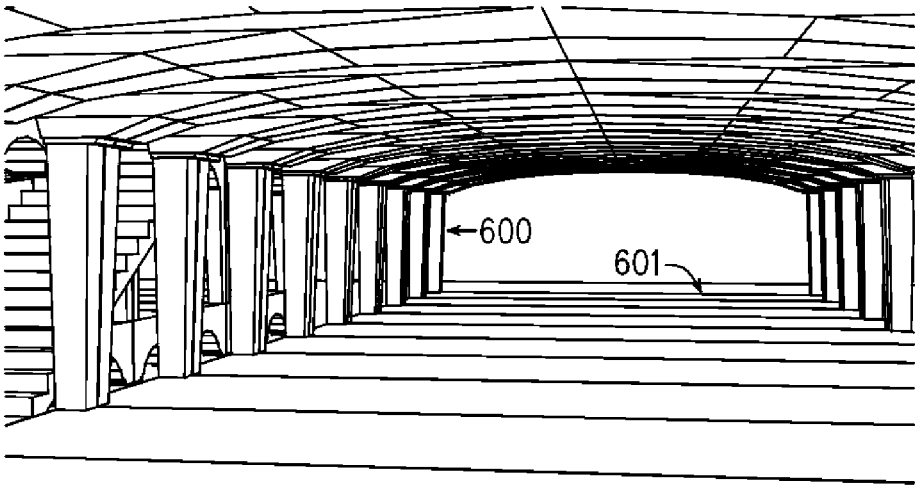

FIG. 35C is a view into the embodiment of FIG. 35A.

Figure 36A:
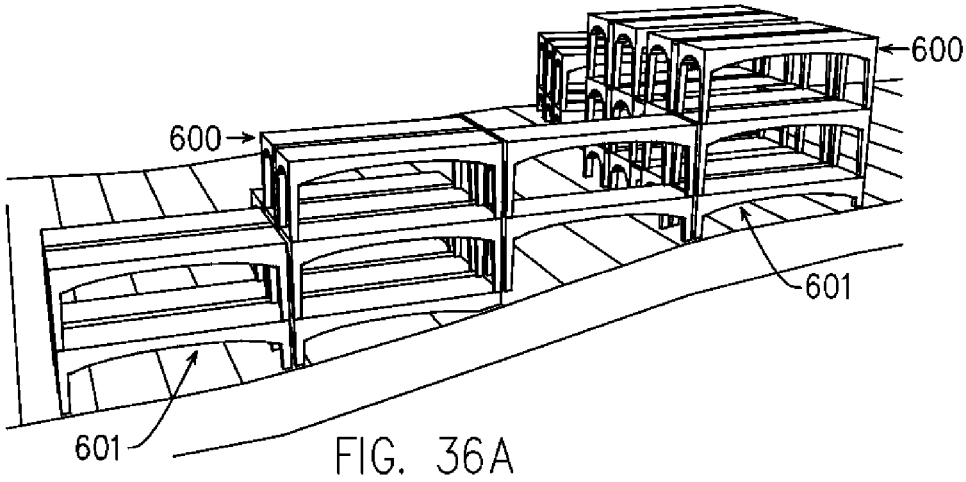

FIG. 36A is a perspective view of a sample embodiment built on a slope.

Figure 36B:
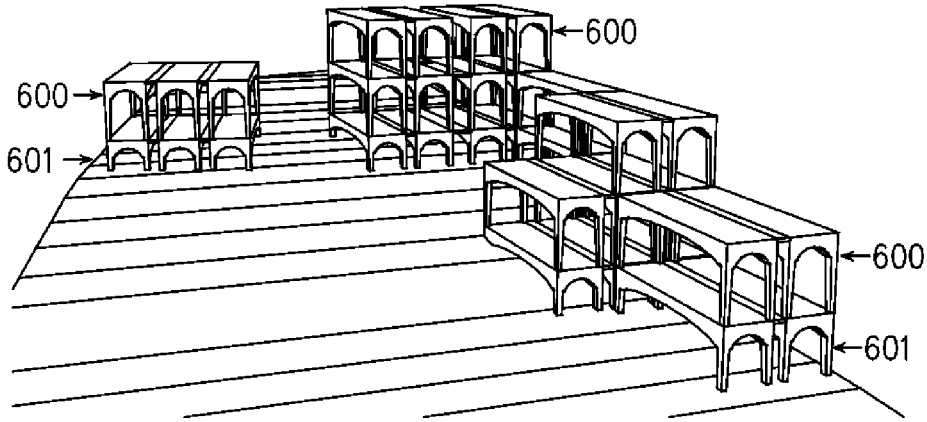

FIG. 36B is a second perspective view of the embodiment of FIG. 36A built on a slope.

Figure 36C:
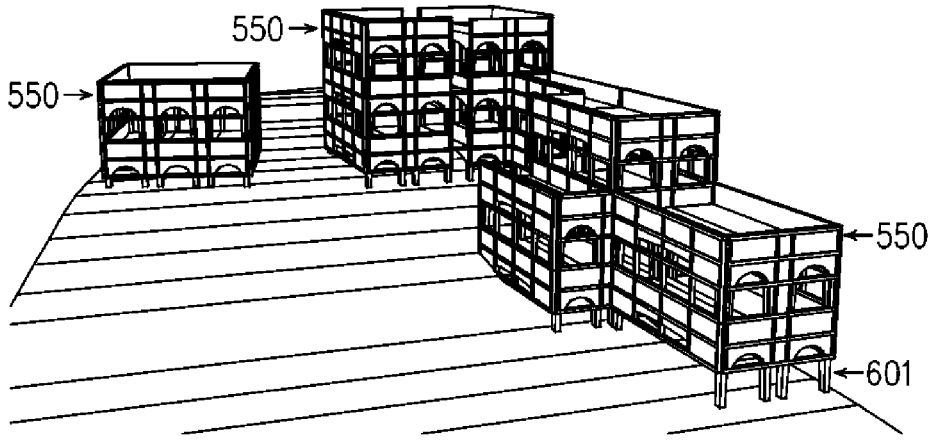

FIG. 36C is a perspective view of the embodiment of FIG. 36A with exterior wall blocks.

Figure 37A:
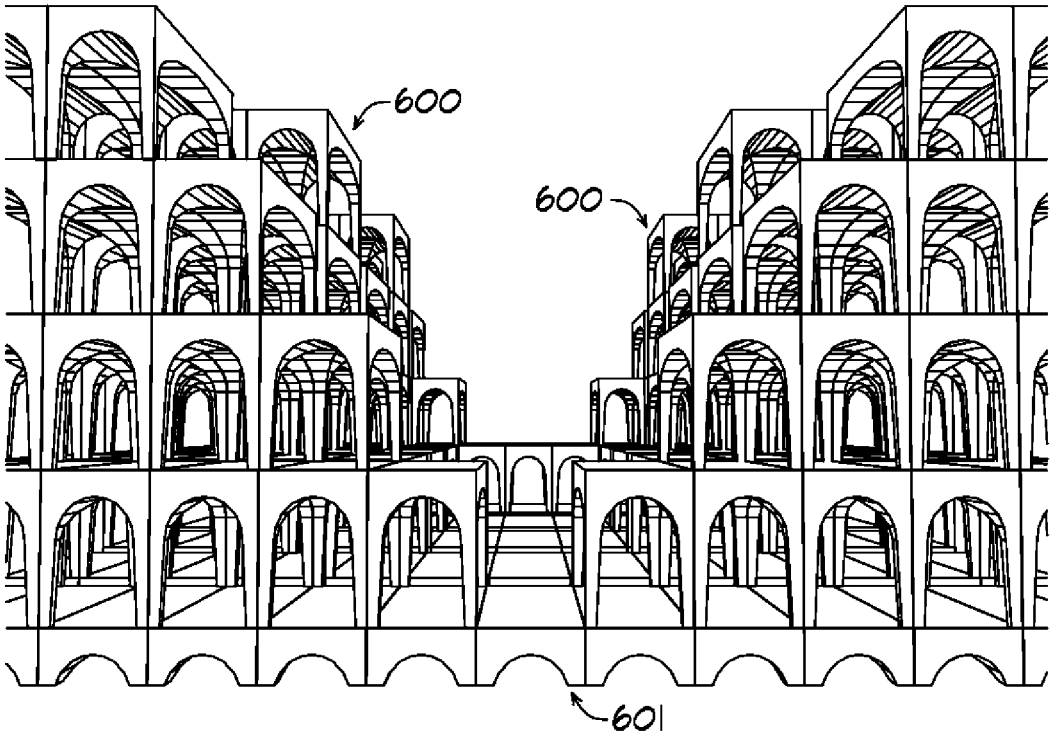

FIG. 37A is a perspective view of an example embodiment that is terraced around a central courtyard.

Figure 37B:
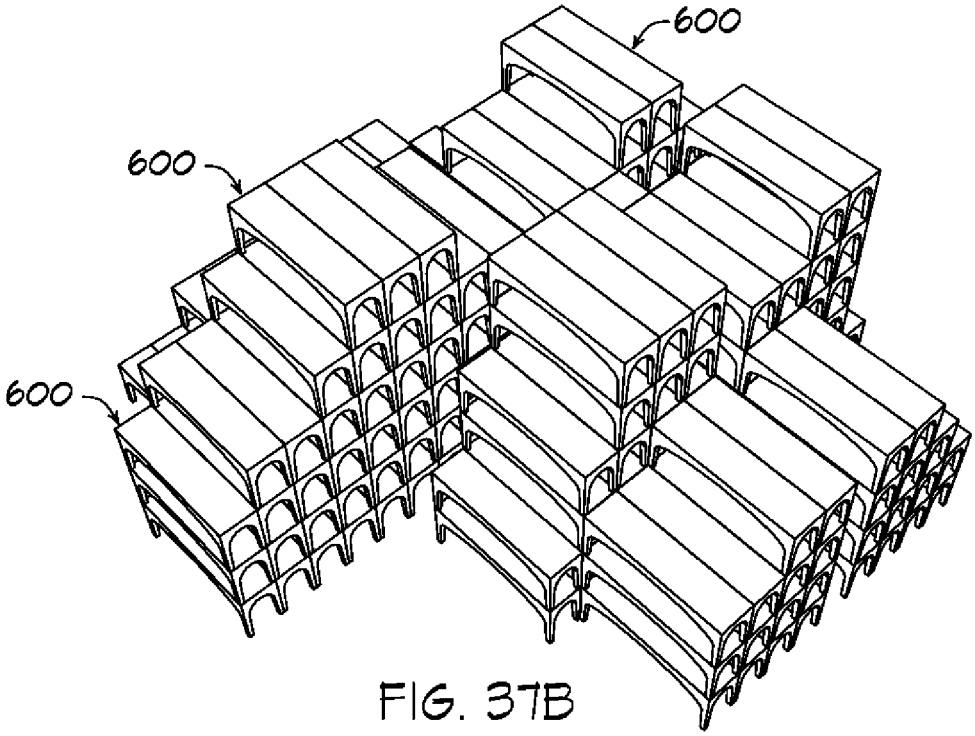

FIG. 37B is a perspective view of an example embodiment that demonstrates the nesting, stacking, and gapping of structural modules.

Figure 38A:
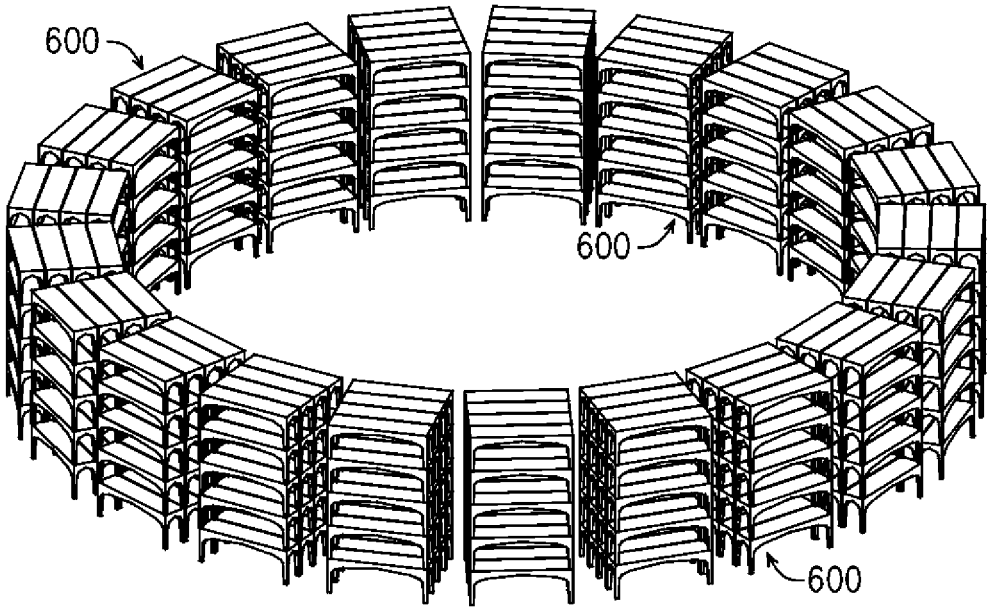

FIG. 38A is a schematic view of an example embodiment with stacked structural modules placed in a radial pattern.

Figure 38B:
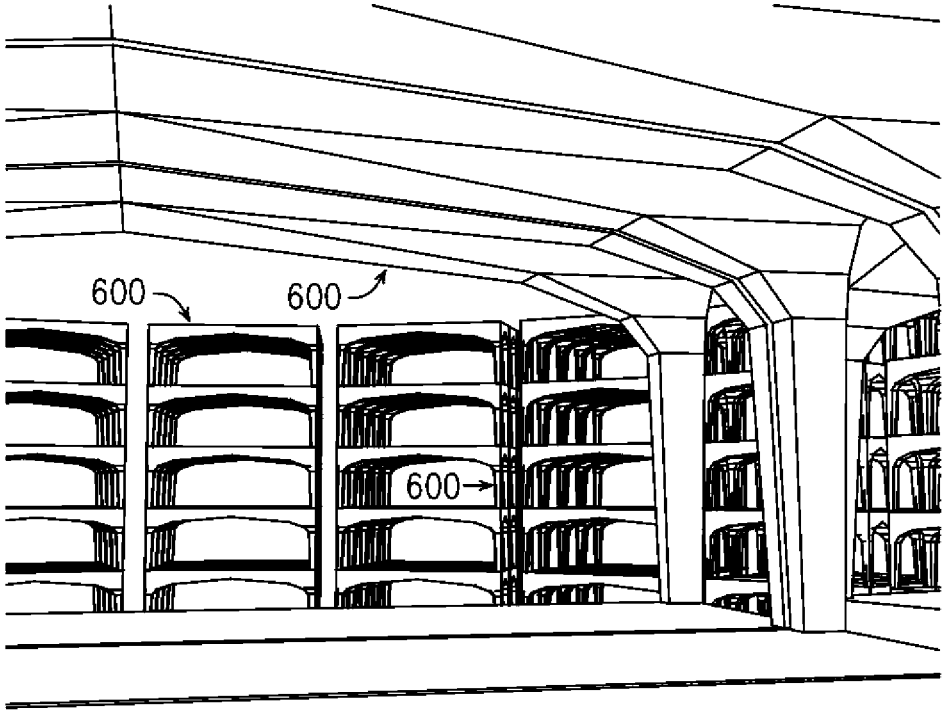

FIG. 38B is a view into the embodiment in FIG. 38A.

Figure 39A:
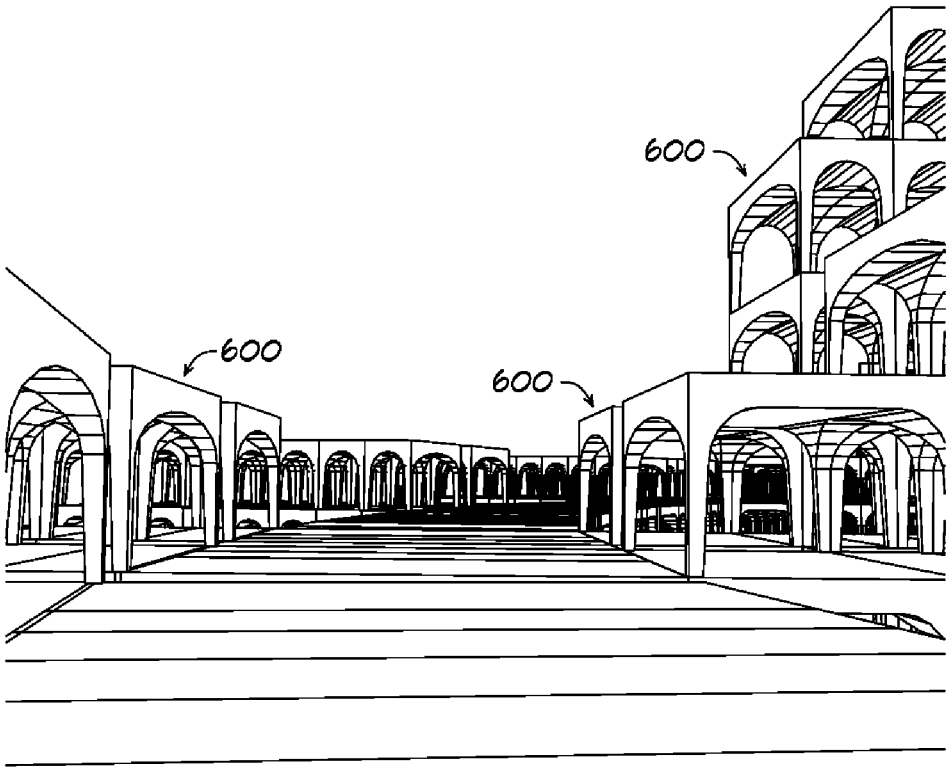
Figure 39B:
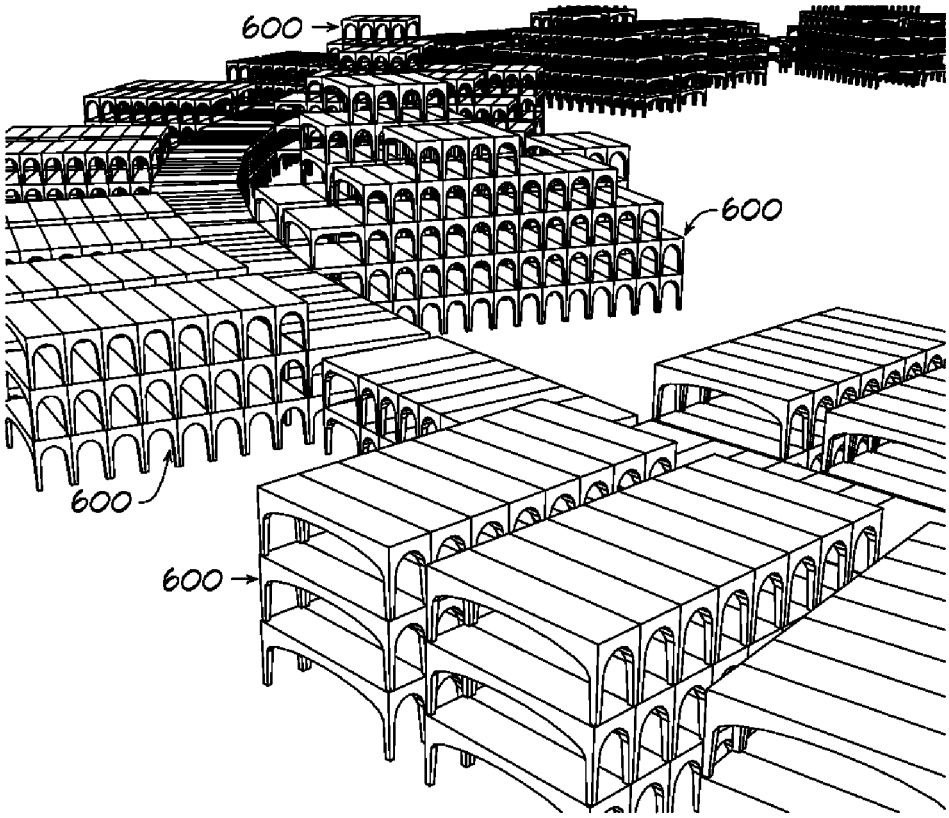

FIG. 39A is a perspective view from the elevated roadway of the embodiment of FIG. 39B.

FIG. 39B is an aerial view of an example embodiment of stacked and nested structural modules forming an elevated roadway connecting parking and occupied structure.

DETAILED DESCRIPTION OF EMBODIMENT

General System Description

Figure 1A:
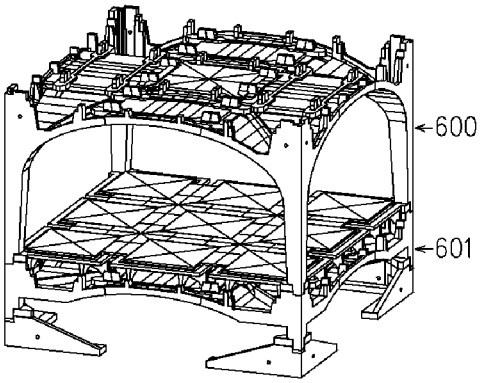
FIG. 1A is a perspective view illustrating a completed structural module.
Figure 1B:
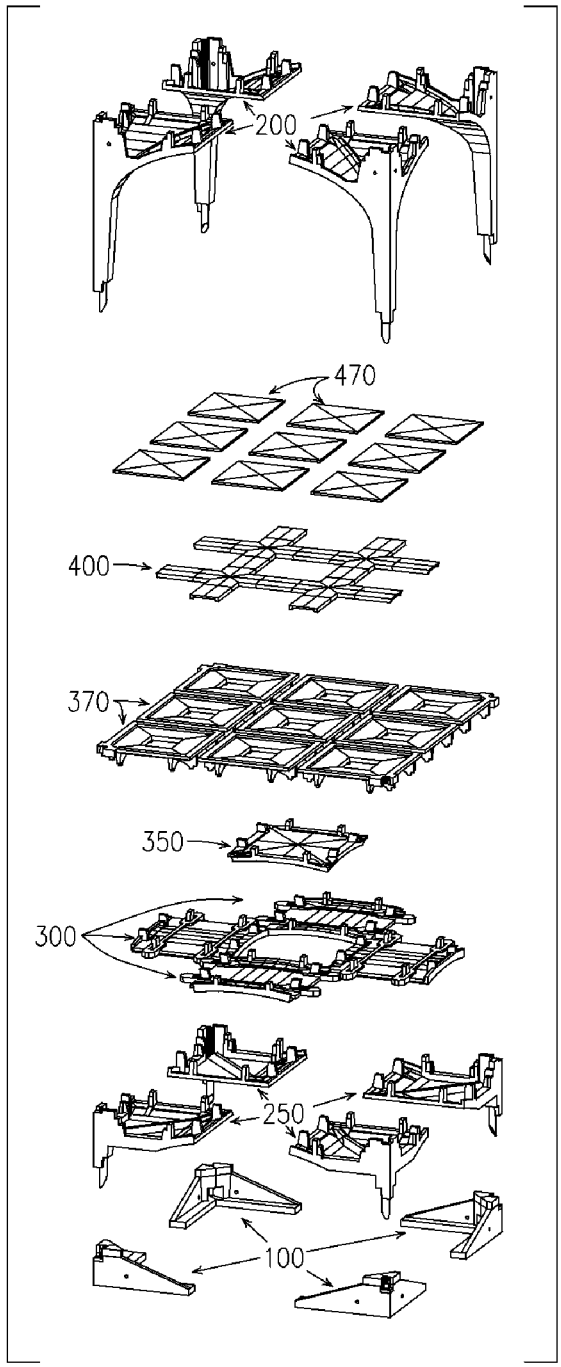
FIG. 1B is an exploded perspective view illustrating the block components of a representative structural module.

FIG. 1*a* shows an assembled structural module 600 that is composed of interlocking precast thin-shell blocks that are thickened and reinforced at selected locations in response to structural and detailing demands. FIG. 1B is an exploded view of the different elements which may include footing blocks 100, base blocks 250, corner blocks 200, key blocks 300, center blocks 350, pan blocks 370, cap blocks 400, and floor infill blocks 470. The assembled structural module 600 in FIG. 1A is shown supported on a base structural shell 601, in which corner blocks 200 are replaced by base blocks 250, which in turn are supported by footing blocks 100.

The building system and its variations are generally designed to carry forces in compression, where feasible to do so, because of the efficiency with which a compression structure utilizes building material.

Reinforced thin-shell concrete is typically used to make the blocks, however, the interlocking building blocks may be engineered and constructed using any castable, structural grade material in conjunction with the necessary reinforcement. The castable material may include but is not limited to Portland cement concrete, flyash concrete, structural plastics, composite materials, and soil-cement mixes. Internal reinforcement may include standard reinforcing steel bars or their alternatives, fiber reinforcement that is integral to the castable material, or any other structurally reliable method of reinforcement that can be proven by load test. Secondary components such as perimeter walls, floor infill panels, and segmented roof systems may be constructed of or incorporate other materials, including but not limited to concrete, plastic, sheet metal, plate steel, and wood.

While the embodiment detailed herein depicts a groin vault that is formed by the intersection of two parabolic barrel vaults, the invention derives from the basic concept of modeling a three dimensional structural span based on desired architectural and structural geometries and then subdividing that span in response to structural, geometric, and handling considerations. The resulting block joints are then structurally sculpted to reassemble the span with the necessary interlock to form a competent structure. Blocks are further sculpted to enable nesting and stacking of spans such that a structure of any size or use may be built by the repetitive use of common building blocks; interconnectivity is also generally designed to eliminate the need for temporary shoring or bracing during construction.

Figure 2A:
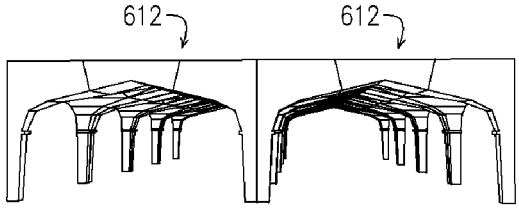
FIG. 2A is a perspective view illustrating a folded plate structure.
Figure 2B:
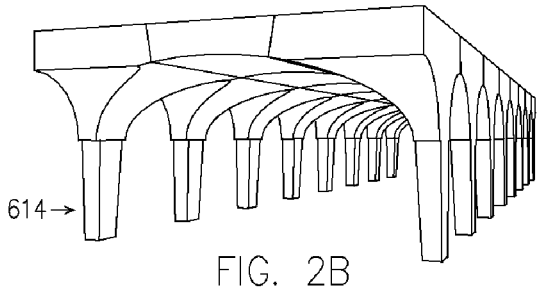
FIG. 2B is a perspective view illustrating a barrel vault structure.
Figure 2C:
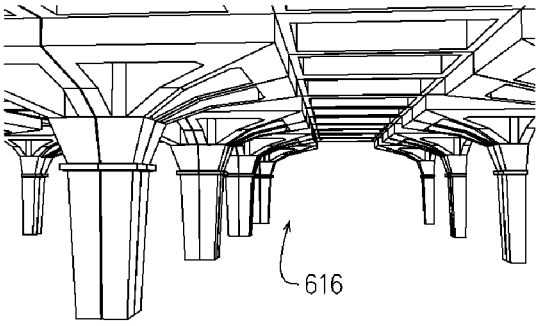
FIG. 2C is a perspective view illustrating a 3D frame.
Figure 2D:
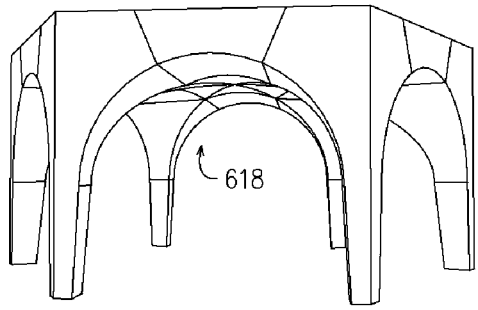
FIG. 2D is a perspective view illustrating a hexagonal module structure.
Figure 2E:
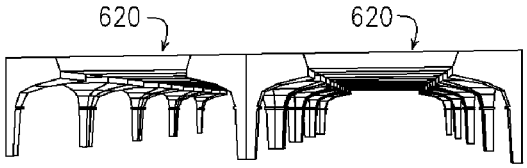
FIG. 2E is a perspective view illustrating a compression/bending hybrid structure.
Figure 2F:
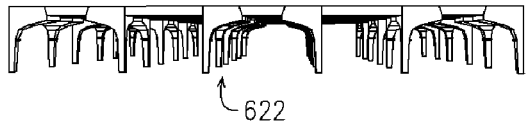
FIG. 2F is a perspective view illustrating a gapped modules structure.
Figure 2G:
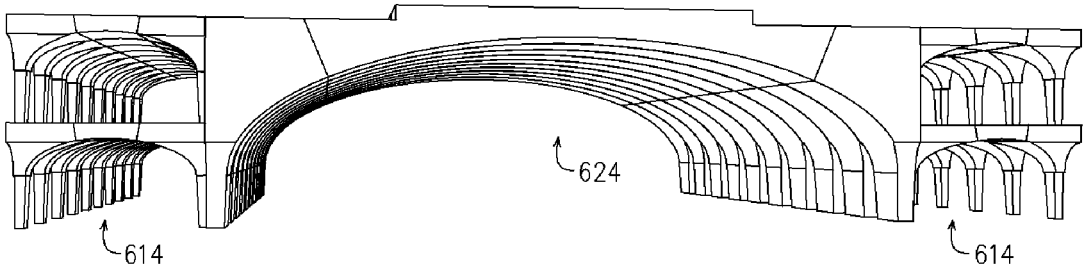
FIG. 2G is a perspective view illustrating a long span module with barrel vault outer modules.

A schematic sampling of the structural geometries that are possible using these methods includes, but is not limited to, the configurations presented in FIGS. 2A-2G. The building system may be modified by utilizing non-rectangular nestable plan modules and by offsetting modules from one another; then spanning the resulting gaps with secondary blocks between modules. Variations may include, but are not limited to, folded plate structures 612 (FIG. 2A), barrel vault structures 614 (FIG. 2B), 3D frames 616 (FIG. 2C), hexagonal shell structures 618 (FIG. 2D), compression/bending hybrid structures 620 (FIG. 2E), gapped modules 622 (FIG. 2F), and long span modules 624 (FIG. 2G).

Block sets are generally configured to limit bending stresses by transferring forces in compression where it is practical to do so; this allows internal stresses and the building material required to resist those stresses to both be minimized. Thickness of shell faces and stiffening ribs are determined on the basis of structural action, constructability, and serviceability considerations. By taking advantage of arching action where practical, a shell or rib of a given span can be much thinner and more lightly reinforced than would otherwise be possible. Where constructability considerations force a compression shell to be thicker than required structurally, the thicker section may offer reserve structural capacity to carry larger service loads and unintended overloads.

The building system is scalable, and embodiments range in size from large scale building and bridge structures to architectural scale model or toy building blocks. Block material thickness and reinforcement can be adjusted in response to structural actions at each scale. Large-scale blocks are generally designed such that they can be manufactured under controlled conditions and transported to the construction site by rail or on a flatbed trailer without special permit. The building system also features larger transportable blocks that require permit, and still larger blocks that are intended to be site-cast using segmental molds that are shipped to the site.

The building system provides rapidly erectable, interlocking sets of building blocks that are designed to satisfy the needs of architects, engineers, builders and owners. By expanding the available kit of parts over time, this building system will provide increasing variety in overall geometry and architectural expression.

The design of these blocks allows the incorporation of variety in surface texture and color. Color may be integral to the mix, or blocks may be tinted using surface-applied permanent stains. As-cast surfaces avoid the need for painting and the maintenance cost of repainting, although they may be painted if the owner so desires.

Subject to satisfying structural requirements, the surfaces that are exposed to view may be customized by casting against sculpted form sets. Texture may be molded into the exposed concrete face with built patterns of reveals, or with a wide variety of readily available or custom-made form liners. Texture may also be hand-sculpted into a master, and that master used to make mold sets for the production of sculpted blocks. Molds are also configurable to accommodate veneers of acoustical tiles, ceramic tiles, stone, brick masonry, or any other surface material that will form adequate bond with the cast surface of the block. Although these veneers could be field-applied, one embodiment incorporates veneers of common finish materials that are laid into molds prior to casting, such that they are integral to the factory-produced building block. Shell faces that form ceilings may also incorporate cast-in modular or designer-specified knock-outs, pipe sleeves, junction boxes, and penetrations. These features accommodate ceiling-mounted electrical equipment, lighting, sprinkler heads, and structural penetrations that may be required for HVAC systems.

By interchanging mold sets, blocks may be thickened and reinforced to resist any structural demand, as required to resist local code-specified loads for a given use. Section reinforcement may be selected from pre-engineered and pre-tied cages of reinforcing steel, or may be custom-specified by the design engineer.

Because this system is designed to resist code-specified forces by interlocking pre-engineered blocks, the erection of a module of this structure can be completed without the field welds, bolts, or temporary bracing that are normally required for stability. The installation of connectors in conventional construction uses manpower and crane time that can both be minimized through the connectorless erection enabled by this system; a structure of this system can be erected at a pace that cannot be approached by any conventional construction system. Where connectors are required for service load conditions or to establish structural continuity between modules, block sets are generally designed such that the installation of connectors can be accomplished independent of and after the erection of a given module.

DETAILED DESCRIPTION OF EMBODIMENT

Block Descriptions

The functional characteristics and configuration of each of the blocks used to build a representative structure of an embodiment, which features stackable four-column modules of segmental parabolic groin vault with square or rectangular plan geometry. A groin vault is the structural form that results from the intersection of two perpendicular barrel vaults. The block sets required to construct previously described variations of this system are similar to those that are described below for the construction of an embodiment.

Foundation Blocks

The supporting foundation of the example embodiment may consist of either footing blocks 100 or pier and pier cap blocks 94. Foundations can alternatively be another system common to a given locale; foundation of any construction must be capable of resisting all design vertical forces, overturning moments, and horizontal thrusts without significant foundation movement, and must provide the required column seat and bearing surfaces.

Footing

Figure 3A:
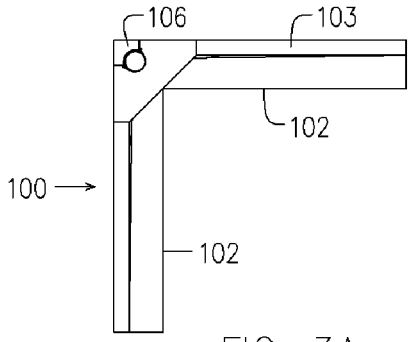
FIG. 3A is a plan view of a footing block.
Figure 3B:
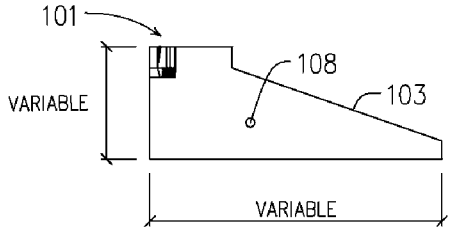
FIG. 3B is a side view of a footing block.
Figure 3D:
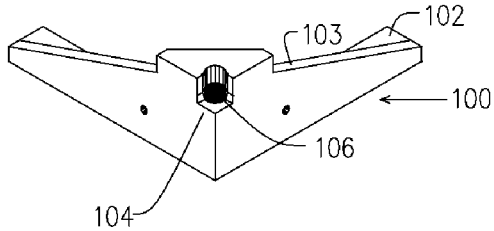
FIG. 3D is a perspective view of a footing block showing a tapered key and vertical sleeve.
Figure 3E:
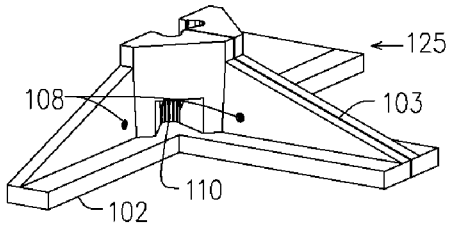
FIG. 3E is a perspective view of two back to back footing blocks forming a "T" shaped footing and showing an access port and shear pin sleeve.
Figure 3F:
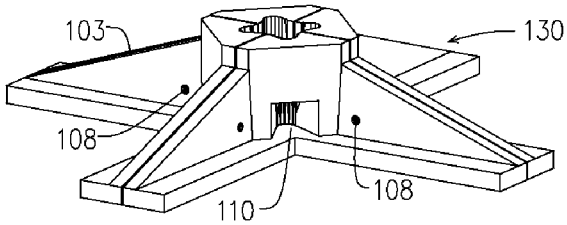
FIG. 3F is a perspective view of 4 footing blocks forming an "X" shaped footing.

Referring now to FIGS. 3A-3F, footing blocks are designed for use in stable shallow soils. These blocks serve as "L" shaped (FIG. 3A) spread footings blocks 100 that nest together to form footing groups at interior and perimeter column groups. While the "L" shaped spread footing works independently at building corners, it also nests with identical elements to form "X" shaped interior footing groups 130 (FIG. 3F) or "T" shaped edge footing groups 125 (FIG. 3E).

Where the potential exists for differential settlement of nested footings, shear pins 109 (not shown) may be installed through shear pin sleeves 108 across back-to-back footing walls 103 (FIGS. 3E-3F) to force the nested shapes to work in unison. In the case of significant settlement or heave of supporting soils below an existing building of this construction, footing block geometry and base block interlock will accommodate limited jacking of the base block 250 and shimming for realignment of the supported structure. Where soil movements are excessive, the entire structure can be relocated to more stable ground; this is not an option with conventional construction.

Figure 3I:
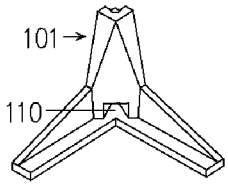
FIG. 3I is a perspective view of a taller footing block.
Figure 3G:
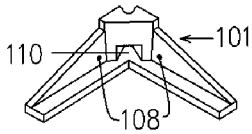
FIG. 3G is a perspective view of a footing block.
Figure 3H:
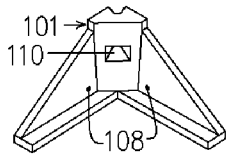
FIG. 3H is a perspective view of a vertically extended footing block.

The width and length of the spread footing base 102 (FIG. 3A) can be modified (FIG. 3B) in response to design loads and site-specific geotechnical analysis. The height of the footing block 101 is adjustable (FIG. 3G-3I) as needed to reach a deeper bearing stratum or to traverse a change in ground elevation below a flat or stepped floor. This feature helps to minimize foundation excavation costs and the environmental impact of extensive excavation work that is typically required for building construction. Modular steps in available footing segment height enable a set of footings to traverse a change in ground elevation while maintaining a constant top of footing elevation; this feature can obviate the need for tall, expensive foundation walls common to some locales with steep grades.

As described below, vertical adjustability in base blocks and corner blocks combines with that of footing blocks 100 to further expand the potential of this system to accommodate changes in ground level and floor level.

Figure 6A:
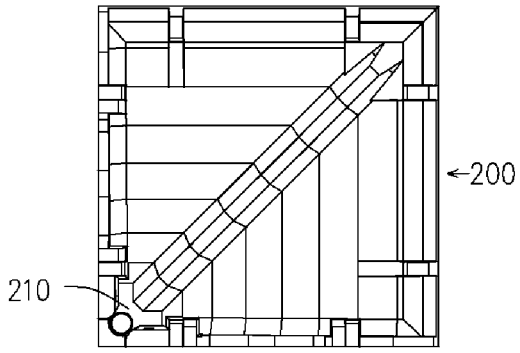
FIG. 6A is a plan view of a corner block.
Figure 6B:
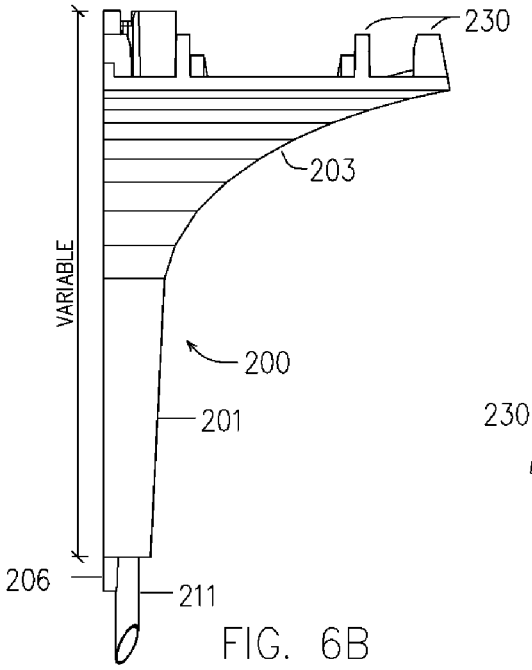
FIG. 6B is a side elevation view of a corner block.
Figure 6C:
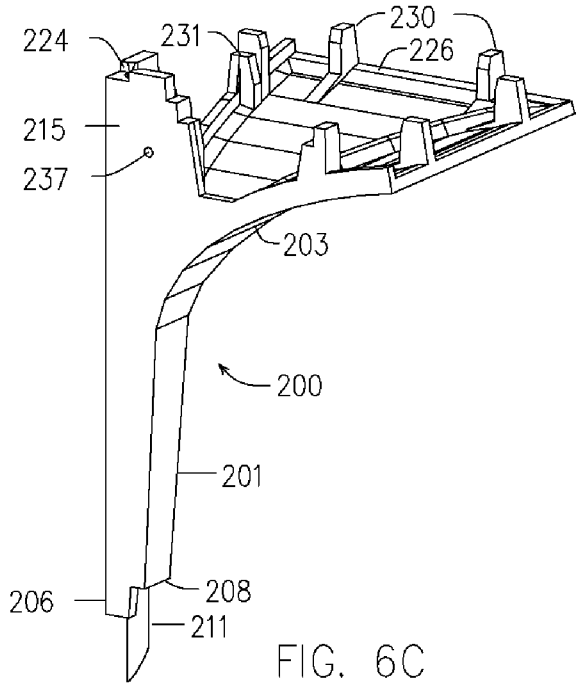
FIG. 6C is a side perspective view of a corner block.

Footing blocks 100 may incorporate a tapered key 104 (FIG. 3D) to mate with a standard column base key 206 (FIG. 6C), and may incorporate a vertical receiving sleeve 106 (FIG. 3D) to accommodate a base pipe extension 211 from the base block 250 or corner block 200 above. The footing is cast with an access port 110 (FIG. 3E) to allow utilities to be connected from within the crawl space after the structure has been erected and dried-in. Ports that are not used may be plugged, and ports that house electrical, data, plumbing, or other utility lines can be sealed with grout, expanding foam sealant or by another appropriate method.

Pier & Pier Cap

Figure 4A:
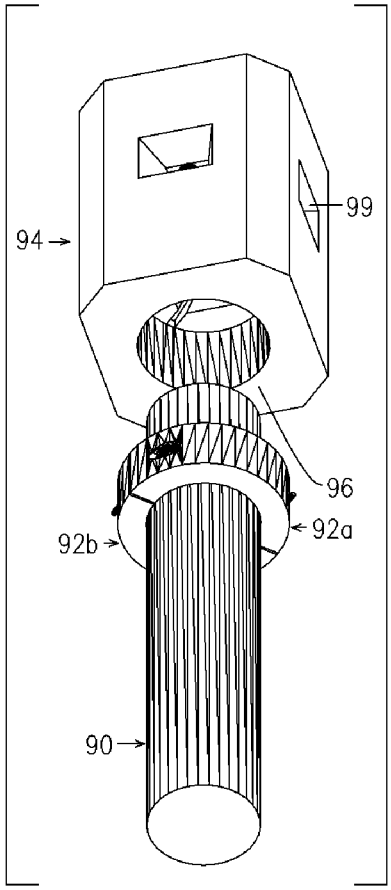
FIG. 4A is a view of a cast in place concrete pier, a two part temporary collar form, and pier cap prior to pier cap installation.
Figure 4B:
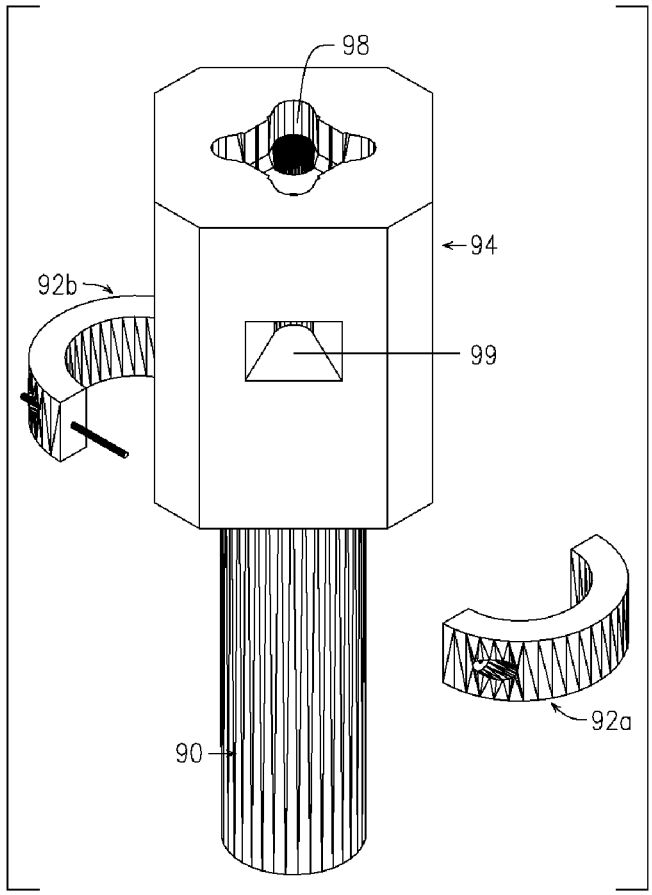
FIG. 4B is a perspective view of a pier and an installed pier cap assembly with the two part temporary collar form removed.

Drilled pier foundations are designed for use where high loads or unstable surface soils require that base forces be transferred to strata deep below the ground surface. Referring now to FIGS. 4A-4B, this foundation type consists of a concrete pier 90 of conventional construction, temporary two-part collar form 92*a* and 92*b*, and pier cap block 94. The cast-in-place concrete pier may be constructed in the usual manner. A truck mounted auger drills a pier of specified diameter, such as 24", to a depth determined by an engineering analysis of soil conditions and design loads. Reinforcing steel cage is lowered into the excavation, and concrete is cast to the specified elevation. Smooth transition is provided from earth-formed pier below grade to formed (cardboard tube or separable form) pier between grade level and pier cap bearing elevation. Piers may be cast to standard tolerances, which are relatively generous because drilling into the earth with a truck-mounted auger with great precision would be very costly, if not impossible. The pier cap block assembly process is designed to allow precise vertical and lateral adjustment of a pier cap block that is supported by a pier of standard placement. After pier concrete has cured, the temporary two-part collar form 92*a* and 92*b* is tightened onto the pier perimeter at the desired elevation, with easily achieved precision, to support a precast pier cap block 94. The two-part collar form 92*a* and 92*b* shown is of reinforced concrete with threaded-rod ties, but these elements could also be constructed of a variety of other structural grade materials. The pier cap block 94 incorporates an oversized base cavity 96 to receive the top of the pier 90, and to accommodate standard pier horizontal placement tolerances. The pier cap block 94 is lowered onto the pier 90 to rest on the two-part collar form 92*a* and 92*b*. The pier cap block 94 is positioned laterally within the limits provided by the oversized base cavity 96, and the annular cavity between the pier and the pier cap block may then be pumped full of non-shrink grout to set the pier cap block in its final position. Once the grout has attained the necessary strength, the two-part collar form 92*a* and 92*b* may be removed and reused, or it may be left in place. The pier cap block 94 incorporates column base keys 98 and MEP access ports 99 for an interior column group as a standard. The use of the pier cap block 94 and appropriately sized piers at the perimeter of a structure enables the addition of new structure without modifying the original foundations.

Where highly expansive soils would threaten to lift the pier cap block 94 off of the pier 90, common soil retainer panels (not shown) are used to maintain a void space below the pier cap block 94 after backfilling, and to thereby isolate the pier cap block 94 from the expansive soil.

Slab-on-Grade or Alternative System Support

Foundation and first floor construction using this system provides opportunities for the incorporation of underfloor air-conditioning, electrical, data and plumbing, but these systems can also be incorporated in a common manner to allow the use of a slab-on-grade or other floor system, subject to the requirement that the foundation provide the required column seat and bearing surfaces. Foundation construction should ideally allow the utilization of the vertical pipe chases that are provided within column sections, but this is not mandatory. Alternate vertical chases can be accomplished within gap framing between spaced structural modules, through exterior wall blocks, or through penetration of the structural shell at a low-stress location. Bearing surfaces, base keys, and connective conduit can be provided in a slab-on-grade system using standard molds to seat the column base at or near floor level. Alternatively, columns can be based on reinforced concrete plinths that are dowelled into the supporting stiffened slab and are configured to receive the column at the top of the plinth.

Structural Shell

Figure 5A:
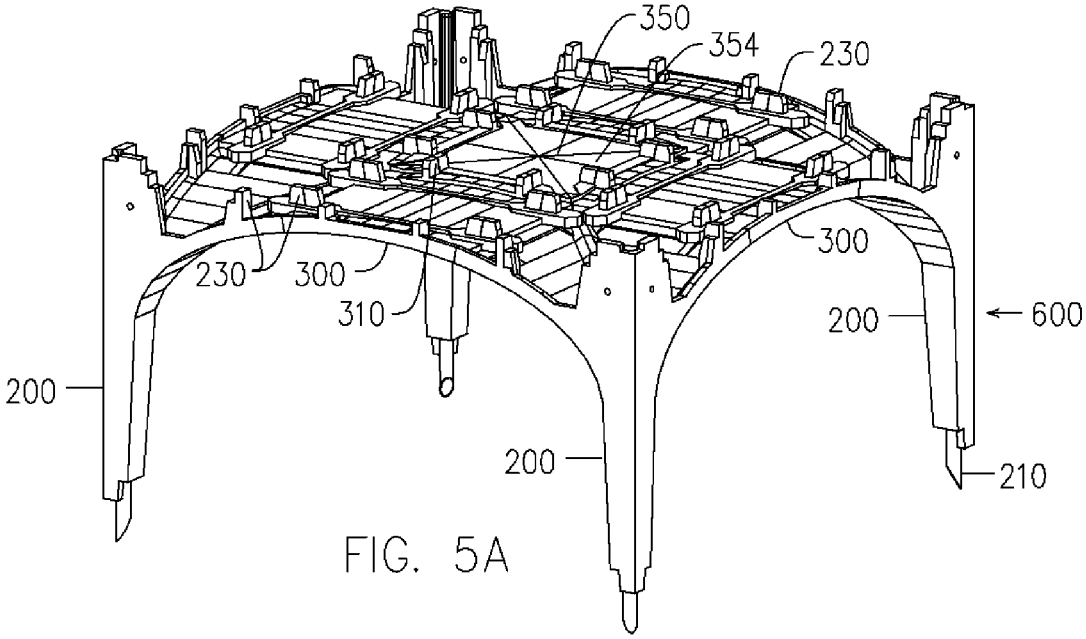
FIG. 5A is a perspective view of a structural module with corner blocks, key blocks, and a center block.

Referring now to FIG. 5A, the shown embodiment features a primary structure for each upper level of floor framing is a stiffened structural shell 600 that is constructed of just three types of blocks that are used repetitively. One module of the square or rectangular structure of this embodiment includes four corner blocks 200, four key blocks 300, and one center block 350. These blocks in the shown embodiment combine to form a groin vault that spans 25 feet in both directions and features a floor-to-floor height of 14 feet. The design of segmenting lines between corner blocks, key blocks, and center blocks for this example results in each of these blocks being transportable without the need for special roadway permits.

The structural shell presents an array of supporting corner block plinths 230, key block plinths, 310, and center block plinths 354 that share a common top elevation; these plinths may be fitted to support a floor structure or a wide variety secondary floor structures including metal of wood joists, framed panels, or flat planks. Because of the short spans between plinths, the secondary floor framing may be quite shallow where greater structural depths would otherwise be required. The support of shallow floor structure on an array of supporting plinths creates a raised floor system; this is an amenity that is generally bought at significant cost for special-use spaces such as computer rooms. Clearances within the access space below such a floor may be adjusted by casting shell block sets with taller or shorter plinths.

Figure 5B:
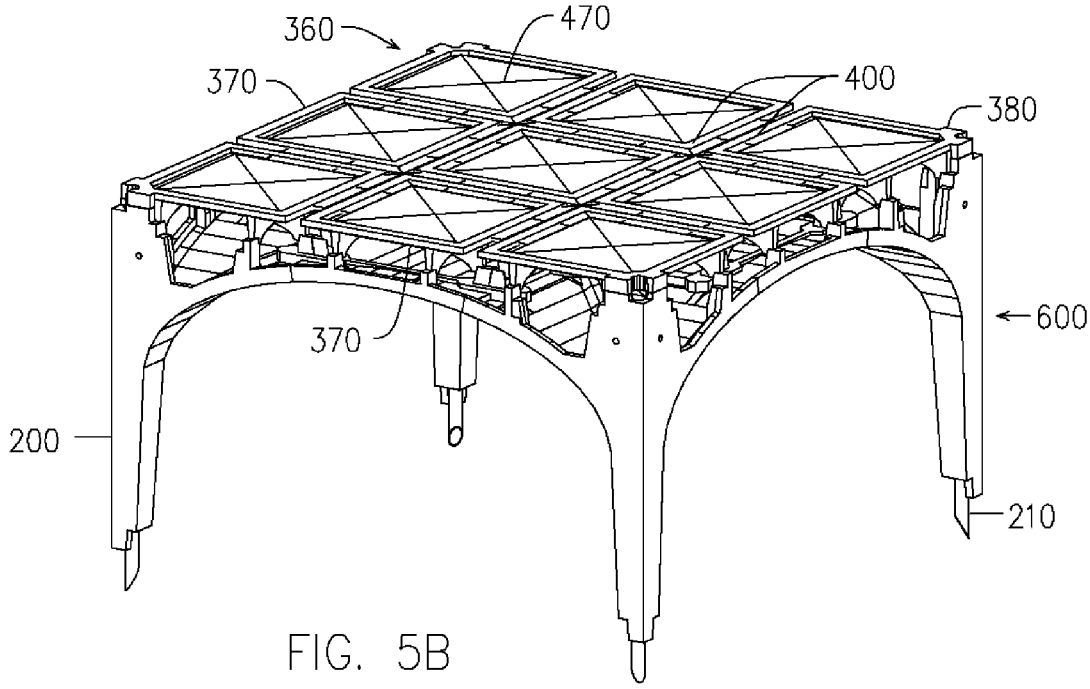
FIG. 5B is a perspective view of the embodiment of FIG. 5A with an access floor/terrace system installed.

Referring now to FIG. 5B, the shell of the preferred embodiment supports an access floor/terrace system 360 that may be designed as a part of this building system. The shell-supported floor system consists of pan blocks 370, cap blocks 400, and floor infill blocks 470, as described below. Tops of corner blocks 200 work in conjunction with corner pans 380 to provide an interlocking connection for the base of a corner block 200 above, thus allowing structural modules to be stacked (FIGS. 27A-27E). Numbers of repetitions of like blocks vary with non-rectangular plan geometries. For instance, a hexagonal module consists of 6 identical "corner" blocks, 6 identical key blocks, and one optional center block. Matched sets of corner, key, and center blocks are produced to mate with one another and to provide a variety of architectural spans and profiles. Structural demands are met by modifying the design and cast geometry of cross-sections, stiffeners, and reinforcement as required for a given profile and loading.

Referring again to FIG. 5A, top surfaces of structural shell blocks are designed to nest and lap; slope of top surfaces on each block make the completed shell largely water resistant (during construction or as an independent shell). Unless rainwater is caught or otherwise diverted it will drain through pipe spines 210 in each corner block. Although rainwater protection provided by the bare shell could be further enhanced by sealing joints between blocks, protection is better assured by the installation of a secondary roof structure above the shell; in the preferred embodiment this secondary roof is formed by access floor/terrace blocks and a rainwater collection system as described below.

Corner Block

Referring now to FIGS. 6A-6D, the corner block 200 of this embodiment shows a flared column that is 14" square at the base 208, and features base key 206 and base pipe extension 211 for interlock and connectivity to the underlying supporting structure. The lower column section 201 flares to 18" square at about 6'-8" above the floor, and transitions at that level to a stiffened thin-shell structure 203. The base pipe extension 211 is cut to a taper to facilitate the "stabbing" of the pipe into a vertical receiving sleeve 106 (FIGS. 22A-22E) in the support below. The relative flexibility of the thin leading edge of the base pipe extension also provides some ductility at the interface between blocks; if the supported block were loaded to failure, the failure would begin at the leading edge of the base pipe extension 211, and ultimately engage the whole cross section of the pipe spine 210. Common base keys 206 interlock with mating faces cast into the top of the supporting block. This interlock offers self-positioning and stability without shoring during erection. In this example, a 6" diameter standard steel pipe spine 210 works compositely in the reinforced concrete column of an embodiment to resist shears and bending moments, and it serves as a vertical systems conduit between levels of structure. Where structural steel is used, it should be provided with the necessary corrosion protection appropriate to the use and location of the structure. As depicted in FIGS. 34L-N, the size the of the structural pipe spine 210, and of the lower column 201 that it occupies, may both vary in the design and construction based on the structural requirements of a given block. Corresponding geometries of the supporting blocks must also be modified to remain compatible with an enlarged column base. The pipe spine 210 may serve not only as integral reinforcement and as MEP systems conduit, but it can also allow the vertical post-tensioning of a stack of corner blocks in a tall structure or one that is subjected to large lateral loads. Referring again to FIG. 6D, the column section above the top of the pipe conduit is a battered "L" column section 215 in plan, and features a spine lateral bearing surface 218 that receives and resists the overturning moment lateral reaction from the base pipe extension 211 of a corner block stacked above. The companion and opposite lateral force, and the vertical reaction from the upper column base, are resisted by the thickened corner 381 (FIG. 11C) of the corner pan 380 working in conjunction with the corner block 200. In the example shown in FIG. 6C, the thin-shell section of the corner block 200 above the level of the top of the pipe spine 210 forms one corner of an elliptical groin vault, and utilizes a minimum structural shell thickness of approximately 3 inches.

Figure 6D:
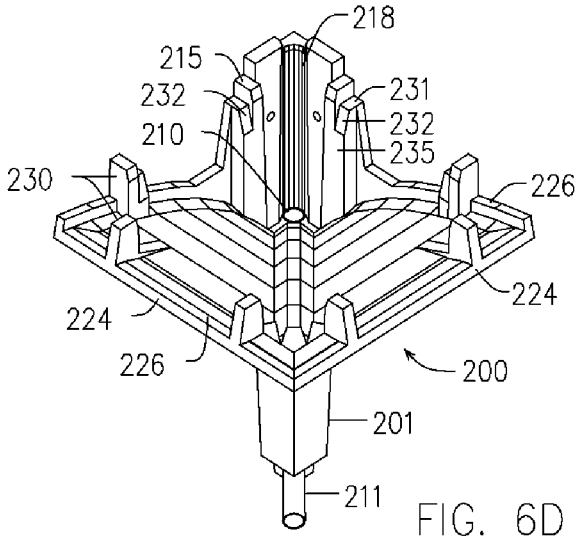
FIG. 6D is a top perspective view of a corner block.
Figure 7A:
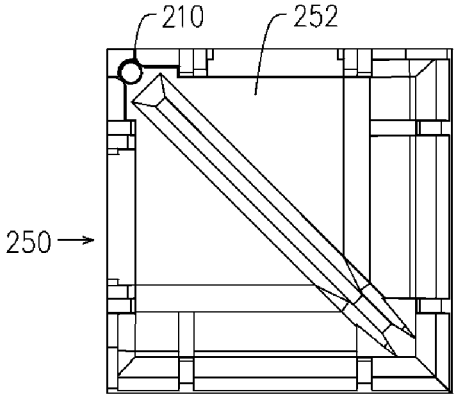
FIG. 7A is a plan view of a base block.
Figure 7C:
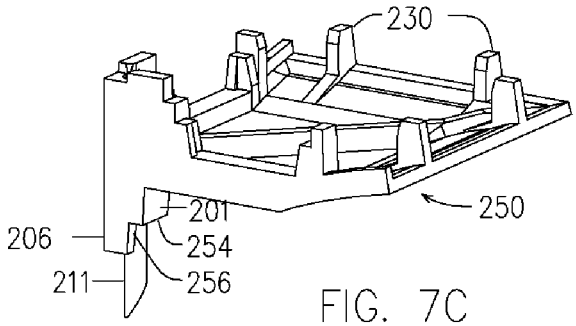
FIG. 7C is a side perspective view of a base block.
Figure 7B:
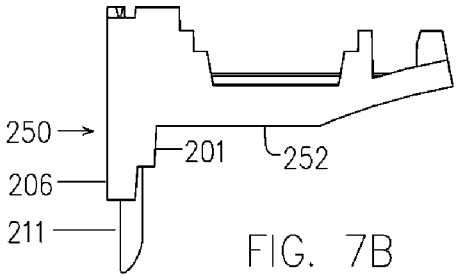
FIG. 7B is a side elevation view of a base block.
Figure 7D:
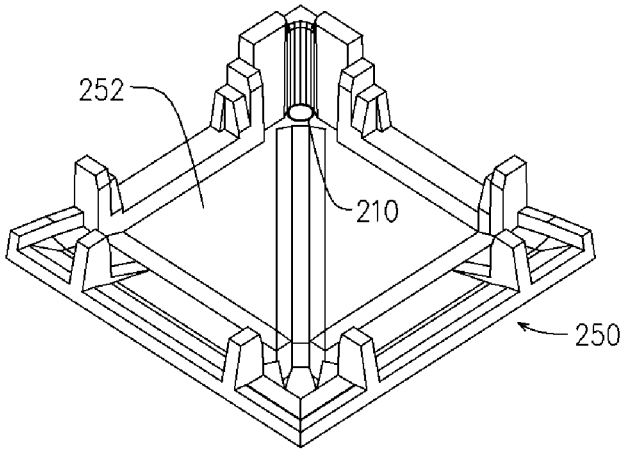
FIG. 7D is a top perspective view of a base block.
Figure 8A:
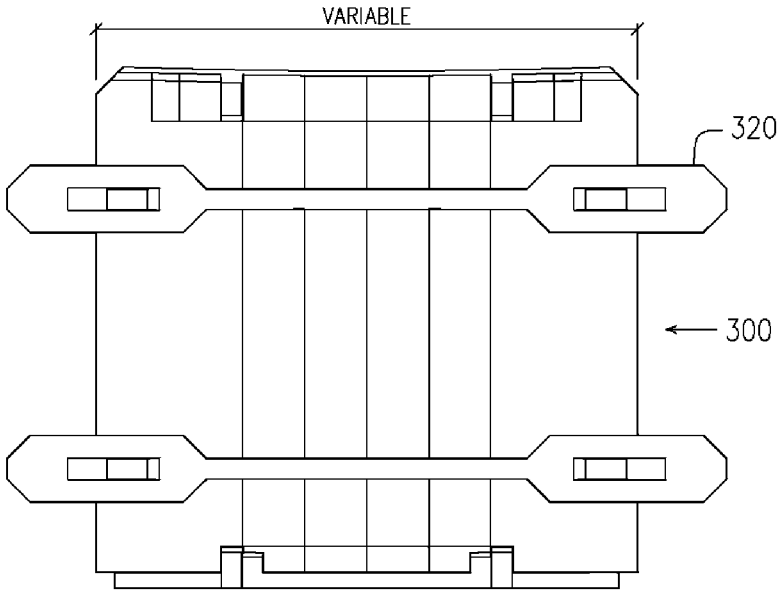
FIG. 8A is a plan view of a key block.
Figure 8B:
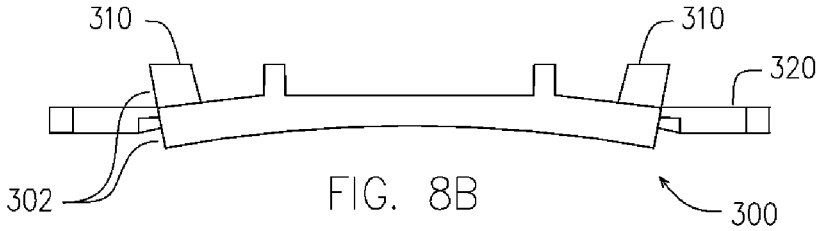
FIG. 8B is a side elevation view of a key block.
Figure 8C:
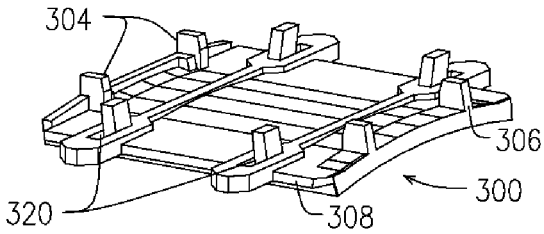
FIG. 8C is a first top perspective view of a key block.
Figure 8D:
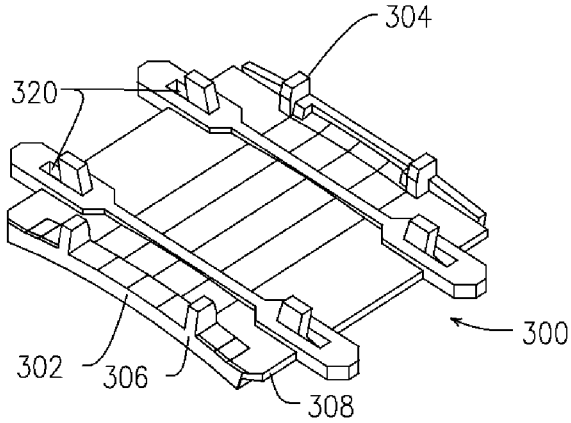
FIG. 8D is a second top perspective view of a key block.
Figure 9A:
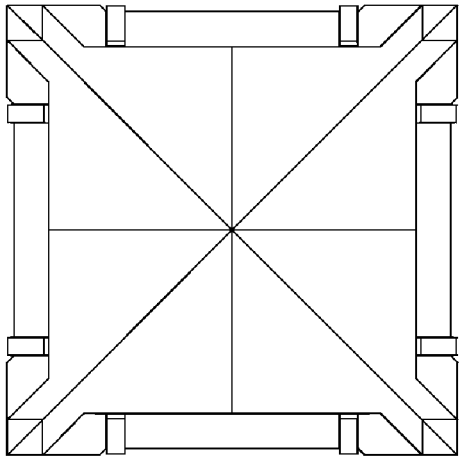
FIG. 9A is a plan view of a center block.
Figure 9B:
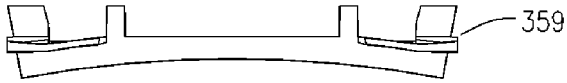
FIG. 9B is a side elevation view of a center block.
Figure 9C:
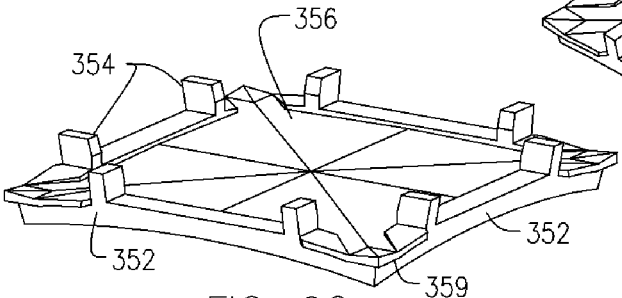
FIG. 9C is a first top perspective view of a center block.
Figure 9D:
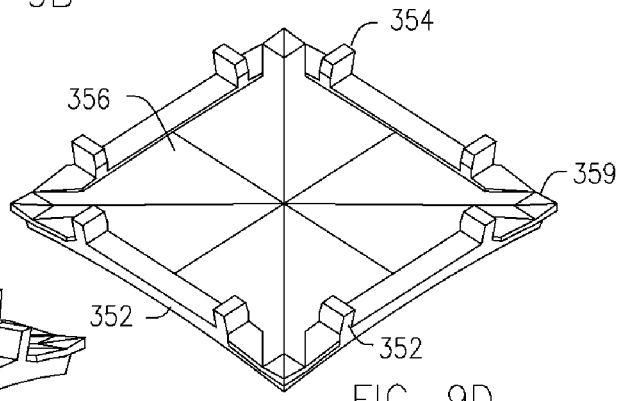
FIG. 9D is a second top perspective view of a center block.

Among the primary functions of the corner block 200 is that it serves as a compression support for key blocks 300 (FIGS. 24A-24E) in two directions. Referring now to FIG. 6D, corner block sloped bearing surfaces 224 of stiffened shell edges 226 and plinths 230 are cut at a slope that is perpendicular to the local plane of the concrete shell; these faces transfer compressive forces from the key block to the corner block, much like a keystone in masonry construction. Corner blocks 200 and key blocks 300 interlock, such that four corner blocks and four key blocks join to form a structurally stable rectangular module. The building system is designed to allow the rapid erection of this structurally stable module with a light crane, and without the need for temporary shoring or bracing.

As previously described, corner blocks 200, key blocks 300, and center blocks 350 each provides standardized plinth supports to carry floor pans above. In addition, outer portions of edge plinths on corner blocks (FIG. 6D) also provide a wall block bearing surface 231 for the support of perimeter wall and gap infill framing (FIG. 15A-15G), and provide tapered surfaces 232 that resist lateral loads from and interlock with standard brackets on spandrel blocks 510, edge frame blocks 520, and exterior wall blocks 550. Referring again to FIG. 6D, vertical surfaces 235 of the interior of the corner block are tapered as required for the extraction of the interior mold during block fabrication.

Corner blocks 200 are designed to nest in plan with one another at interior and edge conditions. Layout of modules may incorporate joints between modules to provide setting tolerance and thermal relief. Joint spacing may be enforced during erection using common spacers, and may be sealed with removable continuous joint wedges and/or elastomeric joint fillers. Spacers at a given location may be of either compressible or rigid material, depending on the structural action needed at that location. Although not required during the erection of a given level of structure, shear pins 109 (not shown) may be installed through corner block shear pin sleeves 237 (FIG. 6C) where deemed necessary prior to building the level of structure above. Shear pins 109 can be utilized to enforce vertical deflection compatibility where minor foundation movements are anticipated, and to link and laterally brace stacked structural modules to adjacent modules.

In order to meet varying architectural and engineering demands, corner blocks 200 are designed to allow adjustability in vertical height (FIGS. 34A-34C) and structural cross-section, as well as adjustability in architectural and structural form. This embodiment features a floor-to-floor height of 14 feet, but this height can be increased or decreased to provide taller and shorter stories, and to traverse a change in ground elevation. Corner block design height may be modified so long as the standard base connection mold is provided; as the lower column 201 design height is modified, the pipe spine 210 changes in length and may increase in wall thickness for tall or heavily loaded corner blocks. Structural demands because of longer spans or taller story heights, or at base levels of multi-story stacked modules, can be met by changing mold sets and reinforcing cages to provide larger and more heavily reinforced cross-sections where required.

The shape of the corner block 200, and the ceiling profile it creates in unison with key blocks 300 and center blocks 350 of a set, may be modified in design and casting to meet architectural needs by enabling variety in architectural span and profile.

Base Block

Referring now to FIGS. 7A-7D, a base block 250 is a limit-case modification of a corner block 200; it is simply a corner block that has been shortened to the greatest extent practical. Base blocks 250 are generally intended for use at the first level of a structure, where it is desirable to have a floor structure that is not significantly higher than the existing ground surface. The lower portion of the thin-shell section of a base block is replaced with a thickened and stiffened flat slab 252, and the lower column section 201 and pipe spine 210 are both shortened to provide a minimal crawl space clearance between the thickened and stiffened flat slab 252 and the top of the supporting structure (FIGS. 22A-22E). It is within this space that the base block 250 can, within limits, be jacked and shimmed to re-level a structure that has experienced undesirable ground motions. By shimming both the base bearing 254 and the base inclined mating faces 256, two-part shims can maintain the necessary keying action between the base block and its support. Base blocks 250 and corner blocks 200 are identical with regard to base configuration, plinth support of pan blocks 370 above, interlock with key blocks 300, and interlock with spandrel blocks 510, edge frame blocks 520, and exterior wall blocks 550.

Key Block

Referring now to FIGS. 8A-8D, the key block 300 completes the span between two corner blocks 200 or base blocks 250. Key blocks 300 feature key block sloped bearing faces 302 and key block plinths 310 to mate with corner block sloped bearing surfaces 224 of two supporting corner blocks 200 or base blocks 250. Key blocks 300 also feature pairs of reinforced concrete "eyes" 320 to receive and interlock with two tapered corner block plinths 230 (FIGS. 24A-24E) from each supporting corner block 200 or base block 250. This provides self-positioning during erection and interlock between the key blocks 300 and supporting corner blocks 200 or base blocks 250 without the need for connectors. The interlock provided between key blocks and corner blocks or base blocks is intended to resist stress reversals or bending moments at the joint, as would tend to occur in a flatter arch profile, during lateral loading of a structure, or under movement of the supporting soils.

Referring again to FIG. 8D, key blocks 300 include key perimeter plinths 304 to interlock with bracket supports 501 on spandrel blocks 510, edge frame blocks 530, and exterior wall blocks 550, similar to the interlock provided by column blocks 200. Key blocks 300 also provide a center block support bearing surface 306 and key block plinths 310 to support center blocks 350, as well as standardized plinth supports to carry floor pans 370 (not shown) above. Key blocks 300 incorporate the necessary taper of vertical surfaces as required for unobstructed mold removal during manufacture.

In order to provide a substantially water-tight shell as previously discussed, key blocks 300 may be cast with key block drainage wings 308 (FIGS. 8C and 8D) as required to overlap with and shed water onto corner blocks 200.

Key blocks 300 are a convenient vehicle for adjusting the plan geometry and span of a given structural module from the example 25' square plan module of FIG. 5A. By changing mold sets, key blocks may be narrowed or widened (FIGS. 34I-34K) as required to form rectangular modules and a variety of spans. Center blocks 350, pan blocks 370, and floor infill blocks 470 may be modified in design and casting as required to conform to narrowed or widened key blocks. For long clear-span modules, simple post-tensioning may be utilized to provide vertical resistance to design live loads; such spans can generally be designed to allow the interlocking system, without post-tensioning, to carry self-weight and construction loads to preserve speed of erection. As with corner blocks, the shape of the key block and the ceiling profile it creates may be designed and cast to meet architectural needs.

Center Block

Referring now to FIGS. 9A-9D, the center block 350 completes the shell between four key blocks 300, and features center block sloped bearing surfaces 352 that are perpendicular to the local plane of the concrete shell to mate with those of four supporting key blocks 300. Center block plinths 354 work in conjunction with plinths from corner blocks 200 and key blocks 300 to carry a secondary floor structure.

Figure 23A:
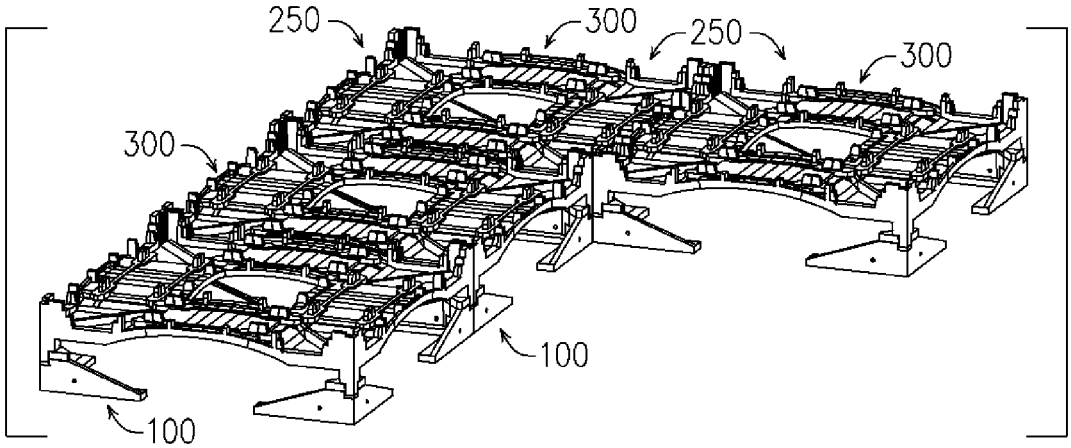
FIG. 23A is perspective view of the embodiment of FIG. 21B with key blocks set.

Because the corner and key blocks interlock to form a stable structure, installation of the center block is optional (FIG. 23A). This option provides opportunities for easily providing an opening at the center of any structural module for an elevator shaft, atrium, spiral stair, or skylight. Larger floor openings, or those that are needed between modules, are formed with gap framing blocks, as described below, between spaced modules.

Referring again to FIGS. 9C and 9D, the center block may include a draining top surface 356, such that the block drains to its edges. In order to provide a substantially water-tight shell as previously discussed, center blocks 350 may be cast with center block drainage wings 359 (FIGS. 9C and 9D) as required to overlap with and shed water onto corner blocks 200.

Access Floor/Terrace System

Figure 10A:
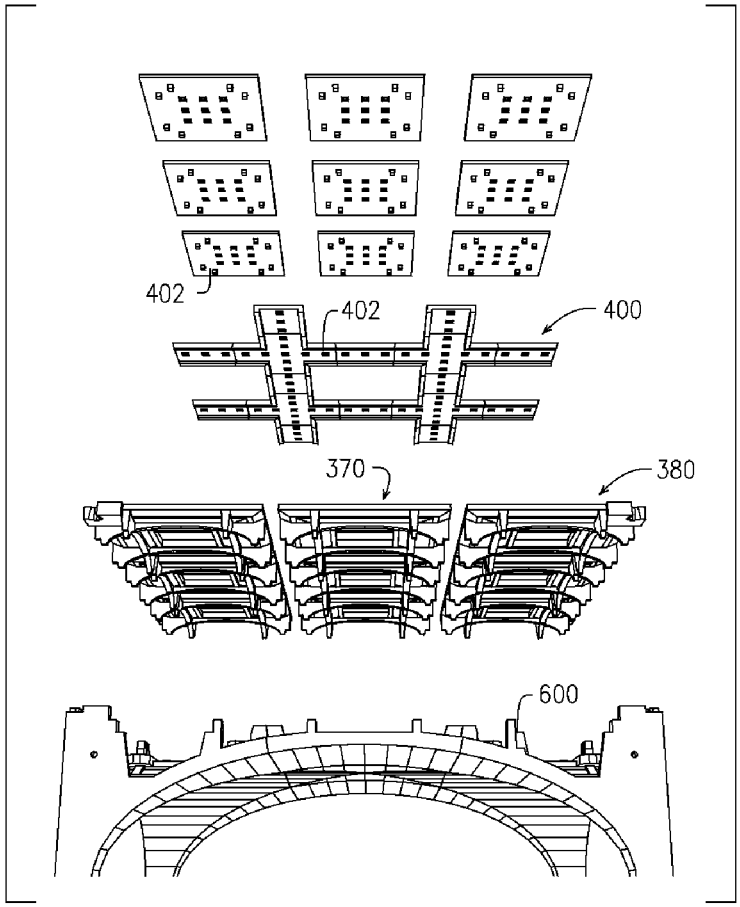
FIG. 10A is an exploded side view of an access floor/terrace system above the structural module.
Figure 10B:
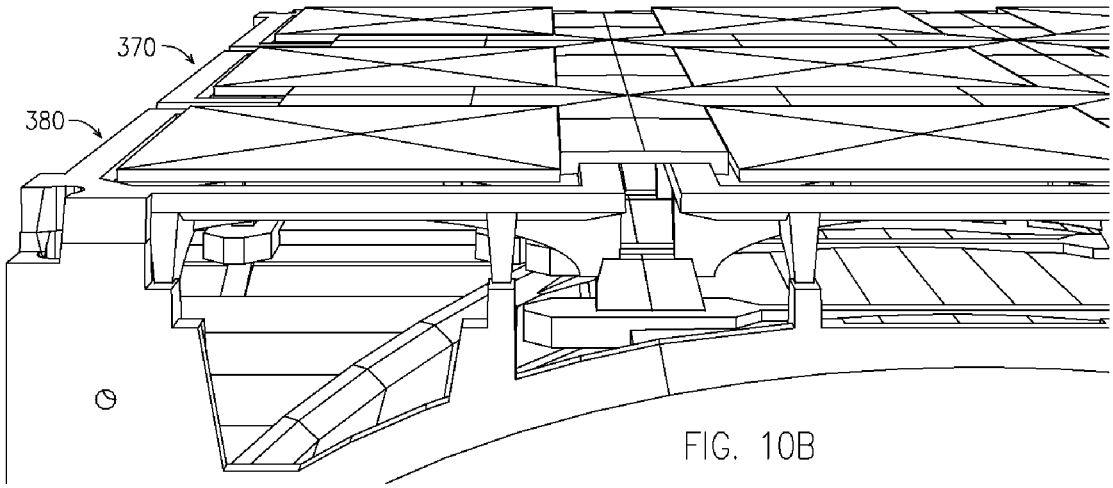
FIG. 10B is a perspective view of a structural module with access floor system assembled on the module.

Referring now to FIG. 10A-10B, this embodiment includes a unique access floor/terrace system 360 that provides an accessible plenum below the structured floor. This same system may be configured to provide a stacked concrete panel roofing system, rainwater collection system, and highly functional roof terrace without the need for a conventional roof membrane. The access floor/terrace system 360 in this example is designed to be compatible with the remainder of this building system, but it can also be used in conjunction with a variety of other structural supports. The design and casting of the access floor/terrace system 360 blocks can be readily modified to increase or decrease plenum height and to bear on any structural system that is shown by engineering analysis or by test to be capable of safely resisting all Code-prescribed loads without excessive deflection. This building system can provide for quick and simple connectivity of mechanical, electrical, data, and plumbing lines within the underfloor plenum that is provided in this example at each level of the structure.

Both floor and roof terrace systems in this example consist of pan blocks 370 and corner pan blocks 380 arranged on plinths from the structural shell 600 to leave a gap of several inches between pan edges. That gap is covered by cap blocks 400, and provides plenum access to MEP knock-outs 402 regularly spaced at the underside of cap blocks to provide modular access points for electrical, data, and plumbing systems to pass through the floor and into the space above. The cap blocks 400 bridge the gap between pan blocks 370 and nest into self-draining concrete basins 379. Openings may be covered and floors brought to consistent elevation by floor infill blocks 470.

The primary water-proofing material in this system is intended to be interlocking precast concrete blocks that are specifically designed for low permeability. Roof terrace pans and caps may incorporate special concrete mixes, admixtures, and surface treatments to minimize the permeability and to enhance the water penetration resistance of the concrete. Cap blocks 400 seal the joint between pan blocks 370; joints between cap blocks can be sealed with sheet metal or elastomeric cap joint flashing. Water shed by terrace cap and floor infill blocks 470 can be drained to the central openings 371 in pan blocks, and there caught in a pressed, soldered, or elastomeric drain pan, which can subsequently direct the water into rainwater collection pipes. Where additional protection is desired or in especially wet environments, common sheet membrane waterproofing can be installed below cap blocks 400 and floor infill blocks 470 and tied directly into a rainwater collection system.

Pan Block

Figure 11A:
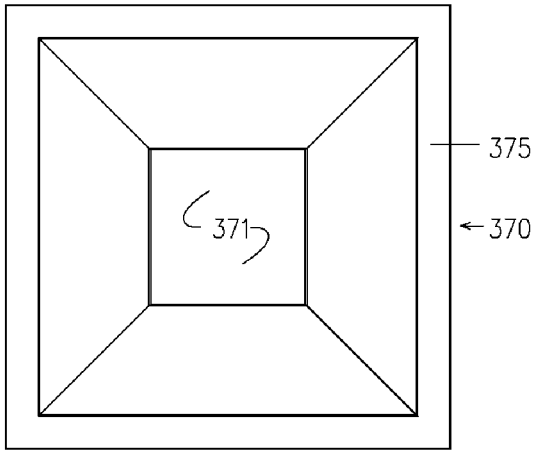
FIG. 11A is a plan view of a pan block.
Figure 11D:
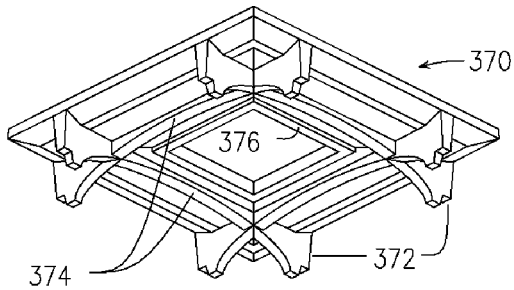
FIG. 11D is a bottom perspective view of a pan block.
Figure 11B:
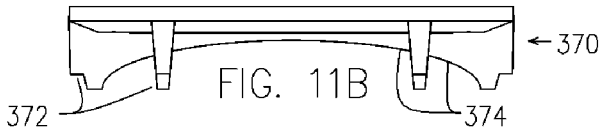
FIG. 11B is a side elevation view of a pan block.
Figure 11C:
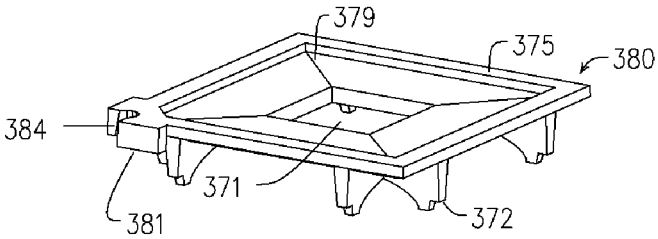
FIG. 11C is a top perspective view of a pan block.
Figure 11E:
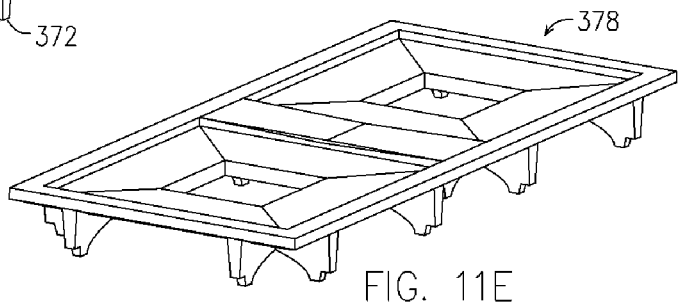
FIG. 11E is a top perspective view of a fused pan block that covers two dimensional modules.

Referring now to FIG. 11A-11E, pan blocks 370 and corner pan blocks 380 are designed to bear on and key into an array of corner block plinths 230, key block plinths 310, center block plinths 354 (FIG. 10B). Pan blocks 370 may also bear directly on gap framing blocks 530 (not shown). Referring again to FIG. 11C, pan block keyed feet 372 act as both bearing points, at which floor loads can be transferred to the structural shell, and self-positioning keys that may be tapered for interlock. Pan block stiffening beams 374 (FIG. 11D) span between feet and in this example take advantage of arching action to minimize their depth at the center of the pan block and to therefore maximize vertical clearance in critical areas within the underfloor plenum. Pan block stiffening beams 374 and keyed feet 372 may be cast with vertical extensions to increase the standoff height and plenum access space where required. Top surface of pan edge 375 in this example is about 2" below the finished floor surface, and is covered with approximately 2" thick cap blocks (FIG. 12). FIG. 10A-10B demonstrate how pan edges 375 may be spaced, and how that space may be covered and adjacent pans engaged by cap blocks 400. FIG. 11C shows how the pan blocks 370 may slope downward from the vertical face that engages with the cap block 400 toward the central opening 371 or floor drain in each pan block. FIG. 11D illustrates how the underside of the pan block 370 may incorporate a pan block lip 376 that stiffens the edge of the opening and provides a surface against which to seal a water catch pan (not shown). Referring again to FIG. 11C, the self-draining concrete basin 379 that can be incorporated at the center of each pan block may be finally covered with a floor infill block 470 (FIG. 10B) that results in a consistent floor plane.

At roof terrace or interior wet area applications, the self-draining concrete basin 379 may be fitted with a pressed or soldered sheet metal water catch pan (not shown) and drain fitting connected to a rainwater or gray water collection pipe. A continuous gap may be formed between the perimeter of every floor infill block 470 and the surrounding cap blocks 400. This gap can act as a modular slot drain system that catches and routs rainwater into the collection system. At dry areas, the center opening in each pan block can provide a modular point of potential access to the underfloor plenum.

Corner pan blocks 380 (FIG. 11C) are identical to pan blocks 370 (FIG. 11D) except that, where a column is located at the corner of the corner pan block 380, the thickened corner 381 is cast with a rounded vertical face 384 to receive a base pipe extension 211 from a corner block 200 above. The thickened corner 381 may be reinforced as required to transfer the base reaction of the corner block 200 above to the supporting corner block 200 or base block 250 below. At the uppermost level of a structure, where no upper level column is to be installed, corner pan blocks 380 may be replaced with pan blocks 370 to build a continuous roof terrace.

As noted above, spans and cross-sections of pan blocks may be modified in design and casting to fit supporting blocks of modified dimension. In this example, a single pan block 370 may complete a single 8'-4" square dimensional module, such that 9 pan blocks 370 complete a 25' by 25' structural module. Alternatively, pan blocks 370 may be stretched in design and casting, or multiple pan blocks may be fused together (FIG. 11E) in design and casting to create a fused pan block 378 that can have multiple drainage points to satisfy emergency overflow provisions in building codes.

Cap Blocks

Referring now to FIGS. 12A-12J, in this example, the primary function of cap blocks 400 is to cover and seal the edge gaps between pan blocks 370 and corner pan blocks 380, and to establish the finished floor elevation. Cap blocks 400 at roof terrace or other wet floor applications may incorporate a sloping top surface 401 to drain water to the edge of the cap block and into the pan block. Although cap blocks at interior floor applications can incorporate this slight crown and still have a flatter floor surface than would a saltillo tile floor, interior caps may also be cast without a crown to provide a flat floor surface. The underside of each cap may incorporate a small recess at each end (not shown) to accommodate cap joint flashing strips, and may also include a series of thinned-section MEP knock-outs 402 (FIG. 12G) located at a modular spacing on the underside of each cap block. Each MEP knock-out 402 can offer an opportunity for system access through the floor; MEP knock-outs 402 can be drilled through or knocked out as required to pass mechanical, electrical, plumbing, and data systems from the underfloor space into the occupied space, or to anchor an interior partition above. Cap blocks 400 are of sufficient weight (the smallest weighs about 220 pounds) to allow some tolerance in the keyed joint with adjacent pan blocks 370 without the cap feeling loose underfoot. Cap blocks 400 can ideally be laid onto a cushioning layer such as 30# felt (not shown), but this is not mandatory.

A combination of cap block sections in this example work together to form a continuous cap. These consist of a typical interior cruciform cap block 410 (FIG. 12G), a shorter, functionally named wedge cap block 420 (FIG. 12I), and a column cap block 425 (FIG. 12H), which is essentially a wedge cap block 420 that is extended to a column face. Exterior edges of the cap block system may be built using curbed perimeter cap blocks 430 (FIG. 12C) or uncurbed perimeter cap blocks 440 (FIG. 12D). Curbed perimeter cap blocks 430 may incorporate an upturned edge 431 for water containment; flashings at roof or parapet wall conditions may lap over the upturn edge 431 on these blocks. Uncurbed perimeter cap blocks 440 may be used at interior conditions where water-tightness is not an issue.

Floor Infill Blocks

Figure 13A:
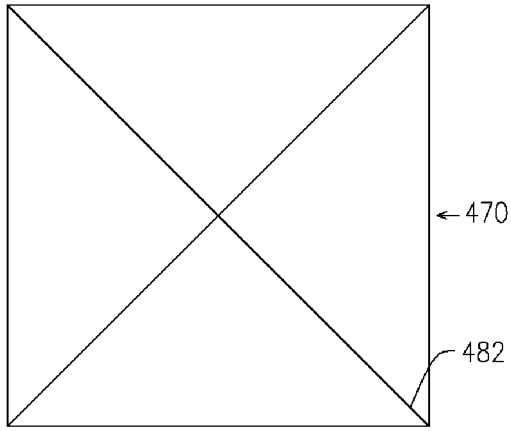
FIG. 13A is a plan view of a floor infill block.
Figure 13B:
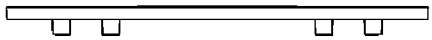
FIG. 13B is a side elevation view of a floor infill block.
Figure 13C:
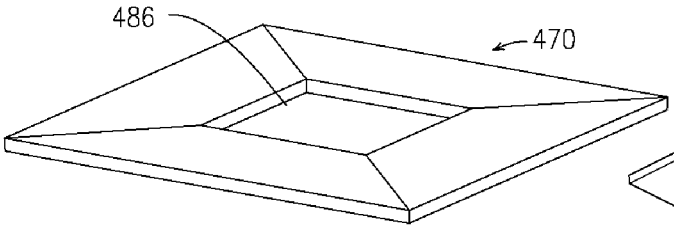
FIG. 13C is a top perspective view of a floor infill block with a hatch opening.
Figure 13D:
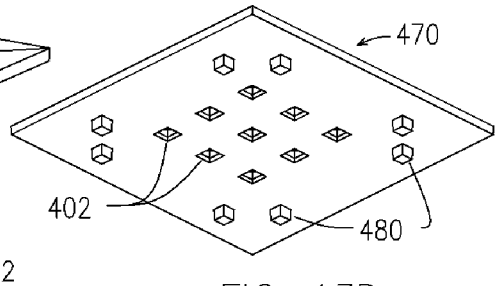
FIG. 13D is a bottom perspective view of a floor infill block with MEP knockouts.
Figure 13E:
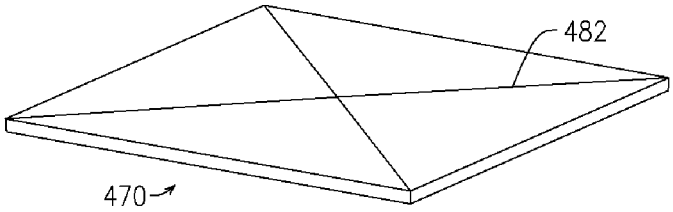
FIG. 13E is a top perspective view of a floor infill block.
Figure 14A:
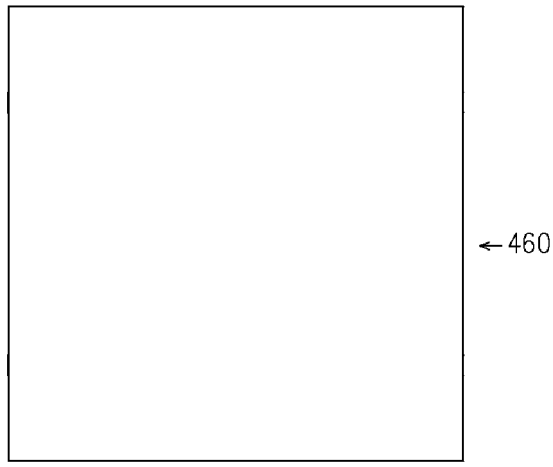
FIG. 14A is a plan view of a floor plank block.
Figure 14B:
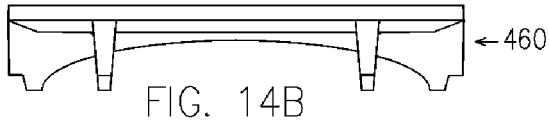
FIG. 14B is a side elevation view of a floor plank block.
Figure 14C:
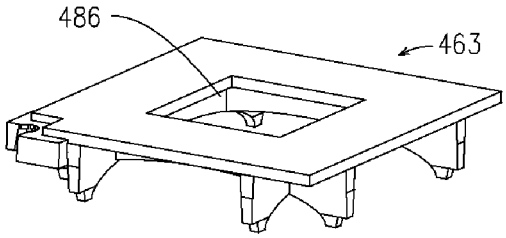
FIG. 14C is a top perspective view of a floor plank block with a hatch opening.
Figure 14D:
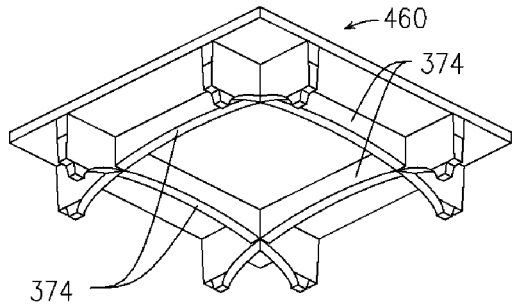
FIG. 14D is a bottom perspective view of a floor plank block.
Figure 14E:
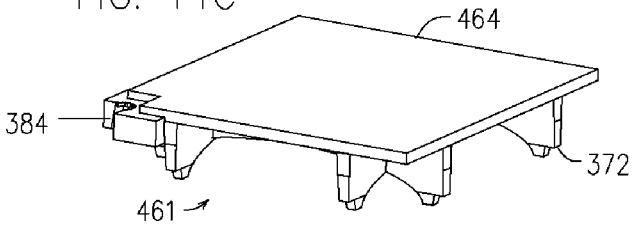
FIG. 14E is a top perspective view of a floor corner plank block.

Referring now to FIGS. 13A-13E, the primary function of a floor infill block 470 is to cover the central opening 371 in a pan block 370 and to complete the finished floor. Floor infill blocks 470 at roof terrace or other wet floor applications may have a crowned surface 482 (FIG. 13E) to drain water to the edge of the floor infill block 470 and into the pan block 370. As with cap blocks, floor infill blocks at interior applications may be cast without a crown to provide a flat floor surface. Floor infill blocks 470 are of sufficient weight (approximately 800 pounds) to allow a continuous perimeter joint between floor infill blocks 470 and cap blocks 400 without fear of the infill block feeling loose underfoot. This slot can provide the necessary installation tolerance, a potential air diffuser for an underfloor HVAC system, or a perimeter slot drain at wet applications. Referring now to FIG. 13D, floor infill blocks also incorporate regularly spaced MEP knock-outs 402 at the underside of the floor infill block to provide additional modular access points for plumbing, electrical, and data systems, or to anchor interior partitions above. Sawcuts linking multiple MEP knock-outs 402 can be utilized to form a larger penetration for services such as vents connecting to the space above to an underfloor HVAC system.

Floor infill blocks need not be any thicker than required to resist structural loads, and may incorporate short pedestal supports 480 that transfer floor infill block loads to the pan block below. The interstitial space (FIG. 10B) that remains allows unimpeded water drainage at wet floor applications, and allows air circulation for drying. Gaps may be closed with compressible fillers where desired for control of air flow from an underfloor HVAC system. Referring now to FIG. 13C, floor infill blocks 470 may incorporate a hatch opening 486 for a removable panel (not shown) that provides access to the plenum space. Where access to the plenum space is required below a floor infill block 470 without a hatch opening (FIG. 13E) a small portable lift (not shown) can be utilized to temporarily remove and replace the floor infill block 470.

As with all faces of blocks that are exposed to view, floor infill blocks may be cast with a finished concrete surface that can incorporate surface patterns, veneer, and integral color. They may also be left flat or roughened to receive underlayment as necessary below carpet, vinyl tile, ceramic tile, or wood flooring. Applied surfaces can be field-installed, but finishes can also be applied prior to shipping to the site. Floor infill blocks 470 offer additional opportunities for completing construction in a more controlled environment than the standard construction site; they can be shipped with pre-wired or pre-plumbed options, or with cabinetry already mounted to the block. They may also be cast and shipped with integral water circulation lines for an in-floor radiant comfort control system.

Although floor infill blocks 470 of the embodiment shown are built of precast concrete, they may also be built of wood or any other suitable construction without negative impact on the overall system.

Plank Floor System

Referring now to FIGS. 14A-14E, for heavy load or utility floor applications such as parking garages, or where the multipart layered concrete blocks of the access floor/terrace system are not desired, they can be replaced with simplified floor plank blocks 460. These blocks are similar to pan blocks 370 and can provide a hatch-accessible plenum below the floor. In this example, a single floor plank block 460 may complete a single 8'-4" square dimensional module, such that 9 floor plank blocks 460 complete a 25' by 25' structural module. As previously described in the discussion of pan blocks 370, multiple floor plank blocks 460 may also be fused together in design and casting to create a modular strip. Completion of a floor system requires only two floor plank block types: a floor plank block 460 (FIG. 14D); and a corner plank block 461 (FIG. 14E) that incorporates the standard column bearing details of corner pan blocks 380. Both block types feature keyed feet 372 to bear on and interlock with supporting corner block plinths 230, key block plinths, 310, and center block plinths 354 from the structural shell, and may also include stiffening beams 374. Corner plank blocks 461 share many characteristics with corner pan blocks 380, including thickened corners 381 and rounded vertical faces 384.

As with all exposed surfaces in this system, the finished floor surface 464 of floor plank blocks 460 may incorporate integral or surface colors and textures, or they may be configured to receive any conventional finish material. Open floor plank blocks 463 (FIG. 14C) may also be configured with hatch openings 486 to accommodate floor hatches, registers, or other necessary floor penetrations.

Special Framing Blocks

The building blocks and methods described above may be used to create a single structural module 600 with an access floor/terrace system 360, or a larger structure that is comprised of multiple nested and/or stacked structural modules. At the perimeter of a completed structural shell and floor system, which may include any number of structural modules, and where structural openings have been formed between gapped structural modules, special framing blocks may be provided to carry perimeter loads and to provide closure of the plenum between the structural shell and the floor. Special framing blocks may consist of spandrel blocks 510, edge frame blocks 520, gap framing blocks 530, or wall blocks 550 (not inclusive).

Left and right end extensions of the special framing blocks may be combined to provide complete perimeter closure for any plan geometry. As with other components, these blocks may be constructed in a wide variety of shapes, spans, cross-sections, and finishes to provide the required structural and architectural design flexibility.

While special framing blocks serve a variety of useful functions, they are not required for the structural integrity of the primary structure, and are in that sense optional; they can be omitted in temporary or utilitarian applications such as temporary canopies or agricultural shelters.

Spandrel Blocks

Figure 15A:
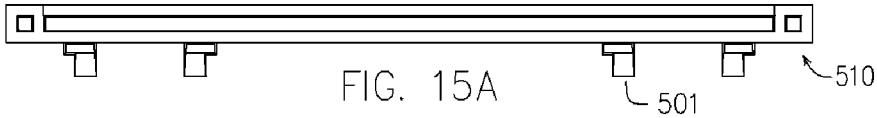
FIG. 15A is a plan view of a spandrel block.
Figure 15B:
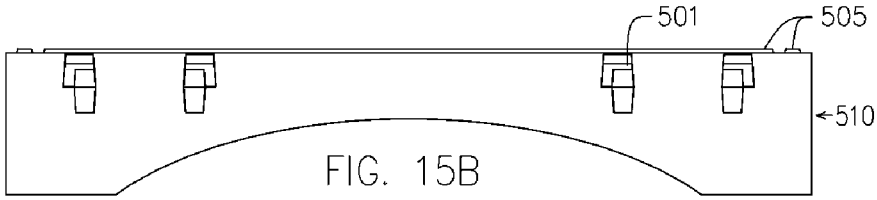
FIG. 15B is a side elevation view of a spandrel block.
Figure 15E:
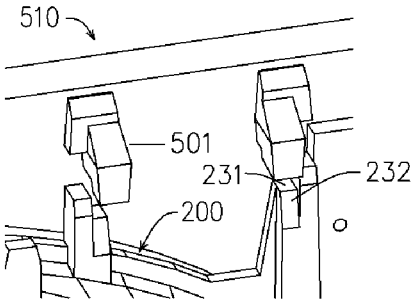
FIG. 15E is a perspective view of a spandrel block suspended above a corner block.
Figure 15C:
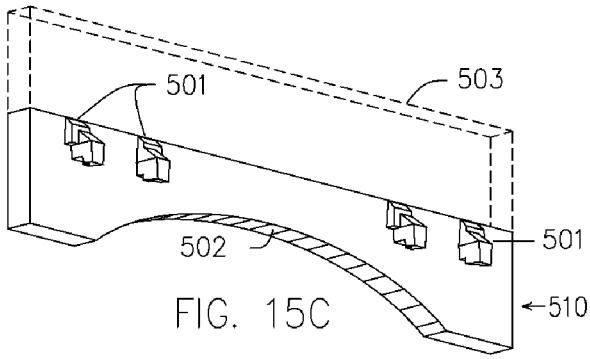
FIG. 15C is a perspective view of a spandrel block with a parapet extension.
Figure 15F:
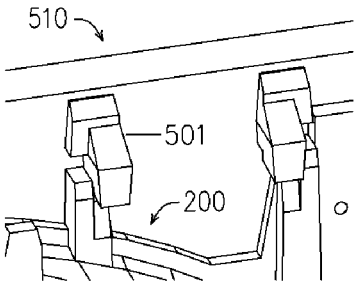
FIG. 15F is a perspective view of spandrel block being lowered to engage with corner block supports.
Figure 15D:
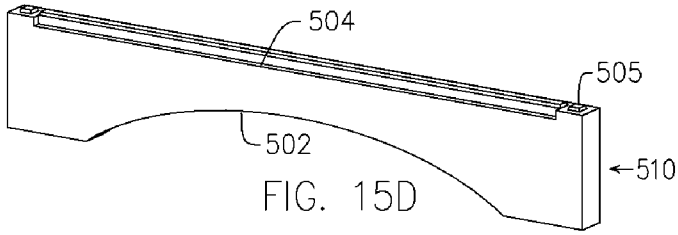
FIG. 15D is a perspective view of a spandrel block with a perimeter ledge.
Figure 15G:
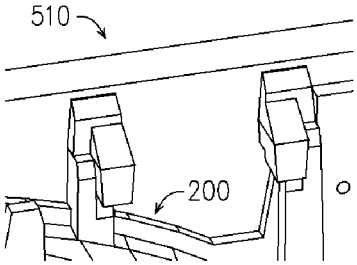
FIG. 15G is a perspective view of a spandrel block bearing on a corner block.
Figure 15H:
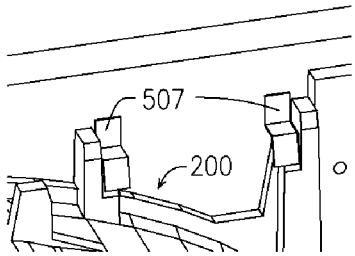
FIG. 15H is a perspective view of a bent plate bracket support.
Figure 16A:
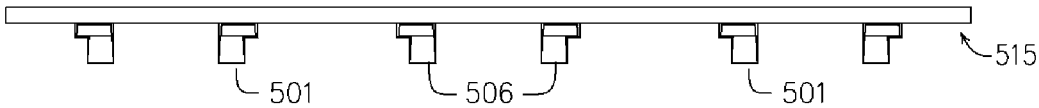
FIG. 16A is a plan view of a framed spandrel block.
Figure 16B:
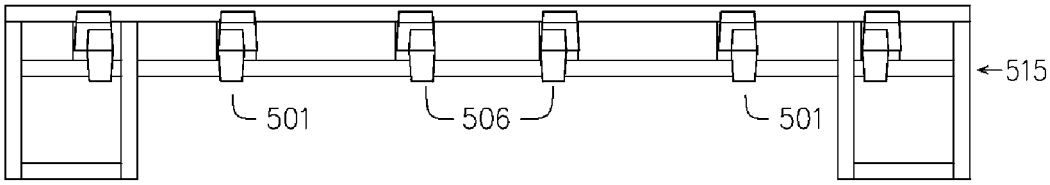
FIG. 16B is a side elevation view of a framed spandrel block.
Figure 16C:
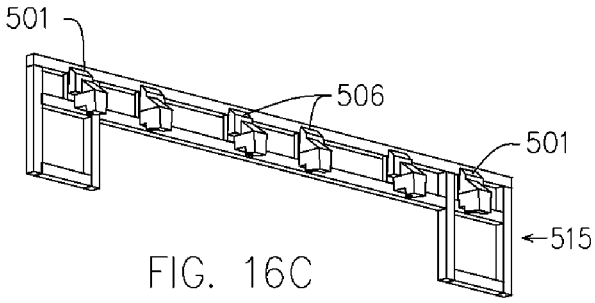
FIG. 16C is an interior perspective view of a framed spandrel block.
Figure 16D:
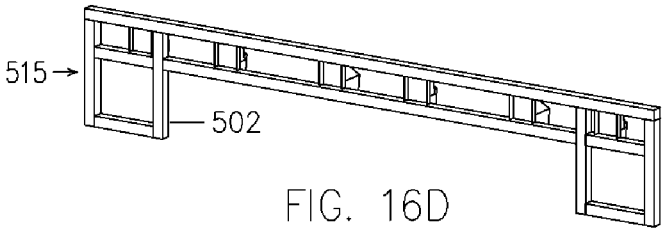
FIG. 16D is a front perspective view of a framed spandrel block.
Figure 30:
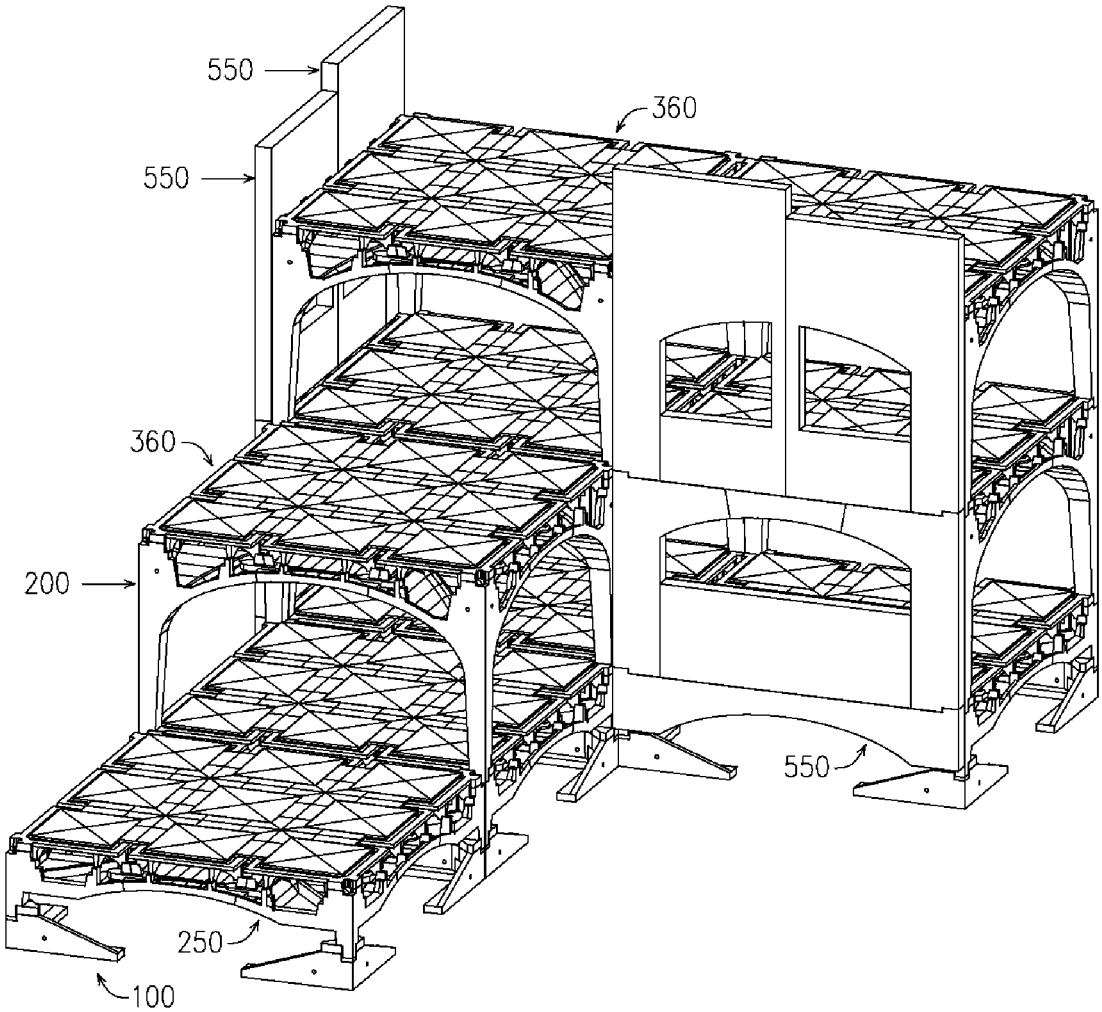
FIG. 30 is perspective view of the embodiment of FIG. 29B with a portion of exterior walls installed.
Figure 31A:
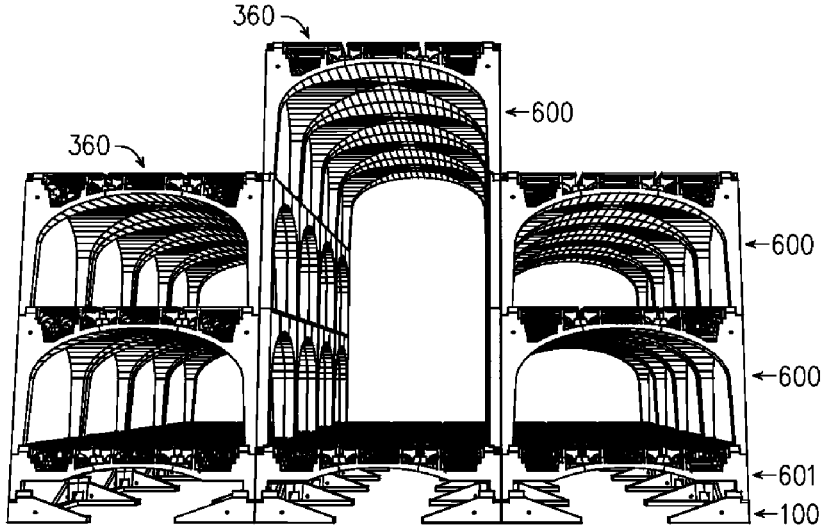
FIG. 31A is a perspective view of a sample assembly with a high center span.
Figure 31B:
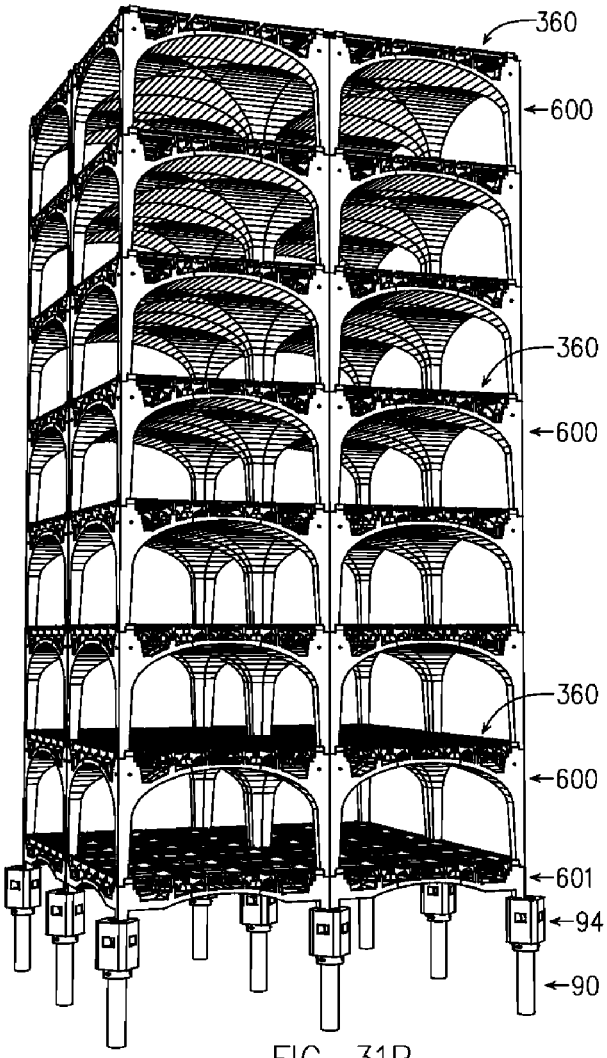
FIG. 31B is a perspective view of a sample multistory assembly.

Referring now to FIGS. 15A-15D, a variety of functions may be served by spandrel blocks 510. These blocks are designed to interlock with and transfer perimeter wall loads to corner blocks 200 using bracket supports 501. In this example, bracket supports 501 are shown as precast concrete construction, but these elements may also be constructed of an assembly of another structural grade material such as a steel plate bracket assembly 507 (FIG. 15H) that provides the necessary bearing and lateral interlocking faces to mate with wall block bearing surfaces 231 and tapered surfaces 232 that are presented by corner blocks 200 and key blocks 300 (FIGS. 15E-15G). Spandrel blocks 510 may also be used as temporary spacers to force corner blocks 200 into their required position prior to installing key blocks 300. Use as a temporary spacer requires that optional bracket supports 506 (FIG. 16C) be omitted as shown in FIG. 15C to avoid conflict with key blocks 300 during their installation. Spandrel blocks 510 are designed so they can be used to support curtain walls at any floor level of an enclosed structure; they may also be used as perimeter closure pieces in an open structure such as a canopy. By providing a spandrel block 510 with a parapet extension 503, perimeter closure and a parapet guard wall may be provided at the perimeter of a roof or roof terrace (FIG. 30).

Figure 18:
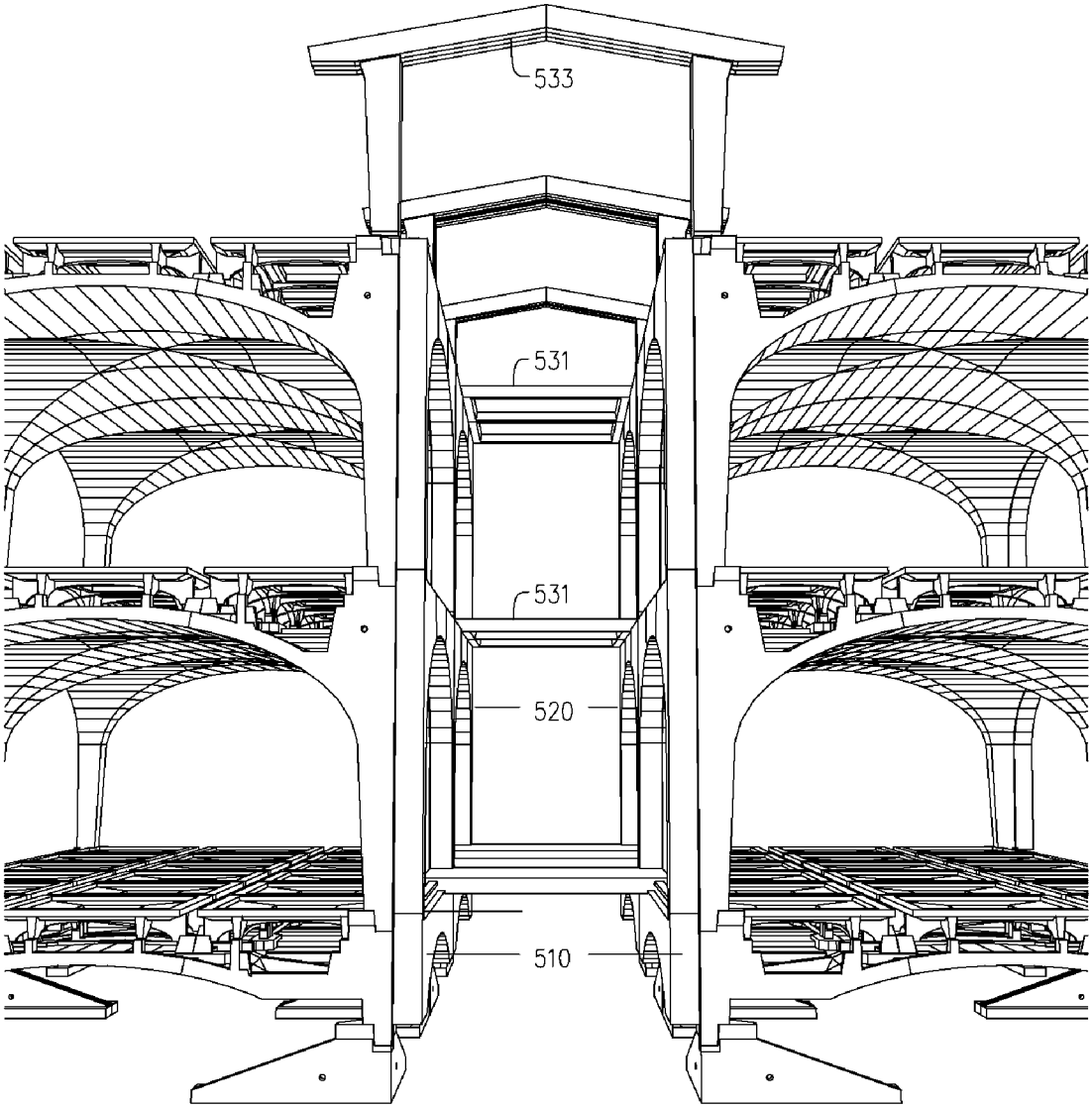
FIG. 18 is perspective view of multiple modules and gap framing blocks.

At an interior floor opening such as a stairwell, atrium, or skylight (FIG. 18), spandrel blocks 510 and edge frame blocks 520 may seal the access floor plenum and support gap infill framing between spaced structural modules. Tops of spandrel blocks 510 may be located below the floor level to support infill framing, at floor level for threshold conditions and full-height infill wall conditions, and at guardrail height or above for guardrail, parapet wall, or screen wall conditions (FIG. 15C). Top of spandrel blocks 510 may be flat, sloped to drain, or stepped for architectural purposes. They may also be provided with top ledges 504 and key interlocks 505 at locations where edge frame blocks 520 or wall blocks 550 are supported at the top of the spandrel block 510 (FIG. 15D). The bottom surface of a spandrel block 510 may incorporate a bottom profile 502 that can be configured to match the profile of the structural shell or another profile as desired architecturally.

Depending on structural and architectural demands, construction of spandrel blocks 510 may be precast in the form of stiffened shell blocks that are open to the interior of the access floor or hollow sections with finished shell faces on all sides. Alternatively, framed spandrel blocks 515 (FIGS. 16A-16D) may be built of steel or wood framing, or of any other structurally suitable construction that incorporates the necessary details for interlock with the structural shell. Framed spandrel blocks 515 may be utilized in a number of ways. As with spandrel blocks 510, framed spandrel blocks 515 incorporate bracket supports 501 (FIG. 16C) that may be of precast or other construction. If optional bracket supports 506 are omitted, framed spandrel blocks 515 may serve as temporary spacers between corner blocks 200 prior to the installation of key blocks 300. Framed spandrel blocks 515 may be used to support secondary conventional wall framing or window wall systems that bear directly on or run outboard of the framed spandrel block. Framed spandrel blocks 515 may also be constructed with extensions as required to provide a variety of top and bottom profiles 502.

Edge Frame Blocks

Figure 17A:
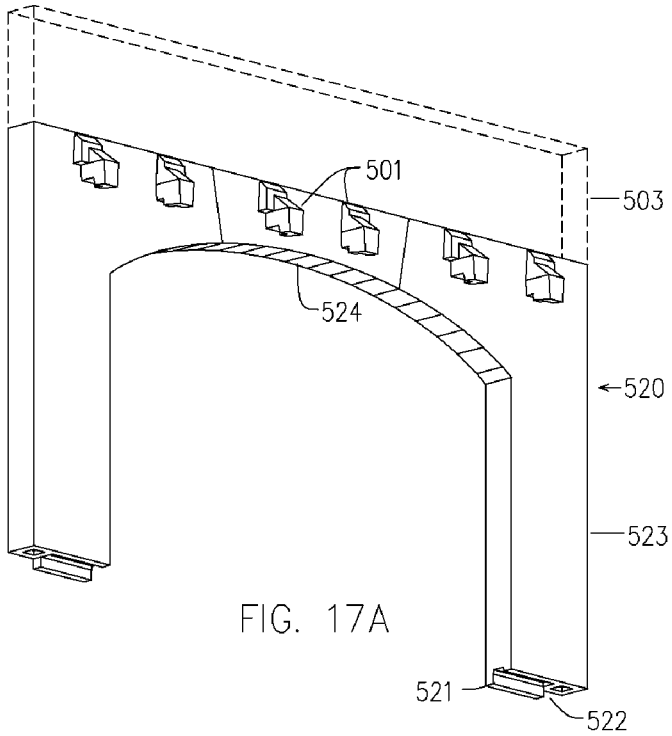
FIG. 17A is an interior perspective view of an edge frame block with a parapet extension.
Figure 17E:
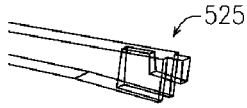
FIG. 17E is a wireframe view of edge frame block key component end joint.
Figure 17D:
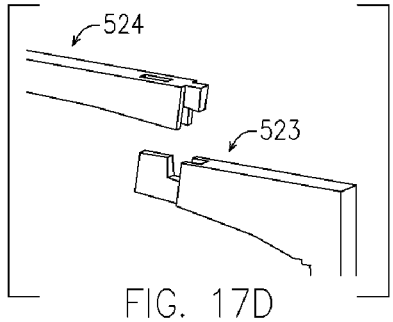
FIG. 17D is an exploded view of edge frame block components.
Figure 17B:
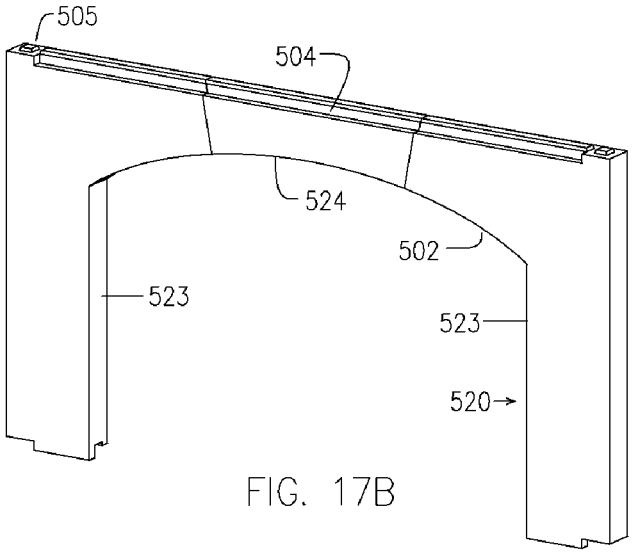
FIG. 17B is an exterior perspective view of an edge frame block.
Figure 17C:
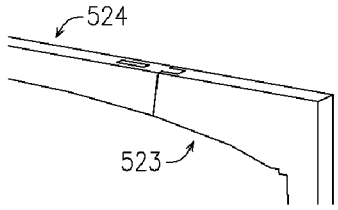
FIG. 17C is an assembled view of edge frame block components.

Referring now to FIGS. 17A-17C, edge frame blocks 520 incorporate the features of spandrel blocks 510, except that edge frame blocks are segmented into corner components 523 and key components 524. Edge frame blocks 520 are also designed with column extensions 521 and column base keyed interlock 522 so that their loads are transferred directly onto footing blocks 100, pier cap blocks 94; edge frame blocks 520 may also bear directly on spandrel blocks 510, wall blocks 550, or other edge frame blocks at the level below. Edge frame blocks 520 may be designed for use in cases where edge framing must carry loads that are greater than a spandrel block 510 can safely transfer, or where architectural considerations dictate that the edge frame be full-height. Edge frame consists of corner components 523 and key components 524 that interlock in similar fashion to corner blocks 200 and key blocks 300 of the structural shell. FIG. 17C shows an example of an edge frame component 523 and key component 524 joined. FIG. 17D shows an exploded view of the same two components, and FIG. 17E shows an edge frame wire drawing 525 that demonstrates one possibility for an internal geometry of an interlocking joint between these blocks. Like spandrel blocks 510, edge frame blocks 520 may be of stiffened shell construction or of hollow sections with finished shell faces on all sides. Edge frame blocks 520 may also be constructed in a wide variety of shapes, spans, and cross-sections to provide the required structural and architectural design flexibility. In FIG. 17B, the space between corner components 523 and below key components 524 may be filled with glazing, window wall system, conventional wall construction, or modular infill wall blocks. As with spandrel blocks 510, edge frame blocks 520 may be provided with a parapet extension 503 (FIG. 17A). Edge frame blocks 520 may also be configured to function as independent frames that can be separated from or supported by a structural module of this building system; or they can be fitted with base pipe extensions 211 (not shown) and used as independent structural components that are supported on foundation footing blocks 100, pier cap blocks 94, base blocks 250, or corner blocks 200.

Gap Framing Blocks

The ability to separate structural modules of this system with a gap (FIG. 18), and to fill that gap with framing or leave it open, provides enormous flexibility in the structural and architectural layout of a building constructed of this system. Structural modules can be spaced orthogonally with a rectangular gap or gap infill framing. Modules can also be staggered, or they can be radially spaced and rotated with a wedge or pie-shaped gap or gap infill framing. Gap framing blocks 530 generally feature keyed interlocks 505 or base pipe extensions 211 for connectivity to supporting spandrel blocks 510 or edge frame blocks 520. Gap framing blocks 530 may consist of stiffened slab infill blocks 531, modular shell infill blocks 532 (not shown), or rigid frame infill blocks 533. Because stiffened slab infill blocks 531 are simple elements that can be readily designed and cast in different configurations, they are particularly well suited to wedge-shaped or curved plan geometries that may be required for a non-orthogonal layout of base structural shells 601.

Specialized gap framing blocks can provide vertical access and closure above a framed gap between structural modules. Examples of such specialized blocks include precast stair blocks and open frames or shells above a terrace access stair, elevator, or atrium. Similar elements may provide vertical access and closure above an omitted center block.

Wall Blocks

This building system is designed to provide a finished structural shell that is capable of accommodating exterior walls and interior partitions of a variety of construction types. This building system can also offer demountable modular exterior wall blocks 551 and interior partition systems that can be designed to complement and complete an enclosed structure.

Exterior Wall Blocks

Figure 19A:
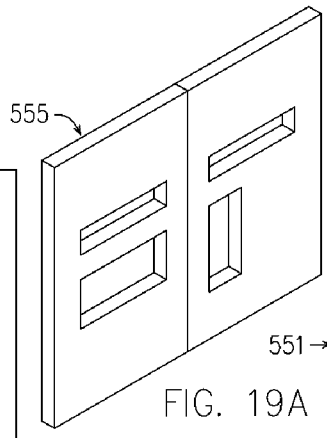
FIG. 19A is an exterior perspective view of exterior wall blocks.
Figure 19B:
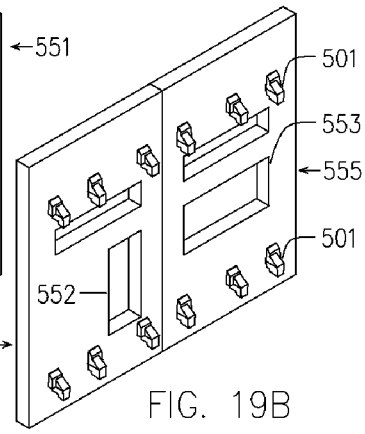
FIG. 19B is an interior perspective view of exterior wall blocks.

While it is true that this building system is capable of accommodating any standard perimeter wall construction, the perimeter of an enclosed structure in the preferred embodiment is built using prefabricated modular exterior wall blocks 551. FIG. 19A shows an exterior view of an example pair of single story wall blocks 555. FIG. 19B shows an interior view of the same pair of single story wall blocks 555 as shown in FIG. 19A. FIG. 19C shows an exterior view of a three story set of exterior wall blocks 551 of varying design that carry down to a spandrel block 510. Bracket supports 501 can transfer wall loads at each floor level, such that only the lower portion of the first floor exterior wall blocks 551 actually bear on spandrel block 510. Exterior wall blocks 551 of the system described herein allow the structure to remain fully demountable. Exterior walls may also be of standard storefront, masonry veneer, or other conventional wall framing and veneer systems, but these systems generally require demolition if a structure is to be moved or modified.

Figure 19D:
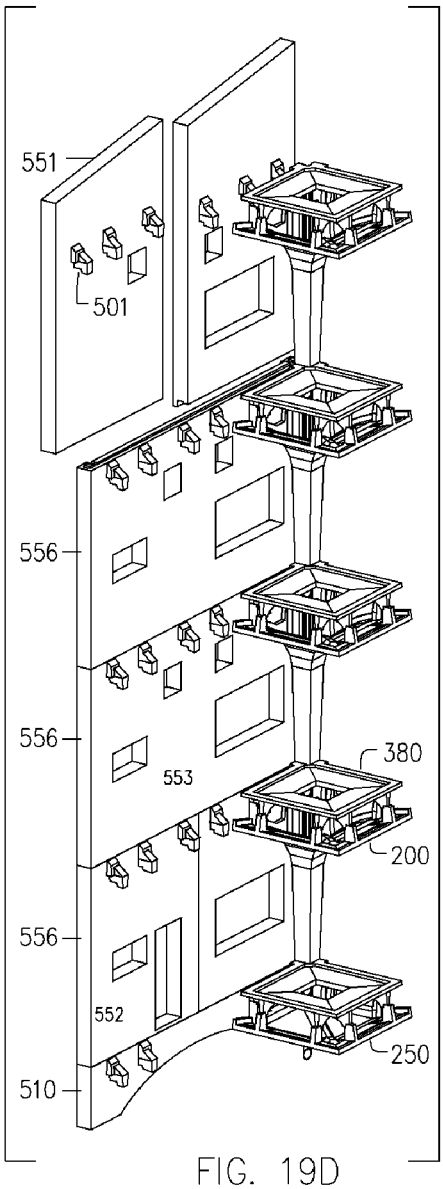
FIG. 19D is an interior perspective view of stacked exterior wall blocks and partial internal shell structure.
Figure 19C:
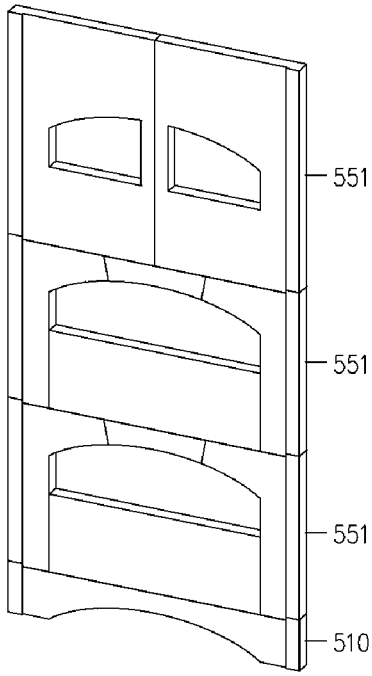
FIG. 19C is an exterior perspective view of stacked exterior wall blocks.

FIG. 19D is an interior view of selected portions of a four story (plus roof terrace) structure carrying exterior wall blocks 551. In order to demonstrate general connectivity between stackable wall blocks 556 and the structural shell 600, all shell elements except for one corner stack of base blocks 250, corner blocks 200, and corner pan blocks 380 have been omitted from the view shown in FIG. 19D. Wall blocks 550 are designed to interlock and transfer wind and gravity loads through bracket supports 501 that connect exterior wall blocks to corner blocks and key blocks of the base structure. A single-story exterior wall block 555 (FIG. 19B) features two levels of bracket supports 501 with the wall block cantilevering below the floor and above the roof terrace. A stackable wall block 556 utilizes bracket supports 501 for connections to the upper shell, and has a keyed interlock 505 with spandrel, edge frame, or wall blocks below. Gravity loads are generally transferred through bracket supports 501. Depending on an engineering analysis for an intended use, keyed interlock 505 connections may be configured to transfer gravity loads, or they may incorporate a compressible joint to isolate wall levels and lend only lateral load resistance. Lateral loads at the tops of exterior wall blocks 551 may be transferred into the shell structure 600 via the bearing of bracket supports 501 against tapered surfaces 232 of corner bock plinths 230 and key perimeter plinths 304.

Prefabricated exterior wall blocks may be of any construction that is structurally capable of being transported and lifted, provided that the necessary bracket supports 501 are incorporated. Wall blocks may be framed of wood or steel, or they may be of precast concrete or other construction. Exterior wall blocks incorporate door openings 552 and window openings 553, and provide a palette for an unlimited variety of architecturally designed profiles and finishes. Blocks may extend to at least guardrail height above roof terraces, but can also extend higher to concurrently create screen walls and a diverse palette of architectural elevations. By incorporating sufficient structural capacity in exterior wall blocks 551, they may also be designed and built to support cantilevered canopies and roof segments. By combining diversity in exterior wall architecture with geometric variety in the base structure module, a building of this construction can emulate the exterior architecture of any conventional construction.

Where conventional perimeter walls are desired, they can be supported by spandrel blocks 510 or edge frame blocks 520, or by girts of conventional construction that incorporate the necessary bracket supports 501 to interlock with the structural shell.

Interior Partitions

Although capable of accommodating interior partitions of any standard construction, the embodiment invites the development of prefabricated modular interior partition blocks that allow the structure to remain fully demountable and reconfigurable without demolition. Modular systems may define flat-ceiling spaces within the larger clear-span space, and alternatively may span from floor to segmental shell ceiling. They can further be designed to interlock and offer modular base connections to cap blocks 400 and floor infill blocks 470. Interior partition systems that are designed to incorporate mechanical, electrical, and plumbing chases, and to offer pre-wired and pre-plumbed options, will best take advantage of an enhanced the demountable capabilities that are designed into this building system.

DETAILED DESCRIPTION OF EMBODIMENT

Block Fabrication

Intended methodologies for the production of full-scale system prototypes are described herein, but fabrication techniques are expected to evolve with production experience. The methods described below provide a relatively quick, inexpensive, and accurate means of producing simple to complex three-dimensional (3D) structural objects; these methods invite a broad range of potential application.

The methodology for constructing each block in the above embodiment descriptions consists of the following basic steps: design the 3D object using 3D modeling software, segment the structure into blocks that are subsequently detailed to interlock or otherwise reconnect using 3D computer solids modeling, build a full-scale structured master of each block, cast interlocking segmental molds around each block master, then cast building blocks from each mold set. The original object should only be segmented to the extent desired or required for constructability or transportability. Once these methods are taken down to a level of building a 3D master and replicating mass produced parts from that master, it is clear that the described methodology can be utilized to produce most any 3D part at any scale.

Where it is determined to offer benefit, this method may be modified to produce stiffened plate masters of mold segments, produce multiple mold sets from those segments, then reinforce and cast blocks from each mold set. Many other techniques are also available and may be used to produce separable mold sets from the structured master. Possibilities include but are not limited to the construction of fiberglass or other composite molds, the casting of flexible mold forms liners that that are carried by an outer structure, and construction of mold sets from sheet metal, wood, or any other material. The methods described are the starting point of choice because of the low cost at which multiple cast mold sets may be produce from a single master, and because of the durability and structural capabilities available through reinforced concrete.

Design Master

Figure 33A:
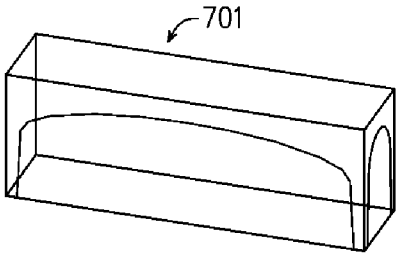
Figure 33B:
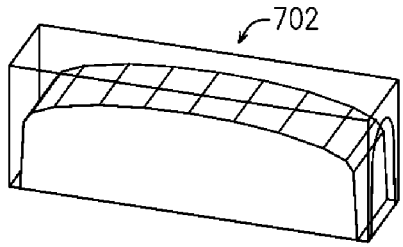
Figure 33C:
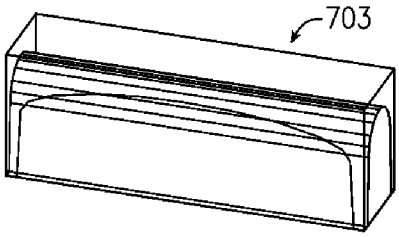
Figure 33D:
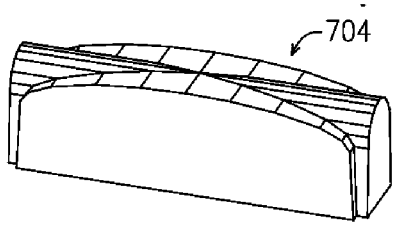
Figure 33E:
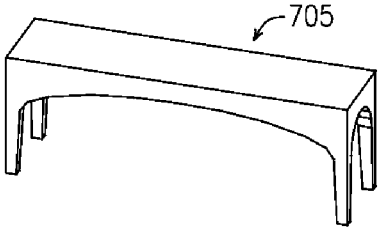
Figure 33F:
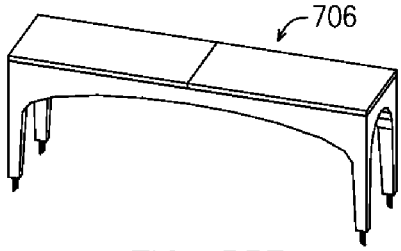
Figure 33G:
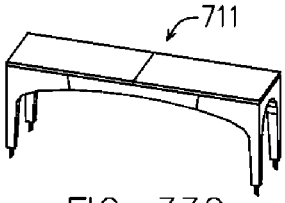
Figure 33H:
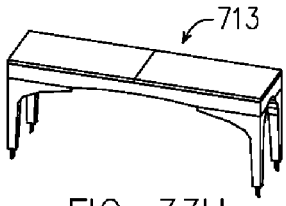
Figure 33I:
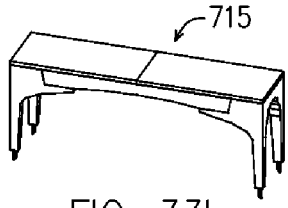
Figure 33J:
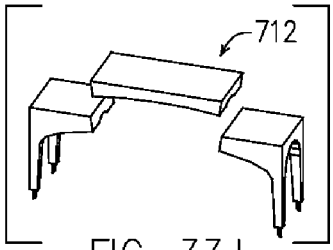
Figure 33K:
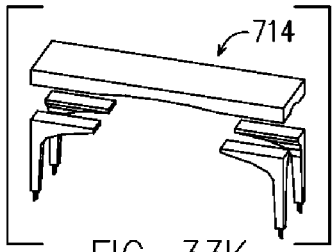
Figure 33L:
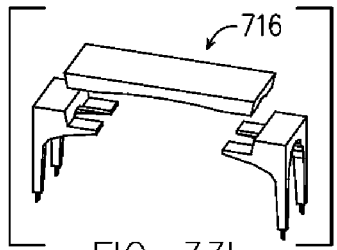

The 3D geometry and form of a module of structural shell of this system must first respond to structural and architectural demands (FIG. 33A). This embodiment presents a structural shell ceiling in the form of a groin vault; it could as easily present arched segmental struts and ties to form an interlocking groin vault framework without the shell, or could present a barrel vault or folded plate shell or framework. Geometries of a folded plate, shell, or 3D frame over a selected span can be modeled in three dimensions using a computer solids model (FIGS. 33B-33F), and may be set based on preliminary architectural engineering and constructability concerns. Basic steps in the construction of a computer solids model of a span 700 include constructing a span block model with profile lines 701 (FIG. 33A), extruding ceiling profiles in the short direction 702 (FIG. 33B) and the long direction 703 (FIG. 33C), to form a groin vault ceiling profile 704 (FIG. 33D), or whatever other ceiling profiles may be desired. The resulting structural module block schematic 705 (FIG. 33E) may then be segmented to allocate depth for a floor block schematic 706 (FIG. 33F). The structural span may then be segmented by a structural engineer on the basis of structural and transportation requirements to produce segmented block schematic options. Three example block schematic options 711, 713, and 715 (FIG. 33G-I) for segmenting the span of FIG. 33F are shown. Exploded views 712, 714, and 716 (FIGS. 33J-L) are also shown for each option, respectively. The strategy adopted in segmenting a representative span should focus on slicing the model into a minimum practical number of identical, repetitive blocks that each satisfy structural and transportation requirements. The selection of joint locations and angles may be made on the basis of structural and architectural factors.

Prior to cutting the computer 3D model into schematic building blocks, the structural engineer must first assess whether the most favorable structural action for a given structure will be achieved through closed, open, or cushioned joints between blocks. While closed concrete-to-concrete joints between blocks and structural modules may be suitable for a building founded directly on stable ground, it may be desirable to mortar joints between large-scale building blocks or to fit them with gaskets. Large-scale gaskets made of a suitable elastomeric material may cushion the joints between blocks to avoid stress concentrations and provide both erection tolerance and ductility. These features should lead to vibration resistance and superior performance under severe loadings such as earthquakes or foundation movements. If joint materials are to be installed, it becomes necessary to slice ½ the desired joint material thickness from the bearing faces of both blocks at each interface.

If the determination is made that the model needs to be segmented, structural connections (not shown in FIG. 33G-I) must then be designed to reconnect the segments, or blocks, that will make up the structure. To minimize the need for connections to be made in the field during the erection process also helps to minimize the time during which a crane must be on site. Blocks are therefore designed, where practical, to interlock. The design of interlocking connections is somewhat complex. Geometries of plinths and eyes, or other interlocking parts, must be proportioned in response to anticipated structural actions (FIGS. 34E-34H). Modeled joints must also present formed surfaces that are strippable; this is dependent on the mold system, mold separation lines, and mold stripping methodologies that will be used. With cast molds, a draft should be provided on surfaces that would otherwise be parallel to the extraction line, such that the part tapers away from the mold as it is extracted and fattens at its base.

If the anticipated loading on a structure makes it necessary for the structural engineer to develop tension across a joint between structural blocks, then bolted connections can be incorporated into the design by enlarging plinths and eyes as required to accommodate aligned sleeves (FIG. 34H). Those sleeves can receive a threaded steel rod or other connector that passes through and ties pairs of plinths together.

In finalizing the design of a building block, it should be confirmed that all of the necessary tapered surfaces have been provided to ensure that mold sets can be stripped from a newly produced block. The 3D computer model can then serve as the platform from which all construction geometry is extracted. Geometries and reinforcement of a given set of blocks may be finalized on the basis of refined structural analyses in combination with full-scale load testing.

Geometry Extraction

Figure 20:
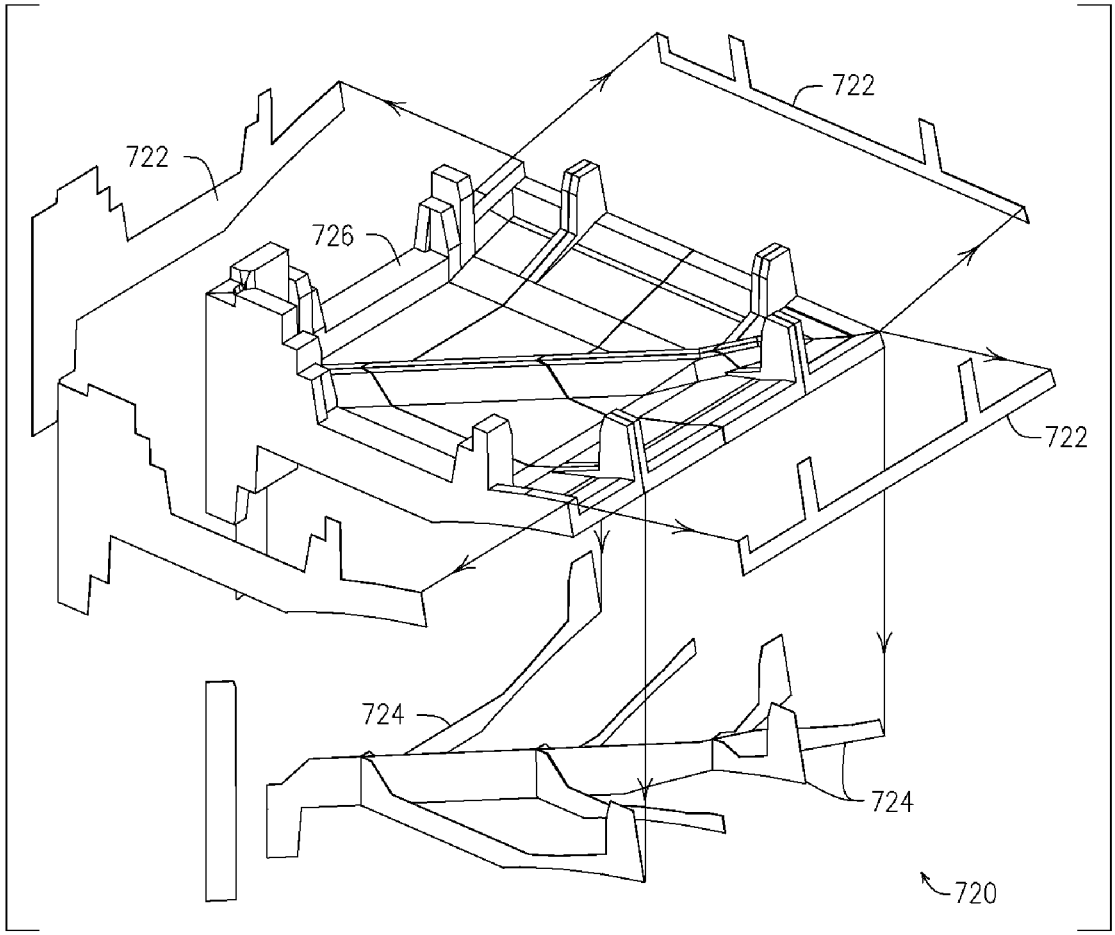
FIG. 20 is perspective exploded view depicting geometric extractions of a corner block.

Given a computer solids model 720 of a block, either 3D geometry of the object or 2D geometries of components of the object may be translated directly to a computer controlled cutter. A number of methods may be utilized to produce a 3D master, including computer controlled 3D foam cutters, but the method described herein is intended to produce an internally stiffened structural master. Referring now to FIG. 20, using the actual thickness of plate (¾" plywood, ⅛" steel plate, etc.) from which the master is to be produced, the computer solids model 720 of a block may be "skinned" or sliced and separated from the original model one surface at a time, producing a set of skinned surfaces 722. It is important to consider how each plate terminates in relation to other plates at each corner, and to track the relative position of plates at each corner, in order to assemble a master of the correct dimensions after the plates have been produced. As each surface is skinned, a computer CAD file can be written to precisely define the geometry of the plate that will form the same surface on the master using the 2D geometry of the extracted plate. Once the model has been fully skinned, the solid shape that remains represents the remaining internal void 726 that is contained within the plate-faced master. That remaining internal void 726 of the computer solid can then be cut into slices at each location where internal stiffeners 724 may be needed to enforce the internal geometry and provide the necessary stiffening of each face of the master. Each of those slices is then used to write a 2D geometry computer CAD file. Extracting the necessary geometry to build a 3D object may thus be accomplished by judiciously slicing skinned surfaces 722 and internal stiffeners 724 from the computer solids model.

Build Master

Once the geometry of a prototype set of master blocks has been finalized, masters of each block may be produced. The method described herein offers an opportunity to fabricate simple to complex 3D object while virtually eliminating the need for manual measurement and layout during fabrication. Concurrently eliminated are the time expenditures and potential for errors that might otherwise accompany the layout of 3D shapes. By cutting any 3D object into the appropriate sections, via standard CAD (computer-aided design) solids modeling software tools, it is possible to extract precise two-dimensional geometry of any internal stiffener or planar face of the object. The extracted 2D geometry is fed directly to a computer-controlled cutting device to produce a piece of the correct geometry, and ultimately a complete set of pieces, as necessary to produce a full-scale master.

Plate Set Production

The computer plate cutting files that are derived through the geometry extraction method as described above are fed directly into readily available computer-controlled cutters that may utilize laser, plasma, water jet, mechanical, or other cutting means and that offer the required precision, as appropriate to the selected construction material. Plates may then be joined using conventional techniques for the selected construction material to accurately build a master of each block.

Variability

Where it is practical to do so, the master itself may be built of interchangeable segments that allow the geometry of the master to be manipulated. For example, variations may be produced in the length and height of footing blocks 101, in the height and width of corner blocks 200 and wall blocks 550, in the width of key blocks 300 and center blocks 350, and in the width and standoff height of the access floor/terrace system 360 (pan blocks 370, cap blocks 400 and floor infill blocks 470). There may be cases in which it is desirable to produce a separate master for each modified block; otherwise separable masters with interchangeable parts may be used to more economically produce a variety of mold sets for a wide range of geometries from a minimized set of structured masters. If a block requires thickened shell faces or deepened stiffeners for a given application, those volumes can be added as a mechanically or magnetically attached lamination to the steel master. The laminated volume may be structurally required, or it may be an architectural texture or feature. Mold sets produced from a master with such built-up sections (by adhered laminations) will, in turn, produce blocks with those same thickened sections. By taking advantage of this capability, a single steel master may serve as the originator of a variety of structural and architectural profiles.

Orientation

As a necessary step in the construction of a master, careful consideration should be given to the orientation of the structured master within the mold set during the casting of each segment of the mold. Where practical, castings are generally oriented such that the faces most exposed to view (critical faces) are cast downward (where air bubbles are least likely to be entrapped), and such that no conditions are created that would result in pockets of air becoming entrapped in the mold set. Horizontal molding surfaces should be avoided because of the difficulty in evacuating air at such surfaces. Where horizontal surfaces would otherwise be presented, the master may generally be rotated within the mold form. Ventilation ports should be installed to ensure that all air pockets can consistently be eliminated at critical surfaces.

In building a mold set from a master, it is generally desirable to invert the casting orientation of the master such that the critical molding faces are cast downward for best finish quality; the mold set should be ultimately inverted again prior to block production, so that the downward-cast (best quality) faces of the block are cast against what were downward-cast faces of the mold set. For some blocks, this inversion process may not be practical; the actual orientation of both master and production mold set are dependent on the geometry of the block to be produced.

Supports

On the basis of the selected casting orientation of the master and the desired segmenting of the mold set, locations can be selected at which wires, light cables, or other restraints may be attached to the master as support points for handling;

these points may also be used to suspend and laterally support the master within mold forms. The master may be suspended via these hanger wires below and between elements of a demountable master support frame. The support frame may be proportioned to offer an array of potential cable tie locations and to enable the access required for construction of segmental production mold sets. The master may also be tied down via wires, light cables, or other restraints to the base of the master support frame as necessary to resist the buoyant forces that might otherwise make the master tend to float up during casting.

Build Segmental Mold Sets

Blocks of the embodiment may be cast in production mold sets that were themselves cast around a structured master. Production molds may be segmented and designed to interlock, but to do so it is necessary to select the lines along which the molds both separate and interlock. Although molds may be produced from any castable structural grade material (or from stiffened plate construction similar to that of the master), segments are ideally heavy enough for the assembled mold set to remain connectorless during the injection molding process. If a mold set does not need to be bolted together prior to injection or unbolted prior to harvesting the block, then production may proceed more quickly and economically. Production mold sets for the example embodiments are constructed of reinforced concrete.

Debonding

Prior to setting reinforcement, keyed dividers, ports, and mold exterior forms around the suspended master, either a form release agent or form liners should be applied to the appropriate surfaces of the structured master. Methods of affixing form liners to faces of a structured master may include but not be limited to using magnetic sheet form liners, using integral clamp plates that may be built into the master and pinch the edges of the form liner, and building a master using perforated plates and internal vacuum pressure to hold the form liner in position. Reversal of such a vacuum to create positive internal pressure could facilitate stripping of the cast mold segments by causing them to shed from the face of the model. Once the block master has been positioned and debonding has been assured, the reinforcement, keyed separators, vents, sleeves, and outer forms required to build segmental molds may be installed around the master.

Mold Segment Outer Forms

After determining the separation lines and resulting form segments, the outer geometry of each mold segment may be set to ensure hardiness of the mold set and to balance the mass of each segment about vertical lift points. Mold set configuration and interlock must accommodate assembly and stripping with handling equipment that may consist of an overhead crane or hoist. Outer geometry of the production mold set is less critical than that of the blocks to be produced, and outer form construction can therefore be accomplished with more flexible construction tolerances, so long as mating surfaces between mold sets are keyed for consistent interlock.

The primary objective in configuring outer forms may be to rough form around the master, to control the weight of the mold segments, and to leave a stiffened and durable mold set. Mold sets should also be concurrently configured to be independently stable. Where practical, mold sets may take a form that is stackable or nestable for ease of storage and transportation. They may also be segmented as required to be of transportable dimension and weight. Small mold sets may be configured as segmental solid blocks, minus areas thinned by external voids for port access or where practical for weight reduction. Larger mold sets may take the form of a large block that is lightened by variable-depth void forms that reach in toward the master molding surfaces, but leave the stiffening ribs necessary for hardiness of the mold set. They may also take a form that more closely profiles the master, but adds whatever stiffeners or buttresses are required to ensure that the assembled mold set remains stable. Void forms that reach in from the outer box form toward the master can feature extractable tapered surfaces and are ideally of durable construction for repetitive use, as it is desirable to build multiple production molds are made from a single form set.

Outer forms can also offer a means of connection to secure the edges of joint forms that build the interlocking joints between mold segments. The uppermost mold segment (mold cap segment) of each set may generally be configured with support extensions and additional lifting loops to allow the segment to be flipped. This can put at ground level what would otherwise be overhead work of surface preparation and reinforcing steel cage connection to the mold. Inverted mold cap segments can serve as a base support and template for the final positioning and connection of reinforcing steel cages. Corner blocks 200 and base blocks 250 can present a special case of exterior mold construction, because these molds are configured to receive the base pipe extension 211 which is integrated into the reinforcing steel cage for each of these blocks.

Reinforcement and Joint Dividers

Once the outer geometry and joint lines have been established for a mold segment, the necessary steel or other internal reinforcement is distributed as required for competence of the mold segment under handling and lifting. Each mold segment also incorporates cable loops or other lifting devices that can be cast into the segment. Inserts can be tied to integral reinforcing steel for and located for balanced vertical lifting and assembly of the mold set. Interlock of separable segments can be accomplished by constructing a match-cast keyed joint. Several concepts will be evaluated. One uses flexible perforated membrane dividers that are secured by an integral clamp plate at the master and between mating edges of corrugated metal at the outer edge of the joint. Another uses perforated and keyed sheet metal joint dividers that are secured (magnetically or with screws) at the master and at the outer forms. Perforations in joint dividers allow air to escape as the injected concrete fills the forms completely on one side of the divider. After the mold segment on one side of a joint divider has been cast, the divider form may be removed to allow for debonding of and match-casting against the newly cast surface. Such a match-casting technique should offer perfect fit between segments of the mold set.

Vents and Ports

Prior to casting mold segments, vent tubes can be installed between the master and the outer form. After being cast into the mold segment, these tubes form ventilation ports whose function is to allow the complete evacuation of air from the mold set as concrete is being placed into the mold. Vent tubes are thus located as required to enable the release of air at the uppermost corner of every top surface of the segment mold during the injection of the concrete mix. Tubes may be fitted onto nubs that can be built onto the surfaces of the master and the outer form; these nubs can both enforce the position of the tubes and seal tube ends against concrete paste infiltration while the molds are being cast. Mold segments may also be configured with chases above the top of the block to receive cable loops, lift inserts, or other lifting devices that may be cast into each block for lifting and handling. Finally, one or more injection ports may be incorporated into mold base forms at or near the lowest point of the cast block, or injection ports may consist of hatches in the top of a mold set that accommodate the placement of pumped, tremied, or gravity-fed concrete. Additional ports may be incorporated to accommodate inserted vibrators during block casting, unless vibrating molds are utilized. Injection ports can be designed to facilitate cut-off of the injected concrete, and all vents and ports can be configured for easy access to facilitate clean-out of the port immediately after casting. An envisioned method of cleaning ventilation ports, injection ports, and vibration ports is to build them using consistent lengths and diameters that coincide with the length and diameter of auger bits that can be used with a hand drill (or other suitable method) to auger overflow concrete from each port.

All hanger and lateral brace wires can be sheathed within split flexible tubing prior to casting concrete; this should prevent the concrete from bonding with them and create ports for future use in the mold set; these ports can subsequently be used to secure reinforcing steel cages to the underside of mold cap segments during block production.

Mold Production

Once all of the integral elements in the mold set have been installed, the exterior mold forms can be treated with a debonding agent and set in place. Exterior mold forms need to accommodate the cables that suspend the master within the support frame, and generally separate along these lines. Lower portions of outer forms are subjected to substantial hydraulic pressure during concrete placement, and must be sturdy and tight.

With exterior mold forms in place, concrete can be injected into the mold from the base of the form or placed from the top. Methods such as pumping concrete from the base are expected to entrap the least air into the mix and therefore produce higher quality surfaces than could be obtained by dumping concrete in from the top of the mold set. If the lower portions of a mold set are injection-molded from the base of the section to the divider; then perforations in the divider should allow entrapped air to escape the underside of the divider. After initial curing of the first segment, the perforated divider can be removed, the cast surface deburred, and a bond-breaker applied to the mating match-cast surfaces. The subsequent segment of the mold set can then be match-cast against the lower segment or segments for perfect fit. In another embodiment of the segmental mold set, the joint dividers can be become integral to the mold set such that both sides of the joint may be cast in a single cycle without sacrificing a match-cast fit.

Consolidation

Aside from fit-up of the mold segments, the quality of the concrete or other material at faces which are cast against the master is most critical; it is these faces that may eventually mold the cast faces of the produced block. Consolidation of the freshly placed concrete helps to eliminate air bubbles and pockets at the concrete surface, and can be a key component to attaining a quality concrete finish. It is standard construction practice to vibrate concrete during placement to eliminate entrapped air, although some self-consolidating concrete designs are intended to eliminate the need to vibrate. Self-consolidating concrete is one good candidate for a construction material for these blocks; the need for vibration will be dependent of the specific properties of the material that is being cast. If the master is suspended within the concrete mix, one very effective method of vibrating the concrete at the face of the master may be to vibrate the master itself. A master block can accordingly be fitted with an on-board vibrator that may be mounted inside the master and can be controlled from the casting floor.

Mold Set Harvest

Upon completion of the casting and initial curing of mold segments, the segments can be stripped from the face of the master in preparation for the reassembly of the newly created mold set. The master support frame can be demountable to facilitate the disassembly and removal of the produced mold set. After disassembly, mold set segments can be patched if required and rubbed, troweled, or sculpted as desired. Mold set segments can then be sealed and treated with debonding agent in anticipation of block production. The master and outer molds can concurrently be cleaned and prepared for the subsequent production of additional mold sets.

Block Production

With mold sets produced, block production can be a straightforward process. Internal reinforcement can be tied into a cage that includes lifting loops or inserts, the mold set can then be assembled to include the cage, and molds can then be filled with concrete or other castable structural grade material. The produced segment may then be cured, stripped, finished, and shipped to the jobsite. On a large or remote project, block production could be moved to the jobsite. This move would ideally follow the erection of sufficient shelter, using this system, to house the operation.

Block Reinforcement

This system enables the very efficient use of reinforcing steel; in light-duty blocks rebar may be reduced or replaced by fiber reinforcement that is integral to the mix, or plain concrete may be used and reinforcement limited to high stress locations only. Produced mold sets can be configured to accommodate and hold in position the rebar that will reinforce the block to be produced. Reinforcing steel, consisting of the necessary straight and bent bars, can be tied into prefabricated standard cages for each block type. Reinforcement positioning jigs can be built using geometries extracted from the computer solids model to enable the rapid and consistent tying of reinforcement cages. After ensuring that all mold surfaces have received debonding agent, the 3D cage can be wire-tied through sleeves to the top of an inverted mold cap segment; it can be chaired off of the mold cap segment to ensure proper positioning and to avoid the need for any chairs to extend to the visible (downward cast) face of the produced block. Wires which may tie the cage to the underside of the mold cap can be locked off after rebar chairs have been snugged to the underside of the mold cap, such that mold cap and reinforcing steel cage can subsequently be handled as a single unit. Ends of cable lifting and handling loops can then be tied to the cage, and loops can be tucked into chases in the underside of the mold cap segment with fillers that prevent concrete from entering the chase.

Mold Set Assembly

Separately, the mold base can be prepared to receive the remainder of the interlocking mold set. In simple elements such as pan blocks, the mold may consist of just a base and cap segment. In more complex shapes such as corner blocks, the mold base may combine with one or more interlocking side segments to receive the mold cap and reinforcing cage. As each mold segment is set in position, any modular or customized conduit, junction boxes, sleeves, or other cast-in elements can be installed. Finally, the cap and cage can be turned upright and assembled onto the remainder of interlocking mold set.

Block Production

Once the preparation and assembly of the mold set has been completed, concrete can be injected into the mold set by pumping through the port or ports that are provided in the base of the mold set, or by tremie, line pump, or gravity feed from above. Concrete can be pumped until cement paste has entered all vents. Once the air has been evacuated to the level of a vent which is lower than the uppermost part of the block, the vent can be temporarily plugged if necessary to prevent paste from pumping out of the vent. Concrete may be consolidated during placement using vibrators that may be inserted through strategically placed ports in the mold set, by vibrating the mold set itself during casting, or by utilizing a self-compacting concrete mix that does not require vibration. After the block has been cast, it is important to immediately clean all cement paste that has entered vents, to prevent them becoming clogged with hardened concrete. This may be accomplished using a fixed-depth auger or another method.

Block Harvest

Once the concrete has cured sufficiently, the cage hanger wires may be untied or cut, and the mold cap and non-supporting side segments may be stripped from the produced block. When the mold cap is lifted off of the block, the cable loops and filler (if used) are stripped out of the mold cap segment, presenting lifting loops or other devices for handling the newly produced block. Once it has gained sufficient strength, the block may be lifted off of the mold base, sharp edges at corners and mold joints can be deburred using a carborundum stone or other means, and blocks can be cured using standard methods that may include water spray, steam, submersion, wet blanket or commercially available curing compounds. At this time, any optional rub or stain, or other applied surface treatments may be applied.

Handling and Shipping

Once production is complete, blocks may be shipped, stockpiled, or assembled into stock modules of usable temporary shelter and/or sales demonstration models. Corner and base blocks can be temporarily supported on interlocking footing blocks, or they can be laid on their sides for stockpiling and shipping. Blocks that are to be transported from the manufacturing site can then be arranged on flatbed trailers or rail cars for shipping, and racks or stacking systems may be utilized where desirable for the transportation of smaller blocks Sculpted Blocks Some additional steps are required to obtain a hand-sculpted block, and two production methods are currently envisioned. One method is to build a master that is oversized as required for a thickness at exposed faces that is increased by the non-structural depth to be sculpted. From that oversized master, an intermediate mold set can be produced, and from that mold set, a new master can be produced of a material that can be sculpted (sculptable material), such as low-strength, lightweight sand-cement concrete. That oversized sculptable master can then be hand-sculpted or machine-cut as desired, sealed, and treated with bond-breaker. Production mold sets may then be cast around the sculpted master following the same process as described above for mold set production.

An alternate method of accomplishing the same end involves building the exposed faces of the master (the faces which are to be textured) using a bonded sculptable material. Exposed faces of a master, otherwise produced as described above, may be built with an internal support structure wrapped in expanded metal or another sheathing upon which plaster, wax, or another sculptable material may be laminated to the desired thickness. The master may then be used to form production molds after these built-up faces have been sculpted, hardened and sealed. This method can result in a hand-sculpted master without the intermediate steps required by the first method. A sculpted master of this construction may, however, be less durable than one produced by the first method; it is likely that only "limited edition" mold sets will therefore be produced from these masters.

The sculptor is afforded a good deal of latitude in what can be done. It is necessary to limit cuts as necessary to avoid detrimental effects on structural performance, and to avoid creating surfaces that are perpendicular to or negative to the mold stripping direction for a given surface. Geometric and freehand patterns can be easily accomplished. One can envision that a simple pattern of chisel marks sculpted into the exposed faces would cause the produced block to appear to be hewn from a single stone, and that a professional sculptor could produce an unlimited variety of forms for the cast surfaces of any building block.

DETAILED DESCRIPTION OF EMBODIMENT

Assembly

This section is predictably short, as this system is designed for ease of assembly. The idea is to enable large scale construction with an ease that approaches that of building with a child's set of building blocks. Subject to structural confirmation that a block of a given wall thickness and reinforcement is suitable for the intended application within the structure, blocks may be used to build virtually any structure. They may be stacked, and they may be rearranged.

Although this system is designed to be able to be dry-stacked, blocks may also be fitted with compressible gaskets to cushion and distribute forces at bearing surfaces between blocks. If permanent installation is desired, blocks may be may be configured to receive mortar beds for bonded installation; they may be grouted or epoxied together for increased capacity under extreme loads. As previously noted, blocks may also be fitted with shear pin sleeves 108 that align to enable tied and bolted connections between blocks, where required structurally.

Foundations

Figure 21A:
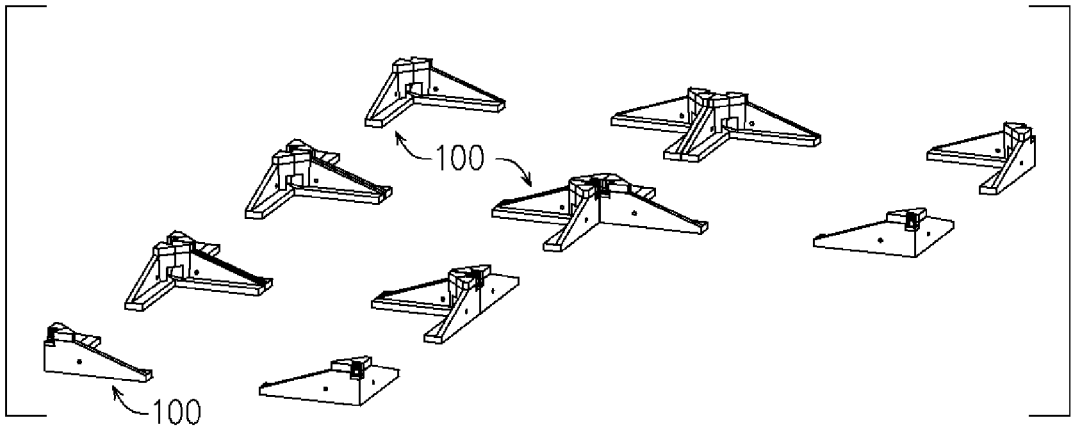
FIG. 21A is perspective view of multiple footing blocks set.

On the basis of a geotechnical engineering analysis of the site, the appropriate foundation system is selected. Piers 90 may be drilled to the required depth, cast, and fitted with pier cap blocks 94, or footing blocks 100 may be used, as depicted in FIG. 21A. In a footing-supported structure, two-way trenches can be cut, compacted, and leveled to the required bearing elevation with flowable grout prior to setting footing blocks and backfilling. It is important that footings are laid out with both horizontal and vertical accuracy, and that joint spacers of the specified design thickness are installed between back-to-back footing blocks 100. Where geotechnical analysis indicates a potential for differential movement, shear pins 109 can be designed and installed to link the movements of adjacent footing blocks 100.

Base Structure

Figure 21B:
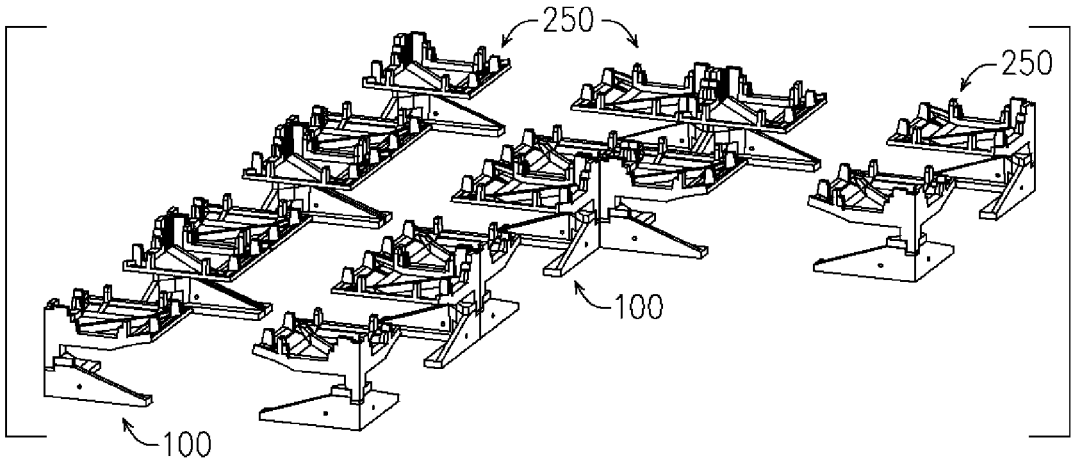
FIG. 21B is perspective view of the embodiment of FIG. 21A with base blocks set.
Figure 22A:
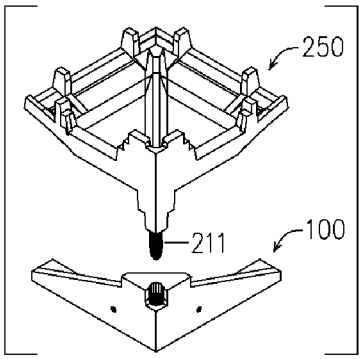
FIG. 22A is a perspective view of a base block suspended above a footing block.
Figure 22B:
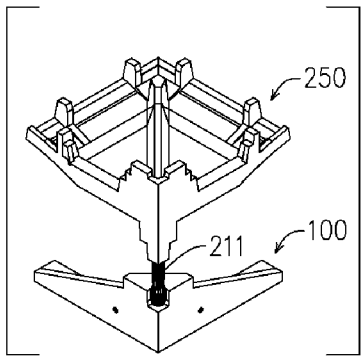
FIG. 22B is a perspective view of base block being lowered to stab pipe spine into footing block support.
Figure 22C:
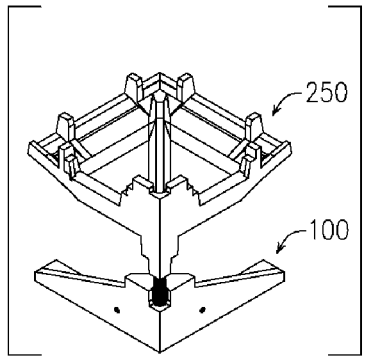
FIG. 22C is a perspective view of base block being lowered further to engage with footing block supports.
Figure 22E:
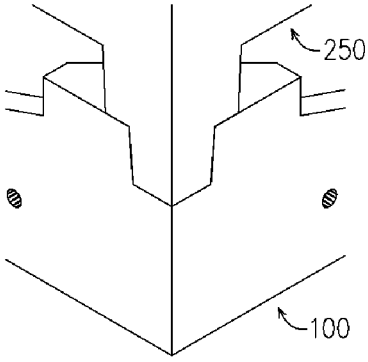
FIG. 22E is a perspective detail of FIG. 22D showing the mating joint between the base block and the footing block.
Figure 22D:
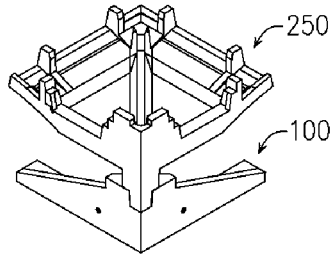
FIG. 22D is a perspective view of a base block supported by a footing block.

Referring now to FIG. 21B, with receiving foundations in place, base blocks 250 may be set. The tapered point of the base block's base pipe extension 211 can be guided into the receiving sleeve in the foundation element (FIGS. 22A-22E), and interlocking concrete base keys 206 can be aligned as the base block 250 is lowered to bear on its foundation. As described previously, limited vertical adjustment can be achieved by jacking and shimming between the footing block 100 and the base block 250. Accuracy of layout between adjacent base blocks, particularly critical on the first module set, may be obtained and enforced by temporarily installing a spandrel block 510.

Figure 23B:
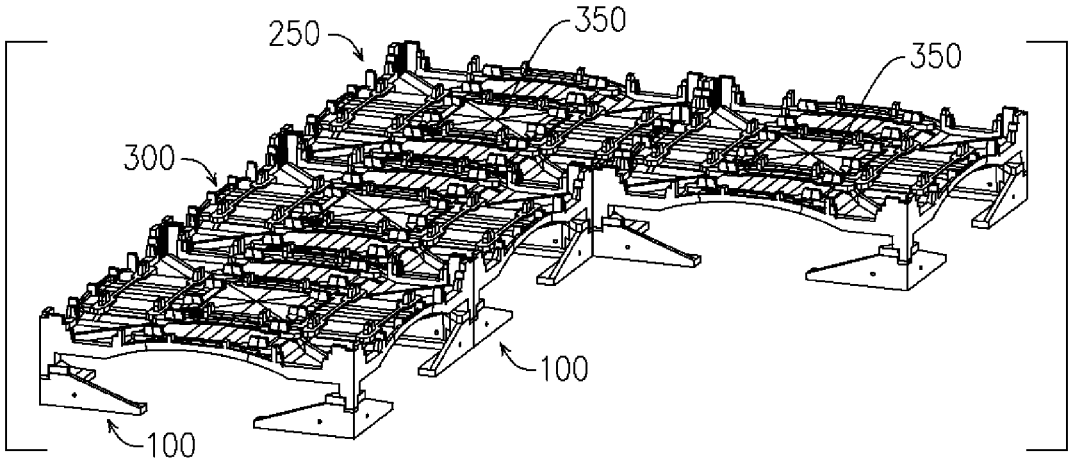
FIG. 23B is perspective view of the embodiment of FIG. 23A with center blocks set.
Figure 24A:
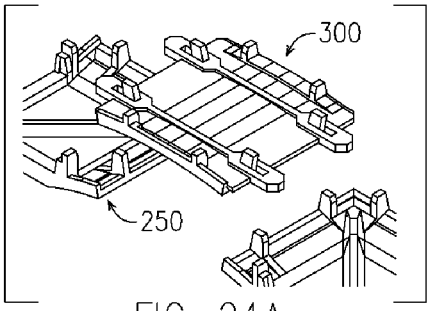
FIG. 24A is a perspective view of a key block suspended above two base blocks.
Figure 24B:
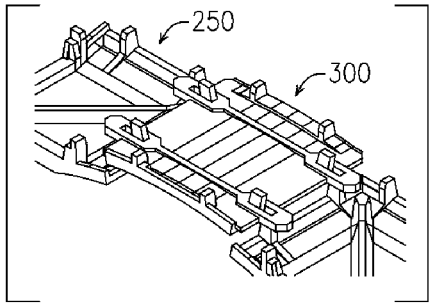
FIG. 24B is a perspective view of key block being lowered to engage base block plinths.
Figure 24E:
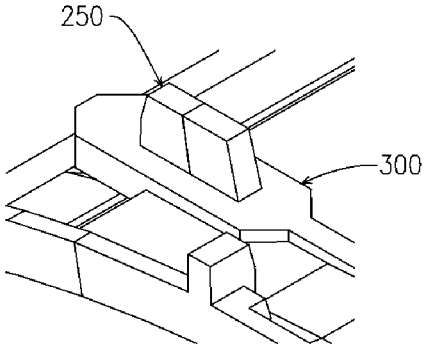
FIG. 24E is a perspective detail of FIG. 24D showing the mating joint between the key block and the base block.
Figure 24C:
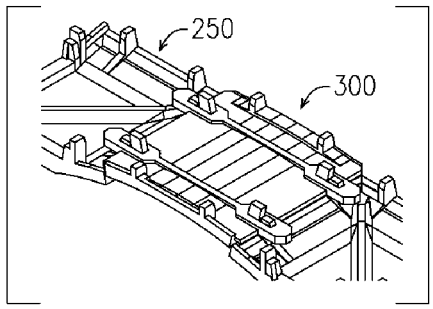
FIG. 24C is a perspective view of key block being lowered further to engage base block plinths.
Figure 24D:
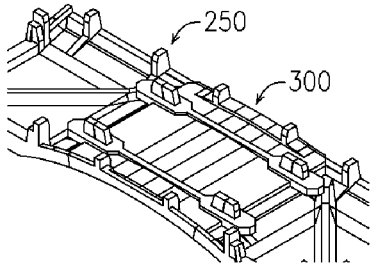
FIG. 24D is a perspective view of a key block supported by two base blocks.

Once its two supporting base blocks 250 have been set, a key block 300 may be set to interlock (FIG. 23A). Referring now to FIGS. 24A-24E, the eye 320 of the key block 300 can be lowered over the mating plinth on the base block 250 for self-positioning and interlock. With four base blocks 250 and four key blocks 300 of a structural module in place, the center block 350 can be set in its nested position (FIG. 23B). Additional modules, either immediately adjacent or spaced, can be constructed in the same manner. Adjacent modules should be laid out using joint spacers of specified design thickness installed between back-to-back base blocks 250. Where structural analysis indicates the need, shear pins 109 (not shown) can be installed to link the movements of adjacent base blocks 250.

First Level Floor

Figure 25A:
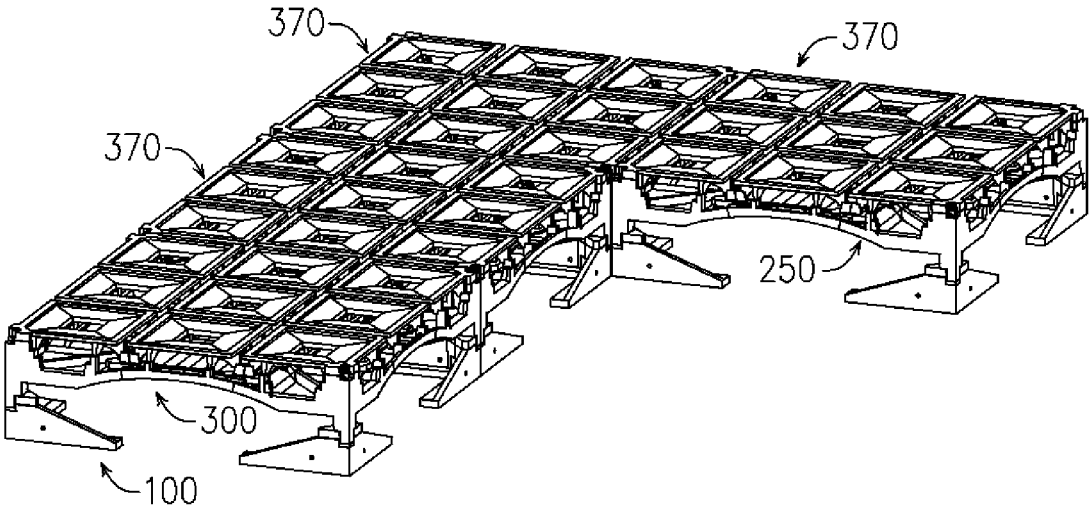
FIG. 25A is perspective view of the embodiment of FIG. 23B with pan blocks set.
Figure 25B:
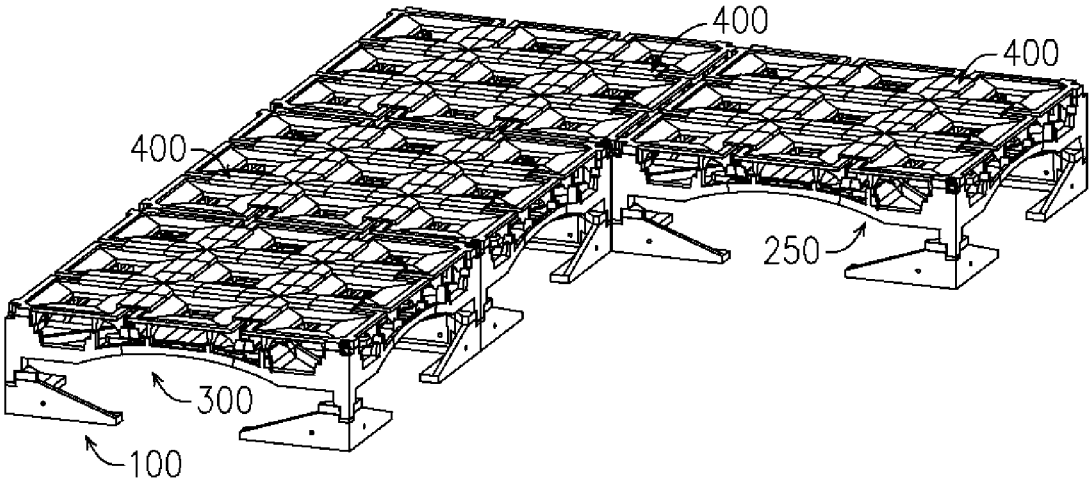
FIG. 25B is perspective view of the embodiment of FIG. 25A with cap blocks set.
Figure 26A:
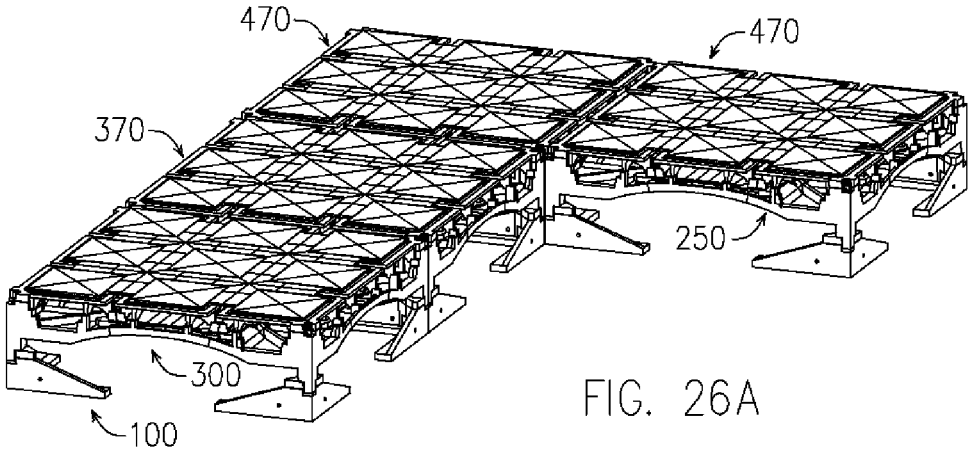
FIG. 26A is perspective view of the embodiment of FIG. 25B with infill blocks set.

Referring now to FIG. 25A, with the base structural shell now completed, floor pan blocks 370 may be set in place, followed by floor cap blocks 400. FIG. 25B and subsequent figures in this sequence show cap blocks 400 at only the interior of each structural module; perimeter cap blocks and interior cap blocks at joints between structural modules are omitted from these views to more clearly show edges of and separations between floor pan blocks 370. FIG. 26A shows the same level of structure after the installation of floor infill blocks 470. The installation of each of the blocks described above consists of rigging (not shown) and lifting the block, setting it into position, and releasing the hoisting lines. In lieu of pan blocks 370, cap blocks 400, and floor infill blocks 470, floor plank blocks 460 (not shown) could be installed to complete the first level of structural shell. If needed, elements such as insulating blankets, utilities, structural shell joint fillers, and shear pins may be installed where deemed necessary prior to building the level of structure above. These items may be installed either before or after floor blocks have been installed.

Upper Levels of Structure

Figure 26B:
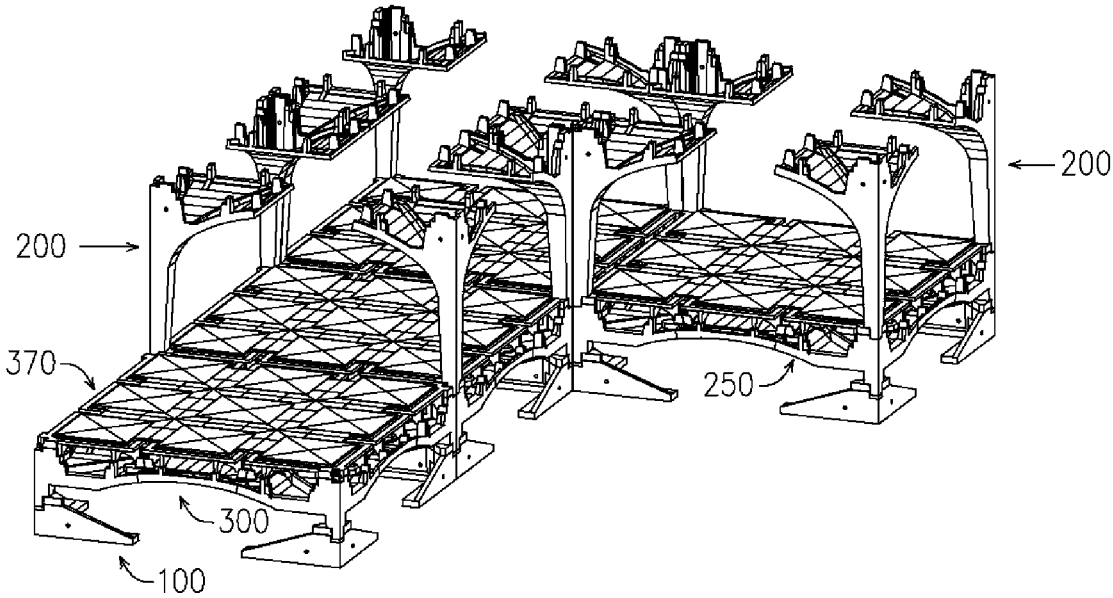
FIG. 26B is perspective view of the embodiment of FIG. 26A with level 2 corner blocks set.
Figure 27A:
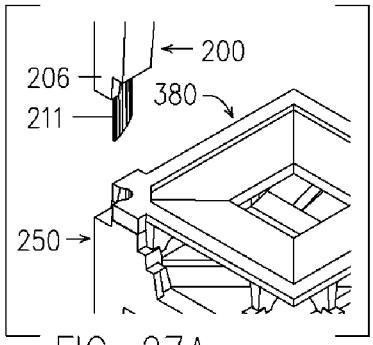
FIG. 27A is a perspective view of a corner block suspended above a base block and pan block.
Figure 27B:
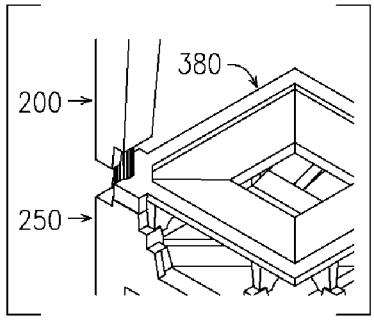
FIG. 27B is a perspective view of corner block being lowered to stab its pipe spine into the base block and pan block support.
Figure 27E:
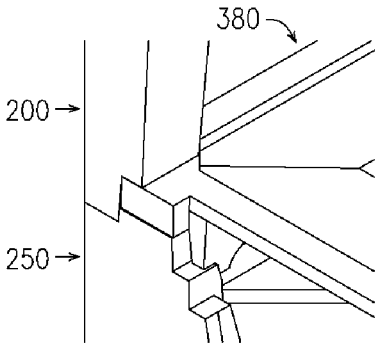
FIG. 27E is a perspective detail of FIG. 27D showing the mating joint between the level 2 corner block and the base block and pan block.
Figure 27C:
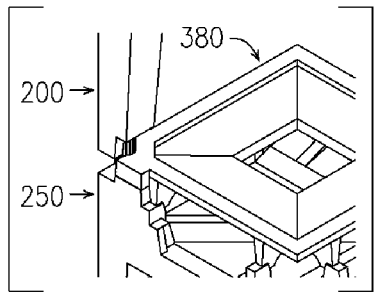
FIG. 27C is a perspective view of corner block being lowered further to engage with base block and pan block support.
Figure 27D:
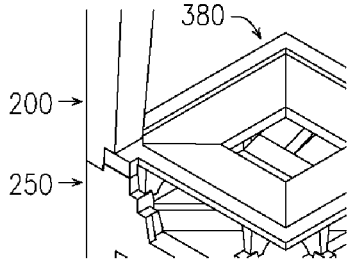
FIG. 27D is a perspective view of a corner block supported by a base block and pan block.
Figure 28A:
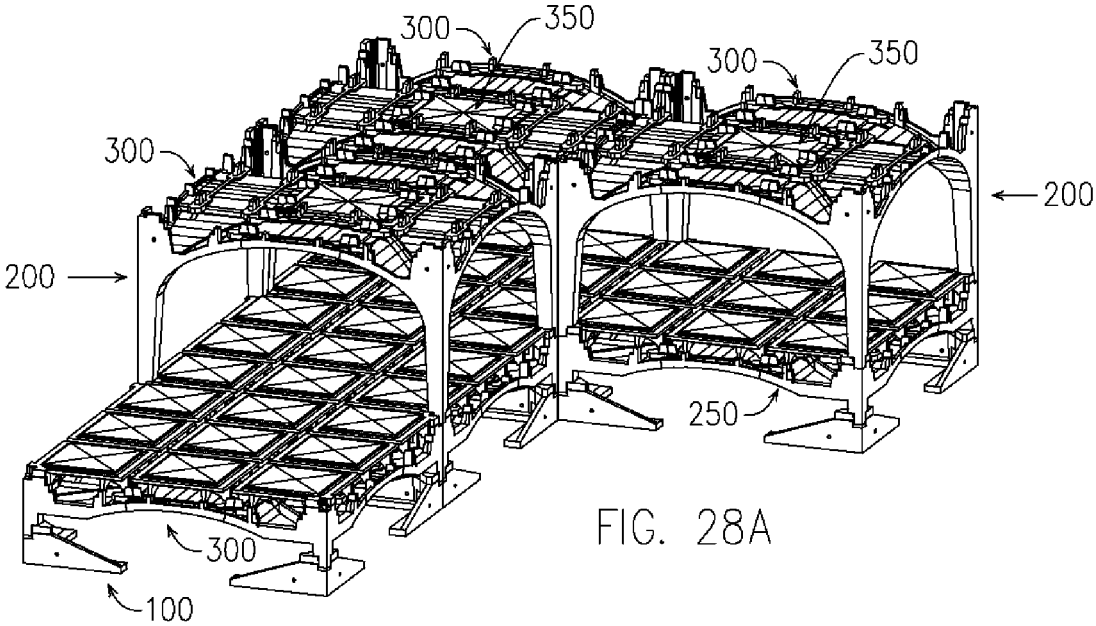
FIG. 28A is perspective view of the embodiment of FIG. 26B with level 2 structural shell completed.
Figure 28B:
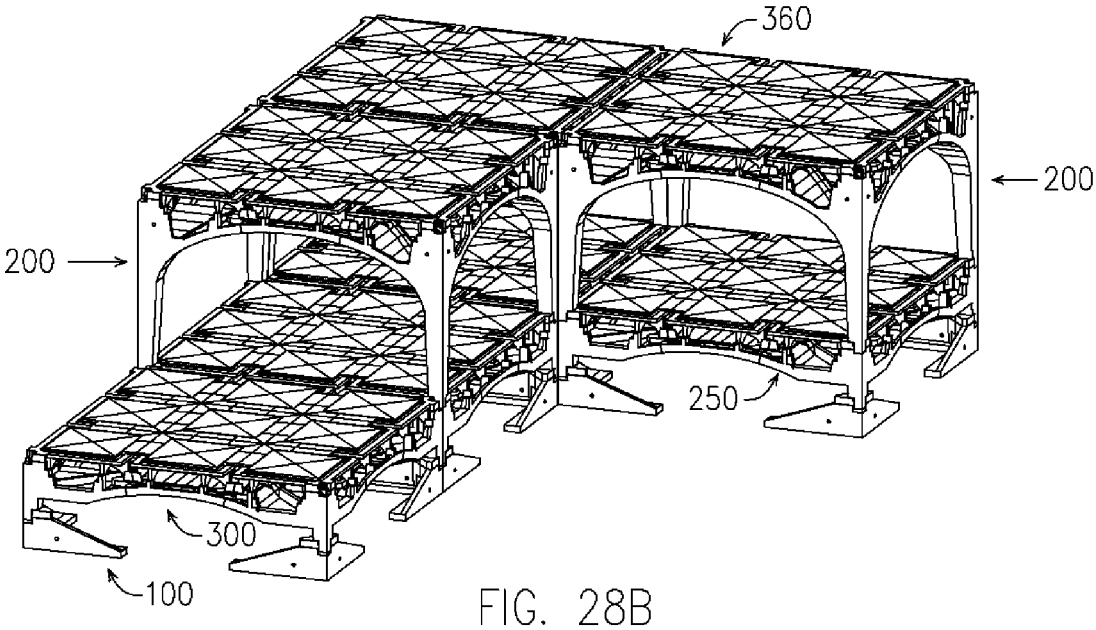
FIG. 28B is perspective view of the embodiment of FIG. 28A with level 2 access floor/terrace system installed.
Figure 29A:
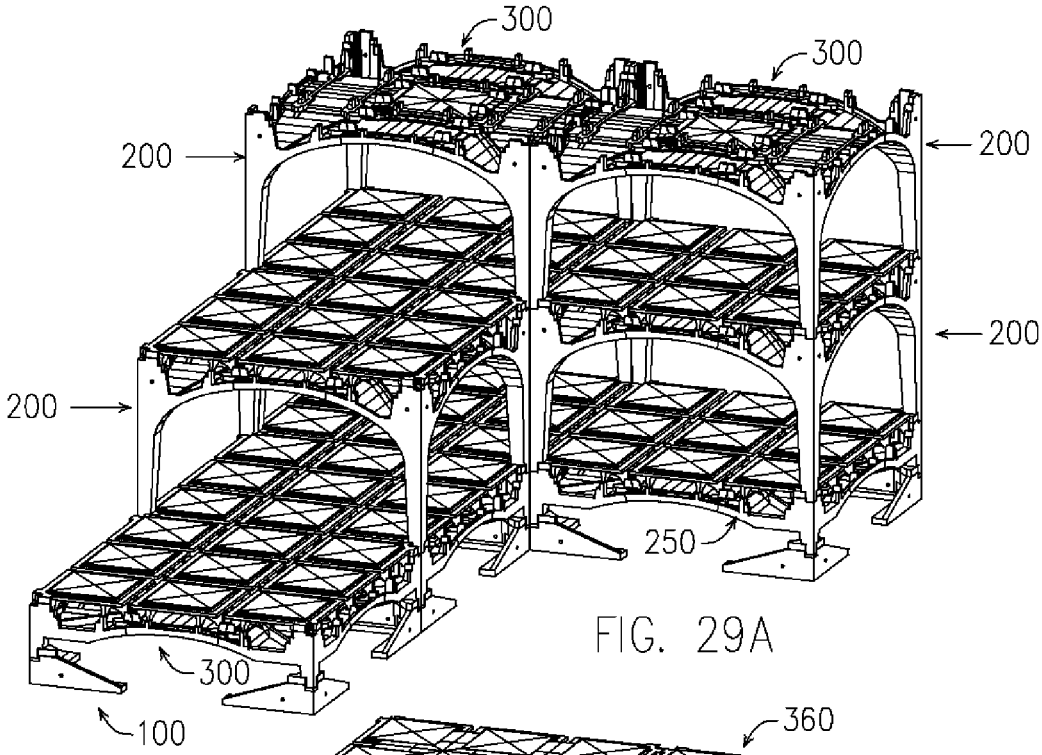
FIG. 29A is perspective view of the embodiment of FIG. 28B with level 3 structural shell completed.
Figure 29B:
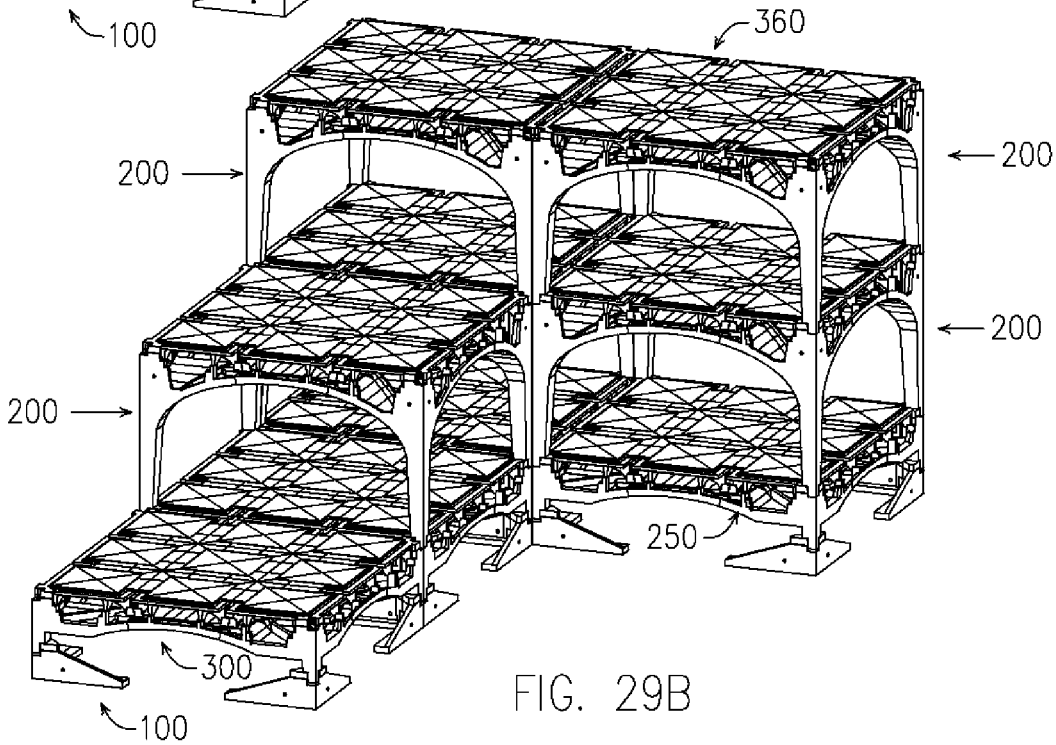
FIG. 29B is a perspective view of the embodiment of FIG. 29A with level 3 access floor/terrace system installed.

Referring now to FIG. 26B, the construction of upper levels of the stackable structure proceeds in a similar manner, except that corner blocks 200 are substituted for base blocks 250. Referring now to FIGS. 27A-27E corner blocks 200 are seated into receivers formed by base blocks 250 and corner pan blocks 380 working in tandem, or by upper level corner block 200 and corner pan blocks 380 in a multi-story structure. FIG. 28A shows the structure of FIG. 26B after the installation of second floor key blocks 300 and center blocks 350. FIG. 28B shows the same structure after the installation of the level 2 access floor/terrace system 360. FIG. 29A and FIG. 29B show the structure of FIG. 28B with the installation of structural modules and access floor/terrace systems 360 at the third floor.

As previously described, the uppermost level of every part of a structure can be fitted with a rainwater collection system (not shown), unless it is under a roof of another construction. Referring now to FIG. 30, to complete the enclosed structural shell of this system, special framing blocks and interlocking wall blocks 550 are installed, and wall joint seals are installed where needed.

Referring now to FIGS. 31A-31B, FIGS. 32A-32B, and FIGS. 35-39 demonstrate sample assemblies that show some of the potential of this building system. Building blocks that are configured on the basis of use-specific engineering can be use to construct virtually any structure.

DETAILED DESCRIPTION OF EMBODIMENT

Applications

The building system described above, and the methodology presented for the manufacturer of system components, each have a very broad range of potential application. Building system embodiments can range from large-scale building and bridge structures to desk-top models. The described manufacturing methodology offers a means of producing virtually any 3D shape, for any use. The list of potential applications described below, though broad, is expected to grow.

Manufacturing Methodology

The method of manufacture described above is not system-dependent, and may be utilized to accurately produce virtually any 3D shape. The produced shape may be a building block of the embodiment, a sculpture, or any other shape whose geometry, scale and use are determined by its designer.

Building System

As previously described, this system of interlocking building blocks may be used to build a variety of structural forms across a range of scales. Each embodiment will require an engineering evaluation to determine the geometry and reinforcement of each block on the basis of the structure's scale and intended use.

Reduced Scale

As described above, this building system is scalable. It may be built at the scale of a desktop toy; one that children and adults will enjoy building with, and one that potential building owners and design professionals can use to model and market their buildings, and to determine which building blocks they need to order. This system may also be built at intermediate scales and of varying materials as necessary to construct pedestal floor systems, furnishings, and other utility structures.

Buildings

Full scale systems can be used to construct buildings, long-span structures, and transportation structures. Building applications include but are not limited to the construction of residential, commercial, institutional, and industrial space, as well as the construction of open canopies and agricultural structures. Because of its underfloor plenum and the attendant ease of system reconfiguration, this building system is particularly well suited to office and retail use. Because of its structural durability, it is well suited for use in housing, school and hospital projects. The ability to quickly assemble, disassemble, and move these structures makes them excellent candidates for use as temporary buildings, emergency shelters, and military structures. This system can be configured using thicker hardened shells, wrapped in segmental concrete walls, and buried to become an earth sheltered structure in extreme climates or for increased blast resistance.

Transportation Structures

Figure 32A:
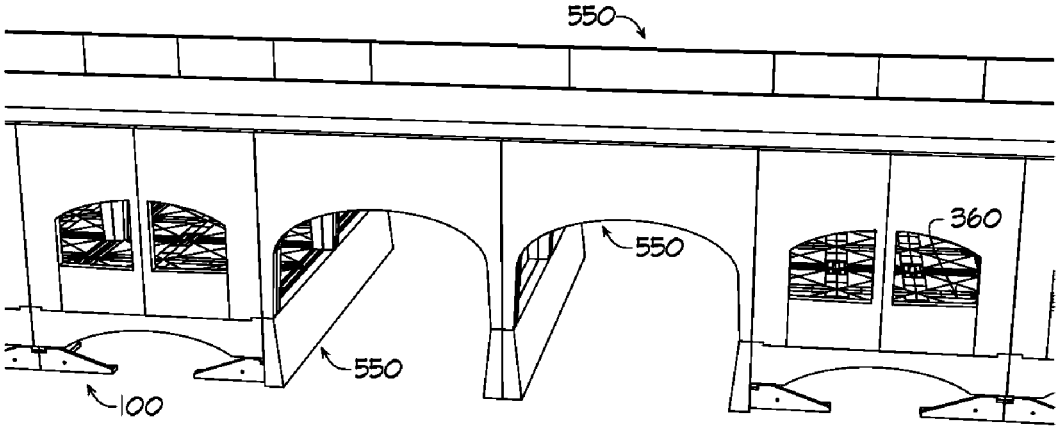
FIG. 32A is a top perspective view of a sample elevated roadway assembly.
Figure 32B:
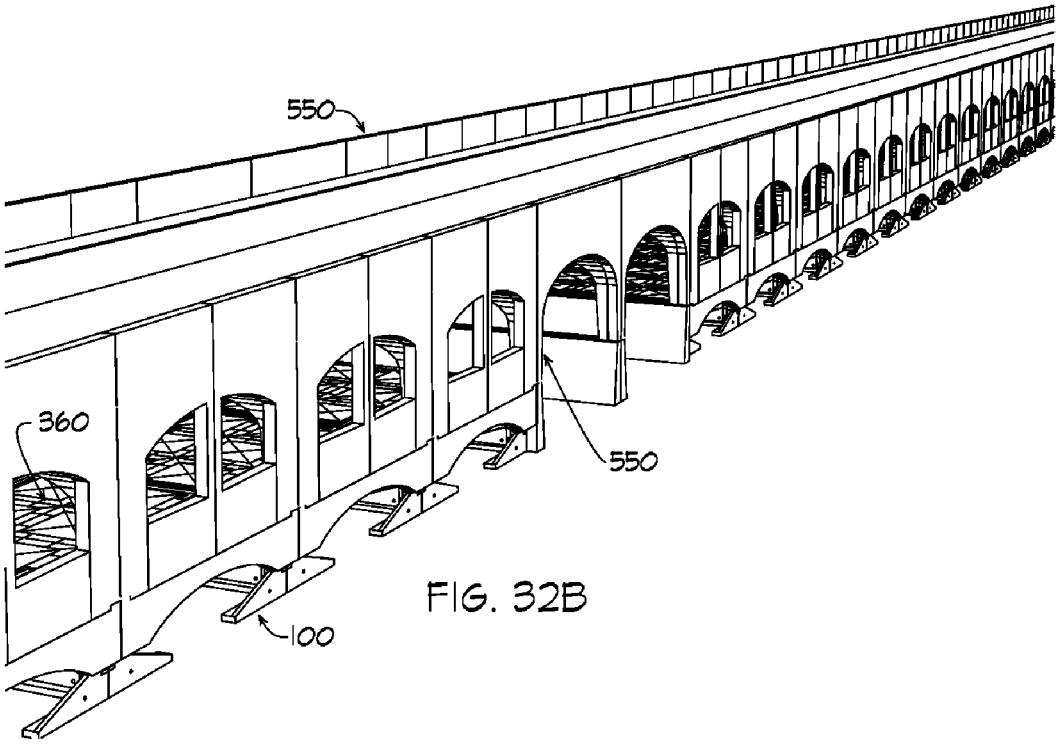

Referring now to FIGS. 32A-32B, structural applications of this building system may include bridges, elevated roadways, parking garages, and other transportation structures. These figures are intended to be schematic representations of this concept; in an actual application the exterior wall blocks might be of varied architecture and feature canopies and changes in facade. They can be configured to produce large blocks of monolithic architecture or provided with a mixed architectural pallet to create a streetscape. Blocks can be produced to deliver the structural capacity necessary to carry roadway and rail traffic, and to potentially be filled with gravel and/or road base material. Because compression structures tend to undergo very small deflections under load, it is anticipated that an elevated roadway of this system can offer occupied space below a roadway with little or no occupant perception of the roadway traffic above. An investment in an elevated roadway structure of this system can therefore offer unique potential for providing attractive shelter for public or privately owned office, retail, residential, civic, or industrial space at ground level, while putting freeway or tollway traffic on the roof.

The invention claimed is:

1. A structure comprising a first module having at least a first side, a second side, and a third side, the first module comprising a first corner block, a second corner block, and a third corner block, each corner block comprising an upper portion, and a lower portion, such that the cross sectional area of the upper portion is substantially greater than the cross sectional area of the lower portion;

a first corner block sloped bearing surface, and a second corner block sloped bearing surface;

a plurality of corner block supports, such that each corner block support accepts the lower portion of at least one of the corner blocks; and a first key block, a second key block, and a third key block, each key block comprising a first key block sloped bearing face, and a second key block sloped bearing face, such that the first side is formed by the first key block partially overlapping and interlocking with a portion of the first corner block and the second corner block, such that the first key block first key block sloped bearing face mates with the first corner block first corner block sloped bearing surface; and the first key block second key block sloped bearing face mates with the second corner block second corner block sloped bearing surface and the second side is formed by the second key block partially overlapping and interlocking with a portion of the second corner block and the third corner block such that the second key block first key block sloped bearing face mates with the second corner block first corner block sloped bearing surface; and the second key block second key block sloped bearing face mates with the third corner block second corner block sloped bearing surface.

2. The structure of claim 1 wherein the first module has n sides, where n is greater than 3, the first module comprising n corner blocks;

n corner block supports, such that each corner block support accepts the lower portion of a corner block; and n key blocks, such that a key block is placed between a pair of adjacent corner blocks.

3. The structure of claim 1 further comprising a fourth corner block comprising a first corner block sloped bearing surface and a second corner block sloped bearing surface;

a fourth key block comprising a first key block sloped bearing face, and a second key block sloped bearing face;

such that the third side is formed by the third key block partially overlapping and interlocking with a portion of the third corner block and the fourth corner block such that the third key block first key block sloped bearing face mates with the third corner block first corner block sloped bearing surface; and the third key block second key block sloped bearing face mates with the fourth corner block second corner block sloped bearing surface; and a fourth side is formed by the fourth key block partially overlapping and interlocking with a portion of the fourth corner block and the first corner block, such that the fourth key block first key block sloped bearing face mates with the fourth corner block first corner block sloped bearing surface; and the fourth key block second key block sloped bearing face mates with the first corner block second corner block sloped bearing surface.

4. The structure of claim 1 wherein one of the plurality of corner block supports holds the first corner block in a substantially upright position until additional interlocking blocks are placed on the first corner block.

5. The structure of claim 1 wherein the first module is stacked above a second module, the second module comprising a plurality of corner blocks; and the first corner block, the second corner block, and the third corner block of the first module serve as corner block supports for the plurality of corner blocks of the second module.

6. The structure of claim 1 wherein the first key block, the second key block, and the third key block each further comprise a pair of eyes in proximity to the first key block sloped bearing face, and a pair of eyes in proximity to the second key block sloped bearing face; and the first corner block, the second corner block, and the third corner block each further comprise a pair of plinths in proximity to the first corner block sloped bearing surface, and a pair of plinths in proximity to the second comet block sloped bearing surface, such that the pair of eyes in proximity to the first key block sloped bearing face overlaps pair of plinths in proximity to the first corner block sloped bearing surface.

7. The structure of claim 1 wherein the first key block, the second key block, and the third key block each further comprise a plurality of sloped center block mating surfaces;

the first module further comprises a center block having a first side, a second side, and a third side such that each key block supports one side of the center block.

8. The structure of claim 1 wherein the first module further comprises a plurality of pan blocks, such that the pan blocks are supported in an interlocking fashion with the corner blocks and key blocks.

9. The structure of claim 8 further comprising a recess in each pan block; and a plurality of floor infill blocks.

10. The structure of claim 1 wherein the first module has four sides, four corner blocks, and four edge blocks.

11. The structure of claim 10 wherein
the first module has a square cross section.
12. The structure of claim 1 wherein
the first module is erected by placing the corner blocks and key blocks without fasteners.
13. The structure of claim 1 wherein
the structure comprises a building.
14. The structure of claim 1 wherein
the first module supports a floor, such that the floor comprises
a plurality of pan blocks supported by the corner blocks and key blocks,
a plurality of cap blocks supported by the pan blocks, and
a plurality of floor infill blocks supported by the pan blocks.
15. The structure of claim 1 wherein the first corner block further comprises
a base;
a substantially solid lower portion; and
a polygonal cross section thin shell construction upper portion.
16. The structure of claim 15 wherein the first corner block further comprises
a substantially vertical pipe through the lower portion and through the base.
17. The structure of claim 1 wherein
no grout is applied between the corner blocks and key blocks.
18. The structure of claim 1 wherein
the corner blocks and key blocks of the first module are precast.
19. The structure of claim 17 wherein
the structure is self-supporting.
20. The structure of claim 1 wherein
the upper portions of the corner blocks of the first module are arched.
21. The structure of claim 1 wherein the key blocks are arched.
22. The structure of claim 1 wherein the first module further comprises
at least one demountable wall block.
23. The structure of claim 1 further comprising
a second module in proximity to the first module, the second module having at least a first side, a second side, and a third side, the first module comprising a first corner block, a second corner block, and a third corner block each corner block comprising
an upper portion, and
a lower portion,
such that the cross sectional area of the upper portion is substantially greater than the cross sectional area of the lower portion
a first corner block sloped bearing surface, and
a second corner block sloped bearing surface;
plurality of corner block supports, such that each corner block support accepts the lower portion of at least one of the corner blocks; and
a first key block, a second key block, and a third key block, each key block comprising
a first key block sloped bearing face, and
a second key block sloped bearing face,
such that the first side is formed by
the first key block partially overlapping and interlocking with a portion of the first corner block and the second corner block such that
the first key block first key block sloped bearing face mates with the first corner block first corner block sloped bearing surface; and
the first key block second key block sloped bearing face mates with the second corner block second corner block sloped bearing surface, and
the second side is formed by
the second key block partially overlapping and interlocking with a portion of the second corner block and the third corner block, such that
the second key block first key block sloped bearing face mates with the second corner block first corner block sloped bearing surface; and
the second key block second key block sloped bearing face mates with the third corner block second corner block sloped bearing surface.
24. The structure of claim 23 further comprising
a third module in proximity to the second module, the third module having at least a first side, a second side, and a third side, the first module comprising a first corner block a second corner block and a third corner block each corner block comprising
an upper portion and
a lower portion
such that the cross sectional area of the upper portion is substantially greater than the cross sectional area of the lower portion
a first corner block sloped bearing surface, and
a second corner block sloped bearing surface;
plurality of corner block supports, such that each corner block support accepts the lower portion of at least one of the corner blocks; and
a first key block, a second key block, and a third key block each key block comprising
a first key block sloped bearing face, and
a second key block sloped bearing face,
such that the first side is formed by
the first key block partially overlapping and interlocking with a portion of the first corner block and the second corner block, such that
the first key block first key block sloped bearing face mates with the first corner block first corner block sloped bearing surface; and
the first key block second key block sloped bearing face mates with the second corner block second corner block sloped bearing surface, and
the second side is formed by
the second key block partially overlapping and interlocking with a portion of the second corner block, and the third corner block, such that
the second key block first key block sloped bearing face mates with the second corner block first corner block sloped bearing surface; and
the second key block second key block sloped bearing face mates with the third corner block second corner block sloped bearing surface.
25. The structure of claim 24 wherein
the third module supports a roof.
26. The structure of claim 25 wherein
the roof comprises a plurality of wet panels.
27. The structure of claim 25 wherein the roof further comprises
floor infill panels comprising wooden deck blocks.

* * * * *